US009176406B2

(12) United States Patent
Sekiguchi et al.

(10) Patent No.: US 9,176,406 B2
(45) Date of Patent: Nov. 3, 2015

(54) TONER, DEVELOPMENT AGENT, IMAGE FORMING APPARATUS, AND PROCESS CARTRIDGE

(71) Applicants: Satoyuki Sekiguchi, Shizuoka (JP); Hiroshi Yamashita, Shizuoka (JP); Minoru Masuda, Shizuoka (JP); Susumu Chiba, Shizuoka (JP); Tatsuya Morita, Kanagawa (JP); Atsushi Yamamoto, Osaka (JP); Shinya Nakayama, Shizuoka (JP); Masahide Yamada, Shizuoka (JP); Kohsuke Nagata, Shizuoka (JP); Keiji Makabe, Shizuoka (JP); Toyoshi Sawada, Kanagawa (JP)

(72) Inventors: Satoyuki Sekiguchi, Shizuoka (JP); Hiroshi Yamashita, Shizuoka (JP); Minoru Masuda, Shizuoka (JP); Susumu Chiba, Shizuoka (JP); Tatsuya Morita, Kanagawa (JP); Atsushi Yamamoto, Osaka (JP); Shinya Nakayama, Shizuoka (JP); Masahide Yamada, Shizuoka (JP); Kohsuke Nagata, Shizuoka (JP); Keiji Makabe, Shizuoka (JP); Toyoshi Sawada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/958,745

(22) Filed: Aug. 5, 2013

(65) Prior Publication Data

US 2014/0051019 A1 Feb. 20, 2014

(30) Foreign Application Priority Data

| | | |
|---|---|---|
| Aug. 17, 2012 | (JP) | 2012-181118 |
| Sep. 4, 2012 | (JP) | 2012-194240 |
| Sep. 14, 2012 | (JP) | 2012-202977 |
| Nov. 1, 2012 | (JP) | 2012-241774 |
| Mar. 8, 2013 | (JP) | 2013-046796 |

(51) Int. Cl.
*G03G 9/00* (2006.01)
*G03G 9/087* (2006.01)

(Continued)

(52) U.S. Cl.
CPC ..... *G03G 9/08764* (2013.01); *G03G 9/0804* (2013.01); *G03G 9/08755* (2013.01); *G03G 9/08795* (2013.01); *G03G 9/08797* (2013.01)

(58) Field of Classification Search
USPC ..... 430/109.1, 109.5, 109.4; 399/252
See application file for complete search history.

(56) References Cited

U.S. PATENT DOCUMENTS

| | | | |
|---|---|---|---|
| 2004/0043318 | A1 | 3/2004 | Sato et al. |
| 2004/0152003 | A1 | 8/2004 | Sato et al. |

(Continued)

FOREIGN PATENT DOCUMENTS

| | | |
|---|---|---|
| JP | 62-070859 | 4/1987 |
| JP | 62-070860 | 4/1987 |

(Continued)

OTHER PUBLICATIONS

Japanese Publication Submission Paper issued Sep. 29, 2014 in Patent Application No. 2012-18118 (with English Translation).

(Continued)

*Primary Examiner* — Thorl Chea
(74) *Attorney, Agent, or Firm* — Oblon, McClelland, Maier & Neustadt, L.L.P.

(57) ABSTRACT

Toner contains a binder resin containing a crystalline resin having a urethane and/or urea bonding; and a colorant, wherein in a diffraction spectrum of the toner as measured by an X-ray diffraction instrument, a ratio {C/(C+A)} of an integral intensity C of the spectrum derived from the crystalline structure to an integral intensity A of the spectrum derived from the non-crystalline structure is 0.12 or greater, wherein the toner satisfies the following relation 1: T1−T2≤30° C. (Relation 1), where T1 represents the maximum endothermic peak in the first temperature rising from 0° C. to 100° C. at the temperature rising rate of 10° C./min and T2 represents the maximum exothermic peak in the first temperature falling from 100° C. to 0° C. at the temperature falling rate of 10° C./min as T1 and T2 are measured by diffraction scanning calorimetry (DSC).

18 Claims, 4 Drawing Sheets

(51) Int. Cl.

| | |
|---|---|
| ***G03G 9/13*** | (2006.01) |
| ***G03G 9/08*** | (2006.01) |

(56) References Cited

U.S. PATENT DOCUMENTS

| | | | | |
|---|---|---|---|---|
| 2004/0229150 | A1* | 11/2004 | Miyazaki et al. | 430/111.4 |
| 2005/0130080 | A1 | 6/2005 | Sato et al. | |
| 2005/0245694 | A1 | 11/2005 | Matsumura et al. | |
| 2008/0050669 | A1* | 2/2008 | Ohmura et al. | 430/109.4 |
| 2008/0107991 | A1 | 5/2008 | Hamano | |
| 2008/0213682 | A1 | 9/2008 | Saitoh et al. | |
| 2009/0010687 | A1* | 1/2009 | Yamada et al. | 399/327 |
| 2011/0065039 | A1 | 3/2011 | Ota et al. | |
| 2011/0171574 | A1* | 7/2011 | Hara et al. | 430/137.11 |
| 2012/0282000 | A1 | 11/2012 | Nakayama et al. | |
| 2013/0078563 | A1 | 3/2013 | Nakayama et al. | |
| 2013/0095422 | A1 | 4/2013 | Yamamoto et al. | |
| 2013/0115550 | A1 | 5/2013 | Amemori et al. | |
| 2013/0130169 | A1 | 5/2013 | Aoki et al. | |

FOREIGN PATENT DOCUMENTS

| | | | |
|---|---|---|---|
| JP | 9-329917 | | 12/1997 |
| JP | 2001-42564 | | 2/2001 |
| JP | 2001-305796 | | 11/2001 |
| JP | 2002-194234 | | 7/2002 |
| JP | 2004-038115 | | 2/2004 |
| JP | 2004-240421 | A | 8/2004 |
| JP | 2004-264320 | A | 9/2004 |
| JP | 2005-173063 | | 6/2005 |
| JP | 2006-208609 | | 8/2006 |
| JP | 2006-251564 | | 9/2006 |
| JP | 2006-276305 | | 10/2006 |
| JP | 2007-58138 | | 3/2007 |
| JP | 2008-15232 | A | 1/2008 |
| JP | 2008-52192 | A | 3/2008 |
| JP | 2008-116613 | A | 5/2008 |
| JP | 2008-233406 | A | 10/2008 |
| JP | 2010-077419 | | 4/2010 |
| JP | 2010-151996 | A | 7/2010 |
| JP | 2010-217849 | A | 9/2010 |
| JP | 2011-095608 | | 5/2011 |
| JP | 2011-148963 | A | 8/2011 |
| JP | 2012-027212 | | 2/2012 |
| JP | 2012-42939 | A | 3/2012 |
| JP | 2012-118466 | A | 6/2012 |
| JP | 2012-168505 | | 9/2012 |

OTHER PUBLICATIONS

Japanese Publication Submission Paper issued Sep. 30, 2014 in Patent Application No. 2012-18118 (with English Translation).

Japanese Publication Submission Paper issued Sep. 29, 2014 in Patent Application No. 2012-202977 (with English Translation).

Japanese Publication Submission Paper issued Oct. 2, 2014 in Patent Application No. 2012-202977 (with English Translation).

Japanese Office Action issued Jul. 16, 2014, in Japan Patent Application No. 2012-181118.

Japanese Office Action issued Jul. 22, 2014, in Japan Patent Application No. 2012-202977.

* cited by examiner

TONER, DEVELOPMENT AGENT, IMAGE FORMING APPARATUS, AND PROCESS CARTRIDGE

CROSS-REFERENCE TO RELATED APPLICATIONS

This patent application is based on and claims priority pursuant to 35 U.S.C. §119 to Japanese Patent Application Nos. 2012-181118, 2012-194240, 2012-202977, 2012-241774, and 2013-046796, filed on Aug. 17, 2012, Sep. 4, 2012, Sep. 14, 2012, Nov. 1, 2012, and Mar. 8, 2013, respectively, in the Japan Patent Office, the entire disclosures of which are hereby incorporated by reference herein.

BACKGROUND

1. Technical Field

The present invention relates to toner and a development agent, an image forming apparatus, and a process cartridge that use the toner.

2. Background Art

Latent images formed electrically or magnetically are typically rendered visible by an electrophotographic image forming apparatus using toner (electrophotographic toner). For example, in electrophotography, electrostatic images (latent images) are formed on an image bearing member (typically a photoreceptor) and developed with toner to form visible toner images. The toner image is then transferred onto a transfer medium, typically paper, and thereafter fixed thereon. In the process in which the toner image is fixed on the transfer medium, a thermal fixing device such as a heating roller fixing system or a heating belt fixing system is generally used for better energy efficiency.

In recent years, demand for ever faster, more energy-efficient image forming apparatuses has continued to grow. Toner having excellent low-temperature fixability and providing quality images is one of the keys to satisfying such demand.

To attain toner having excellent low-temperature fixing, binder resins forming the toner are required to have low softening temperatures. However, when the softening temperature of the binder resin is low, part of the toner image easily adheres to the surface of the fixing device when fixing the image and is transferred onto the transfer medium (so-called offset, also referred to as hot offset).

In addition, the ability of the toner to withstand high temperatures also deteriorates, leading to clumping (in which the toner particles stick to each other) under high-temperature conditions in particular. Furthermore, there are other problems, such that the toner particles adhere to the inside of a development device or to carrier particles, thereby contaminating the development device or causing toner filming on the surface of the image bearing member.

To solve these problems, use of crystalline resins as the binder resins for toner is known.

Crystalline resins quickly soften at their melting points so that it is possible to lower the softening point of the toner to around its melting point while securing excellent high-temperature stability at the melting point or temperatures lower than that. Therefore, such toner can have a good combination of low-temperature fixing and high-temperature stability.

For example, JP-H04-24702-B (JP-S62-070859-A) and JP-H04-24703-B (JP-S62-070860-A) disclose toners using crystalline resins elongated from a crystalline polyester by diisocyanate as the binder resins.

These toners have excellent low-temperature fixing properties but insufficient hot offset resistance, which is not satisfactory in terms of the level of quality currently required.

In addition, JP-3910338-B1 (JP-2001-305796-A) discloses toner that uses a crystalline resin having a cross-linked structure formed by unsaturated linking containing a sulfonic acid group.

This toner can overcome hot offset in comparison with conventional toner. Further, JP-2010-77419-A discloses regulating the ratio of the softening point to the peak temperature of the melting heat and viscoelasticity to obtain an excellent combination of low-temperature fixability and high-temperature stability.

However, these toners having crystalline resins as the main component of their binder resins, although they have excellent impact resistance, also exhibit poor indentation hardness (e.g., Vickers hardness). As a consequence, due to the stirring stress in a development device, carrier and a machine are easily contaminated and toner filming on a photoreceptor tends to occur. Also, the chargeability and fluidity tend to deteriorate because of burial of an external additive.

In addition, recrystallization of toner melted on a fixing medium during heat fixing takes a time, thereby delaying recovery of the hardness of the image surface.

For this reason, a mark of the discharging roller used in the sheet discharging conducted after fixing is left on the image surface, which causes a change of the gloss or damage.

Moreover, even if the hardness of the image surface is restored by the recrystallization of the toner, the hardness is not sufficient, so that the image is still vulnerable to scratch or abrasion.

JP-3360527-B1 (JP-H09-329917-A) discloses improvement of the stress resistance of toner by regulating the durometer hardness of a crystalline resin in the toner and containing inorganic particulates in the toner. Although successful in some degree, it does not have an impact on a mark of the roller left after fixing or improve the image hardness sufficiently. In addition, the low temperature fixability is worsened by the inorganic particulates. Consequently, this improvement does not stretch the advantage of the fixability of the crystalline resin to the full.

Unlike the above-mentioned, for example, JP-3949526-B1 (JP-2004-038115-A) and JP-4513627-B1 (JP-2006-276305-A) disclose a combinational use of a crystalline resin and a non-crystalline resin instead of using a crystalline resin as the main component.

These toners compensate the defect about the hardness of crystalline resins by the non-crystalline resin but are not capable of exhibiting the power of the crystalline resin for the low temperature fixability improvement to the full.

SUMMARY

The present invention provides toner that contains a binder resin containing a crystalline resin having a urethane and/or urea bonding; and a colorant, wherein in a diffraction spectrum of the toner as measured by an X-ray diffraction instrument, a ratio {C/(C+A)} of an integral intensity C of the spectrum derived from the crystalline structure to an integral intensity A of the spectrum derived from the non-crystalline structure is 0.12 or greater, wherein the toner satisfies the following relation 1: $T1-T2 \leq 30°$ C. (Relation 1), where T1 represents the maximum endothermic peak in the first temperature rising from 0° C. to 100° C. at the temperature rising rate of 10° C./min and T2 represents the maximum exothermic peak in the first temperature falling from 100° C. to 0° C.

at the temperature falling rate of 10° C./min as T1 and T2 are measured by diffraction scanning calorimetry (DSC).

As another aspect of the present invention, a development agent is provided which contains the toner mentioned above and carrier (toner carrier).

As another aspect of the present invention, an image forming apparatus is provided which includes a latent electrostatic image bearing member; a charger to charge the surface of the latent electrostatic image bearing member; an irradiator to irradiate the charged surface of the latent electrostatic image bearing member with light to form a latent electrostatic image; a development device to develop the latent electrostatic image with the toner mentioned above to form a visible image; a transfer device to transfer the visible image to a recording medium; and a fixing device to fix the transferred image on the recording medium.

As another aspect of the present invention, a process cartridge is provided which includes a latent electrostatic image bearing member to bear a latent electrostatic image; and a development device to develop the latent electrostatic image with the toner mentioned above to form a visible image, wherein the process cartridge is detachably attachable to an image forming apparatus.

BRIEF DESCRIPTION OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

DETAILED DESCRIPTION

Figure 1A:
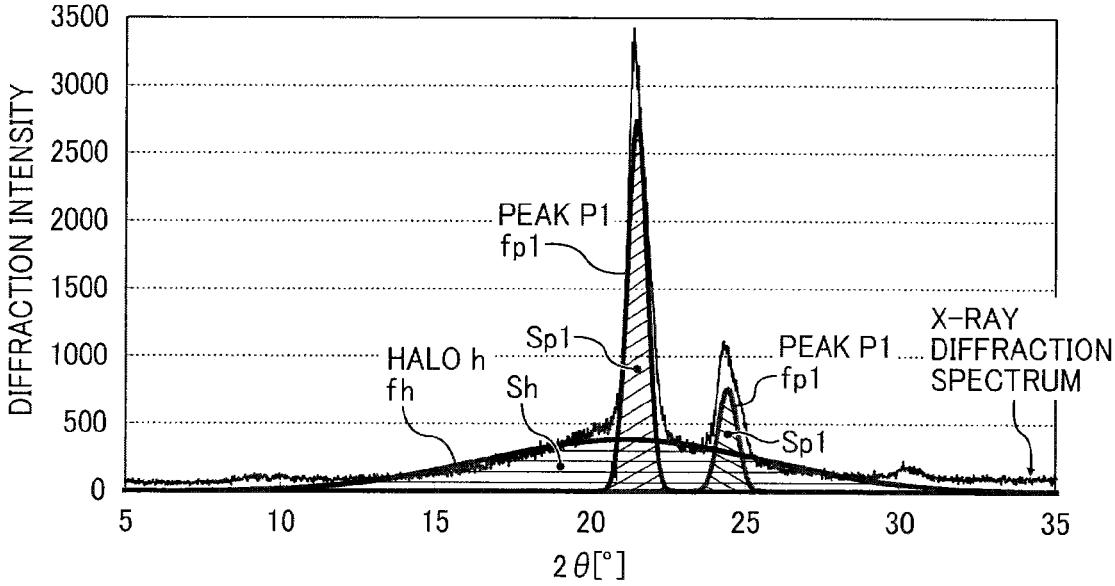
FIGS. 1A and 1B are graphs illustrating a method of calculating the crystallinity of toner according to an embodiment of the present disclosure after fitting.

As a result of an investigation, the present inventors have found that by using toner which contains a binder resin containing a crystalline resin having a urethane and/or urea bonding; and a coloring agent, wherein in a diffraction spectrum of the toner as measured by an X-ray diffraction instrument, a ratio {C/(C+A)} of an integral intensity C of a spectrum derived from a crystalline structure to an integral intensity A of a spectrum derived from a non-crystalline structure is 0.12 or greater, wherein the toner satisfies the following relation 1:

$$T1-T2\leq 30^\circ\ \text{C.} \qquad \text{Relation 1}$$

where T1 represents a maximum endotherm peak in a first temperature rising from 0° C. to 100° C. at a temperature rising rate of 10° C./min and T2 represents a maximum exotherm peak in a first temperature falling from 100° C. to 0° C. at a temperature falling rate of 10° C./min as T1 and T2 are measured by diffraction scanning calorimetry (DSC), the crystalline resin is recrystallized quickly, thereby preventing occurrence of damage to an image during transfer in the paper path and improving the hardness of the image without degrading the stress durability of the toner.

The toner of the present disclosure contains a crystalline resin having a urethane bonding and/or urea bonding and other optional components. The crystalline resin having a urethane bonding and/or urea bonding is preferably a crystalline polyester resin.

In addition, the toner of the present disclosure has a ratio {C/(C+A)} of 0.12 or greater, more preferably 0.15 or greater, furthermore preferably 0.17 or greater, and particularly more preferably 0.20 or greater where C represents the integral intensity of the spectrum derived from the crystalline structure of the binder resin and A represents the integral intensity of the spectrum derived from the non-crystalline structure of the binder resin in the diffraction spectrum obtained by an X-ray diffraction device.

Also, to prevent the occurrence of damage to image during transfer in the paper path, the toner of the present disclosure satisfies the following relation 1:

$$T1-T2\leq 30^\circ\ \text{C.} \qquad \text{Relation 1}$$

where T1 represents a maximum endotherm peak in the first temperature rising and T2 represents a maximum exotherm peak in the first temperature falling as T1 and T2 are measured by diffraction scanning calorimetry (DSC), in which the speed of the first temperature rising from 0° C. to 100° C. is 10° C./min and the speed of the first temperature falling from 100° C. to 0° C. is 10° C./min.

In the present disclosure, there is no specific limit to the selection of the crystalline polyester resin having a urethane bonding and/or a urea bonding for use in the binder resin. It is preferable to use a crystalline polyester resin having a urethane bonding and/or a urea bonding and a non-modified crystalline polyester resin.

Since the binder resin contains at least a crystalline polyester resin having a urethane bonding and/or a urea bonding and a non-modified polyester crystalline resin, it is possible to prevent damage received in the transfer path and improve the strength of an output image while striking a balance between the low temperature fixability and the high temperature stability at a high level.

This is possible because the mechanical strength of an output image increases before the output image reaches any transfer member that causes damage thereto by a combinational usage of a crystalline resin having a urethane bonding and/or a urea bonding, which has a high agglomeration energy capable of improving the hot offset resistance, the high temperature stability, and the strength of the output image and a non-modified crystalline resin capable of improving the re-crystallization speed of the image after fixing by heat.

Since it is preferable that the non-modified polyester crystalline resin and the crystalline polyester resin having a urethane bonding and/or a urea bonding are uniformly mixed in an image, it is preferably that both are uniformly mixed or distributed inside the toner. In terms of uniform mixing and dispersion inside toner particles, the non-modified crystalline polyester resin preferably has a skeleton similar to that of the crystalline polyester portion in the crystalline polyester resin having a urethane bonding and/or a urea bonding.

The content of the crystalline polyester resin in the toner is 50% by weight or more, preferably 60% by weight or more, more preferably 75% by weight or more, and furthermore preferably 80% by weight or more. When the content ratio is too low, the low temperature fixability tends to deteriorate.

Non-Modified Crystalline Polyester

The non-modified crystalline polyester resin is a polyester polyol obtained by using a polyol component and a polycarboxylic acid component such as a polycarboxylic acid, a polycarboxylic acid anhydride, and a polycarboxylic acid ester.

In the present disclosure, as described above, the crystalline polyester resin is obtained by using a polyol component and a polycarboxylic acid component such as a polycarboxylic acid, a polycarboxylic acid anhydride, and a polycarboxylic acid ester. The crystalline polyester resin includes no modified polyester resin.

Polyol Component

There is no specific limit to the polyol component. For example, diols and alcohols having three or more hydroxyl groups are suitable.

An example of diol is a saturated aliphatic diol.

Specific examples of the saturated aliphatic diols are classified into the straight chain type saturated aliphatic diol and the branch-chain type saturated aliphatic diol. The straight-chain type saturated aliphatic diols are preferable and the straight-chain type saturated aliphatic diols having 4 to 12 carbon atoms are more preferable.

If the aliphatic diols are of a branch type, the crystalline level of the crystalline polyester resin decreases, resulting in a drop of the melting point thereof.

In addition, when the number of carbon atoms in the main chain is too small, for example 4, the melting point tends to become high if conducting polycondensation with an aromatic dicarboxylic acid, which makes low temperature fixing difficult.

When the number of carbon atoms is too large, practical materials are not easily available. The number of the carbon atoms in the main chain is preferably 12 or less.

Specific examples of the saturated aliphatic diols include, but are not limited to, ethylene glycol, 1,3-propane diol, 1,4-butane diol, 1,5-pentane diol, 1,6-hexane diol, 1,7 heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,14-eicosane decane diol.

Among these, in terms that the crystalline polyester resin has a high crystallinity and an excellent sharp melting property, ethylene glycol, 1,4-butane diol, 1,6-hexane diol, 1,8-octane diol, 1,10-decane diol, and 1,12-dodecane diol are preferable.

Specific examples of the alcohols having three or more hydroxyl groups include, but are not limited to, glycerin, trimethylol ethane, trimethylol propane, and pentaerythritol.

These can be used alone or in combination.

Polycarboxylic Acid Component

There is no specific limit to the polycarboxylic acid. For example, dicarboxylic acids and tri- or higher carboxylic acids are suitable.

Specific examples of dicarboxylic acids include, but are not limited to, saturated aliphatic dicarboxylic acids such as oxalic acid, succinic acid, glutaric acid, adipic acid, acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid; aromatic dicarboxylic acids of dibasic acids such as phthalic acid, isophthalic acid, terephthalic acid, naphthalene-2,6-dicarboxylic acid, malonic acid, and mesaconic acid; and anhydrides or lower alkylesters thereof.

Specific examples of the tri- or higher carboxylic acids include, but are not limited to, 1,2,4-benzene tricarboxylic acid, 1,2,5-benzene tricarboxylic acid, 1,2,4-naphtalene tricarboxylic acid, and their anhydrides or lower alkyl esters.

In addition to the above-specified aliphatic dicarboxylic acids and the aromatic dicarboxylic acids, the polycarboxylic acid components includes diacarboxylic acid components having a sulfonate group.

In addition to the above-specified aliphatic dicarboxylic acids and the aromatic dicarboxylic acids, diacarboxylic acid components having carbon-carbon double bond can be suitably contained as the carboxylic acid component in the polycarboxylic acid.

These can be used alone or in combination.

A non-modified crystalline polyester resin having a unit derived from a saturated aliphatic dicarboxylic acid having 4 to 12 carbon atoms and a unit derived from a saturated aliphatic diol having 2 to 12 carbon atoms is preferable because such a resin has a high crystallinity and an excellent sharp melting property, thereby demonstrating an excellent low temperature fixability.

The non-modified crystalline polyester resin preferably has a melting point of from 50° C. to 80° C.

When the melting point is too low, the non-modified crystalline polyester resin tends to melt, thereby degrading the high temperature stability of toner. When the melting point is too high, the crystalline polyester resin does not melt sufficiently by heating during fixing, thereby degrading the low temperature fixability.

The melting point can be obtained by the endotherm peak value shown in DSC chart in differential scanning calorimetry (DSC) measuring.

There is no specific limit to the molecular weight of the non-modified crystalline polyester resin. Since a non-modified crystalline polyester resin having a sharp molecular weight distribution and a low molecular weight has an excellent low temperature fixability but a degraded high temperature stability if it contains a low molecular weight component in a large amount, the tetrahydrofuran (THF) solubles of the non-modified crystalline polyester resin preferably has a weight average molecular weight (Mw) of from 3,000 to 30,000, a number average molecular weight (Mn) of from 1,000 to 10,000, and an Mw/Mn of from 1.0 to 10.

The weight average molecular weight (Mw), the number average molecular weight (Mn), and the ratio Mw/Mn are more preferably from 5,000 to 15,000, from 2,000 to 10,000, and from 1.0 to 5.0, respectively.

The content of the non-modified crystalline polyester resin in the crystalline polyester resin is preferably from 2% by weight to 50% by weight and more preferably from 4% by weight to 40% by weight.

When the content is too small, the output image is vulnerable to damage during transfer in the transfer path. When the content is too large, the hot offset resistance tends to be inferior.

Crystalline Polyester Resin Having Urethane Bonding and/or Urea Bonding

The crystalline polyester resin having a urethane bonding and/or a urea bonding is prepared by reaction of the non-modified crystalline polyester resin, an isocyanate component, and a curing agent.

It can also be prepared by reaction of a composition containing the non-modified crystalline polyester resin, an isocyanate component, and a curing agent and a diol monomer and an oligomer having a hydroxyl group at its end and/or a non-crystalline polyester resin or reaction of a composition containing a diol monomer having an isocyanate group at its end, an oligomer, and a non-crystalline polyester resin.

The crystalline polyester resin having a urethane bonding and/or a urea bonding preferably has at least one of a urethane bonding and a urea bonding, which have a high agglomeration energy and more preferably at least a urea bonding, which has a higher agglomeration energy.

These bondings have high agglomeration energy and behave like cross-linking points, so that the molecular chain forms three-dimensional network structure, which makes it possible to sustain good high temperature stability and hot offset resistance.

Diisocyanate Component

A preferable isocyanate component is diisocyanate.

Specific examples of the diisocyaante components include, but are not limited to, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified by a urethane group, a cabodiimide group, an allophanate group, a urea group, a biuret group, a uretdione group, a uretimine group, an isocyanulate group, and an oxazoline group), and mixtures thereof, in which the number of carbon atoms specified above excludes the number of carbon atoms in NCO group).

Optionally, tri- or higher isocynates can be used in combination therewith.

Specific examples of the aliphatic diisocyanates (including tri- or higher isocyanates) include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl)fumarate, bis(2-isocyanato ethyl)carbonate, and 2-isocyanatoethyl-2,6-diisocyanato hexanoate.

Specific examples of the alicyclic isocyanates include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate.

Specific examples of the aromatic aliphatic diisocyanates include, but are not limited to, m- and/or p-xylylene diisocyanate (XDI), α,α,α',α'-tetramethyl xylylene diisocyanate (TMXDI).

Specific examples of the modified diisocyanates include, but are not limited to, modified compounds having a urethane group, a cabodiimide group, an allophanate group, a urea group, a biuret group, a uretdione group, a uretimine group, an isocyanulate group, and an oxazoline group.

To be specific, these are: modified MDIs such as urethane modified MDI, carbodiimide modified MDI, and trihydrocarbyl phosphate modified MDI), modified compounds of diisocyanates such as urethane modified TDI, and mixtures thereof such as modified MDI and urethane modified TDI (prepolymer containing isocyanate).

Among these, aromatic diisocyanates having 6 to 15 carbon atoms, aliphatic diisocyanates having 4 to 12 carbon atoms, alicyclic diisocyanates having 4 to 15 carbon atoms are preferable. In particular, TDI, MDI, HDI, hydrogenated MDI, and IPDI are preferable.

Known amine-based compounds are suitable as the curing agent to react with isocyanate.

Specific examples diamines (including optionally used tri- or higher amines) thereof include, but are not limited to, aliphatic diamines having 2 to 18 carbon atoms such as (1): aliphetic diamines (including alkylene diamines having 2 to 6 carbon atoms, e.g., ethylene dimaine, trimethylene diamine, tetramethylene diamine, hexamethylene diamine) and polyalkylene diamines having 2 to 6 carbon atoms such as diethylene triamine, iminobis propyl amine, bis(hexamethylene)triamine, triethylene tetramine, tetraethylne pentamine, and pentaethylene hexamine;

(2): substituted compounds thereof with an alkyl group having 1 to 4 carbon atoms or a hydroxyl alkyl having 2 to 4 carbon atoms such as dialkyl (having 1 to 3 carbon atoms) aminopropyl amine, trimethyl hexamethylene diamine, aminoethyl ethanol amine, 2,5-dimethyl-2,5-hexamethylene diamine, and methyl iminobispropyl amine;

(3): alicyclic or heterocyclic aliphatic diamines such as alicyclic diamine having 4 to 15 carbon atoms such as 1,3-diamino cyclohexane, isophorone diamine, menthene diamine, 4,4'-methylene dicyclohexane diamine (hydrogenated methylene dianiline) and heterocyclic diamines having 4 to 15 carbon atoms such as piperazine, N-aminoethyl piperazine, 1,4-diaminoethyl piperazine, 1,4-bis(2-amino-2-methylpropyl)piperazine, 3,9-bis(3-aminopropyl)-2,4,8,10-tetraoxaspiro[5,5]undecane; and (4): aromatic aliphatic amines having 8 to 15 carbon atoms such as xylylene diamine and tetrachlor-p-xylylene diamine.

Specific examples of aromatic diamines having 6 to 20 carbon atoms include, but are not limited to:

(1): Non-substituted aromatic diamine: [1,2-, 1,3-, and 1,4-phenylnene diamine, 2,4'- and 4,4'-dimaphenyl methane diamine, crude diphenyl methane diamine (polyphenyl polymethylene polyamine), dimainodiphenyl sulfon, bendidine, thiodianiline, bis(3,4-diaminophenyl)sulfon, 2,6-diamino pyridine, m-amino benzyl amine, triphenyl methane-4,4'-4"-triamine, and naphthylene diamine;

(2): Aromatic diamines having a nuclear substituted alkyl group (alkyl groups having 1 to 4 carbon atoms such as methyl, ethyl, n- and i-propyl, and butyl) such as 2,4- and 2,6-tolylene diamine, crude tolylene diamine, diethyl tolylene diamine, 4,4'-diamino-3,3'-dimethyl diphenyl methane, 4,4'-bis(o-toluidine), dianisidine, diamino ditolyl sulfon, 1,3-dimethyl-2,4-diamino benzene, 1,3-dimethyl-2,6-simaino benzene, 1,4-diisopropyl-2,5-diamino benzene, 2,4-diamino mesitylene, 1,methyl-3,5-diethyl-2,4-diamino benzene, 2,3-dimethyl-1,4-diamino naphthalene, 2,6-dimethyl-1,5-diamino naphthalene, 3,3'-5,5'-tetramethyl bendidine, 3,3',5,5'-tetramethyl-4,4'-diaminophenyl methane, 3,5-diethyl-3'-methyl-2',4-diaminodiphenyl methane, 3,3-'-diethyl-2,2'-diaminodiphenyl methane, 4,4'-diamino-3,3'-dimethyl dimphenyl methane, 3,3'-5,5'-tetraethyl-4,4'-diamino benzophenone, 3,3'5,5'-tetraethyl-4,4'-diamino diphenyl ether, 3,3'-5,5'-tetraethyle-4,4'-diamino diphenyl ether, 3,3', 5,5' tetraisopropyl-4,4'-diamino diphenyl sulfone, and mixtures of isomers thereof in various ratios;

(3): Aromatic diamines having a nuclear substitution electron withdrawing groups (halogen; i.e., Cl. br, I, F, etc.), alkoxy groups such as methoxy group and ethoxy group, and nitro group) such as methylene bis-o-chloroaniline, 4-chloro-o-pheneylene diamine, 2-chloro-1,4-phenylene diamine, 3-amino-4-chloroaniline, 4-bromo-1,3-phenylene diamine, 2,5-dichloro-1,4-phenylene diamine, 5-nitro-1,3-phenylene diamine, 3-dimethoxy-4-aminoaniline, 4,4'-diamino-3,3'-dimethyl-5,5'-dibromo-diphenyl methane, 3,3'-dichloror bendidine, 3,3'-dimethoxy bendidine, bis(4-amino-3-chlorophenyl)oxide, bis(4-amino-2-chlorophenyl)propane, bis(4-amino-2-chlorophenyl)supfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylene bis(2-iode aniline), 4,4'-methylene bis(2-bromoaniline), 4,4'-methylene bis(2-fluoroaniline), and 4-aminphenyl-2-chloroanilide);

(4): Aromatic diamines having a secondary amino group (part or all of NH2 of aromatic diamine mentioned in (1) to (3) is substituted by —NH—R', where R' represents an alkyl group such as a lower alkyl group, for example, methyl group and ethyl group), e.g., 4,4'-di(methylamino)diphenyl methane, 1-methyl-2-methyl amino-4-amino benzene.

In addition to those, specific examples of the diamine components include, but are not limited to, polyamide polyamines (low-molecular weight polyamide polyamines obtained by condensation of a dicarboxylix acid (e.g., dimeric acid) and excessive (2 mols or more per mol of acid) polyamines (e.g., the alkylene diamines specified above and polyether polyamines (hydrogenetaed compounds of cyanoethylated polyether polyol (polyalkeylene glycol).

The weight average molecular weight of the crystalline polyester resin having a urethane bonding and/or a urea bonding is preferably from 5,000 to less than 50,000.

When the weight average molecular weight is too small, the toner fluidizes easily at lower temperatures, thereby degrading the high temperature stability.

In addition, the viscosity during melting tends to become low, so that high temperature offset properties becomes inferior in some cases.

The melting point of the crystalline polyester resin having a urethane bonding and/or a urea bonding is preferably from 50° C. to lower than 70° C.

When the melting point is too low, the non-modified crystalline polyester resin tends to melt at low temperatures, thereby degrading the high temperature stability of toner. When the melting point is too high, the crystalline polyester resin does not melt sufficiently by the heat during fixing, thereby degrading the low temperature &ability.

Toner particles can be prepared by mixing a crystalline polyester resin, in which a urethane bonding and/or a urea bonding are preliminarily formed, with other compositions.

The crystalline polyester resin having a urethane bonding and/or a urea bonding can be formed by elongating a modified crystalline polyester resin (hereinafter referred to as binder resin precursor) having an isocyanate group at its end (which is a reactive point of isocyanate, etc. of the non-modified crystalline polyester resin with, for example, a compound having an active hydrogen group in any one of the processes in the toner manufacturing processes.

Measuring Method of Ratio {C/(C+A)} of Toner

The ratio {C/(C+A)} indicates the content of the crystallized portion (mainly, the content of the crystallized portion in the binder resin constituting the main component of the toner) in the toner and is represented by the integral intensity C of the spectrum (peak) derived from the crystal structure of the toner in the diffraction spectrum and the integral intensity A of the spectrum (halo) derived from the non-crystalline structure of the toner as both measured by the X-ray diffraction measuring.

In the present disclosure, X-ray diffraction measuring is conducted by using an X-ray diffraction device. A specific example is a two-dimension detector installed X-ray diffraction device (D8 DISCOVER with GADDS, manufactured by BRUKER JAPAN CO., LTD.).

The capillary used for measuring has a mark tube (Lindemann glass) having a diameter of 0.70 mm.

A sample is stuffed to the upper portion of the capillary tube for measuring.

The sample is tapped 100 times during stuffing.

The detailed measuring conditions are as follows:

Current: 40 mA
Voltage: 40 kV
Goniometer 2θ axis: 20.0000°
Goniometer Ω axis: 0.0000°
Goniometer Φ axis: 0.0000°
Detector distance: 15 cm (wide angle measuring)
Measuring range: 3.2≤2θ(°)≤37.2
Measuring time: 600 sec.

A collimator having a 1 mm ϕ pinhole is used as the light incident optical system.

The obtained two-dimensional data are integrated (X axis: 3.2° to 37.2°) and converted by installed software to single-dimensional data of the diffraction intensity and 2θ. Based on the obtained X-ray diffraction measuring results, the method of calculating the ratio {C/(C+A)} is described below.

Figure 1B:
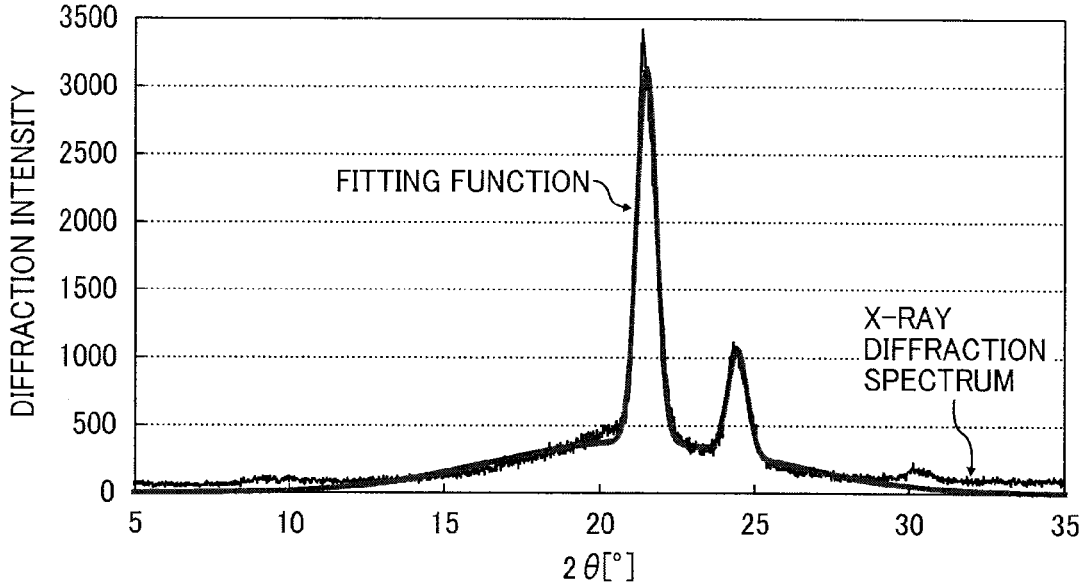

FIGS. 1A and 1B are graphs illustrating an example of the diffraction spectrum obtained by X-ray diffraction measuring for the toner.

X axis is 2θ and Y axis is the X-ray diffraction intensity. Both are linear axes. As illustrated in FIG. 1A, in the X-ray diffraction pattern of the crystalline resin of the present disclosure, the main peaks of P1 and P2 are observed at 2θ of 21.3° and 24.2°. Halo h is observed in a wide range including these two peaks.

The main peaks are ascribable to the crystalline portions and, the halo, the non-crystalline portion Gaussian function of these two main peaks and halo are as follows:

$$fp1(2\theta)=ap1\exp(-(2\theta-bp1)2/(2cp12)) \quad \{\text{Relation A(1)}\}$$

$$fp2(2\theta)=ap2\exp(-(2\theta-bp2)2/(2cp22)) \quad \{\text{Relation A(2)}\}$$

$$fh(2\theta)=ah\exp(-(2\theta-bh)2/(2ch2)) \quad \{\text{Relation A(3)}\}$$

fp1(2θ), fp2(2θ), and fh(2θ) are functions corresponding to the main peaks P1 and P2 and the halo, respectively. The sum of these three functions:

$$f(2\theta)=fp1(2\theta)+fp2(2\theta)+fh(2\theta) \quad \{\text{Relation A(4)}\}$$

is defined as the fitting function of the entire X-ray diffraction spectrum as illustrated in FIG. 1B and fitting is conducted by the least-square approach.

The fitting variables are nine variables of ap1, bp1, cp1, ap2, bp2, cp2, ah, bh, and ch. As the initial values for fitting of each variable, the peak positions of the X-ray diffraction are assigned as bp1, bp2, and bh (21.3=bp1, 24.2=bp2, 22.5=bh in the example illustrated in FIGS. 1A and 1B) and suitable values are assigned for the other variables to match the two main peaks and the halo with the X-ray diffraction spectrum as much as possible.

Fitting may be conducted by, for example, SOLVER of EXCEL 2003 manufactured by MICROSOFT CORPORATION.

The ratio {C/(C+A)}, indicating the amount ratio of the crystallized portion can be calculated by the integral areas (Sp1, Sp2, and Sh), where C represents Sp1+Sp2 and A represent Sh calculated by Gaussian integration of Gaussian functions (fp1(2θ), fp2(2θ)) corresponding to the two main peaks P1 and P2 and Gaussian function (fh(2θ)) corresponding to the halo after fitting.

Measuring Method and Measuring Condition of Maximum Endothermic Peak and Maximum Exothermic Peak of Toner The maximum endothermic peak and the maximum exothermic peak of the toner are measured by DSC SYSTEM Q-200 (manufactured by TA INSTRUMENTS. JAPAN).

To be specific, about 5.0 g of toner to be measured is placed in an aluminum sample container; the container is placed on a holder unit, which is set in an electric furnace; then, the temperature is raised from 0° C. to 100° C. in a nitrogen atmosphere at a temperature rising speed of 10° C./min.; the temperature is cooled down from 100° C. to 0° C. at a temperature falling speed of 10° C./min; the DSC curve at the first time temperature rising is chosen and the maximum endothermic peak temperature T1 of the toner is measured by the analysis program in the DSC SYSTEM Q-200 (manufactured by TA INSTRUMENTS. JAPAN).

In addition, the maximum exothermic peak temperature T2 of the toner is measured in the first time temperature descending in the same manner.

The maximum endothermic peak temperature T1 preferably satisfies the following relation 3:

$$50° \text{ C.} < T1 < 70° \text{ C.} \qquad \text{Relation 3.}$$

T1 is more preferably from 53° C. to 65° C. and furthermore preferably from 58° C. to 62° C.

When T1 is within the range of from 50° C. to 70° C., the high temperature stability is secured for the thus-obtained toner and it has a low temperature fixability better than ever.

When the maximum endothermic peak temperature T1 is too low, the low temperature fixability tends to be improved but the high temperature stability is sacrificed.

When the maximum peak temperature is too high, the high temperature preservation property tends to be improved but the low temperature fixability suffers.

T2 preferably satisfies the following relation 2:

$$T2 \geq 30° \text{ C.} \qquad \text{Relation 2}$$

T2 is more preferably from 30° C. to 55° C., further more preferably from 35° C. to 55° C., and particularly preferably from 40° C. to 55° C.

When T2 is too low, the fixed image tends to be cooled down and solidified slowly, so that a toner image sticks to another toner image or a recording medium after fixing or damage to a toner image during transfer of the printed material in the paper path.

It is preferable that T2 is as high as possible. However, since T2 is the crystallization temperature, it never surpasses T1, which is the melting point.

That is, to prevent a toner image from sticking to another toner image or a recording medium after fixing or damage to images passing through the transfer path in an image forming apparatus while maintaining excellent high temperature stability and low temperature fixability, it is preferable that the temperature difference (T1−T2) is within a narrow range to some extent.

To be specific, the difference (T1−T2) is preferably 30° C. or less and more preferably 25° C. or less.

When the difference (T1−T2) is too large, for example, 30° C. or greater, the temperature difference between the fixing temperature and the solidification temperature of the toner image tends to become wide, so that it is not possible to prevent a toner image from sticking to another toner image or a recording medium after fixing or damage to images passing through the transfer path in an image forming apparatus.

Nucleating Agent

Nucleating agents can accelerate the recrystallization of the crystalline resin. Such a nucleating agent raises the exothermic peak temperatures of the crystalline resin and the toner mentioned above.

In the present disclosure, the exothermic peak temperature means an exothermic peak temperature measured by differential scanning calorimetry (DSC), unless otherwise specified.

It is preferable to use a nucleating agent that has a melting point higher than that of the crystalline resin and is incompatible with the crystalline resin.

If this is true, the nucleating agent is crystallized in the toner at a higher temperature than the crystalline resin, thereby accelerating crystallization of the crystalline resin. For this reason, by using the nucleating agent, the crystallization degree of the crystalline resin in the manufacturing process of toner is improved, thereby ameliorating the high temperature stability of the toner.

Moreover, it also promotes post-fixing crystallization of an image, thereby ameliorating prevention of a toner image sticking to another toner image or a recording medium and furthermore uniformly reducing the size of the crystal nuclear, so that the surface of the toner image becomes smooth, resulting in improvement of gloss thereof.

When the melting point of the nucleating agent is lower than that of the crystalline resin, promoting crystallization of the crystalline resin is insufficient, so that the high temperature stability of toner and the sticking resistance of a toner image to another toner image or a printed material (recording medium) after fixing may deteriorate.

There is no specific limit to the nucleating agent if it accelerates re-crystallization of the crystalline resin. For example, inorganic crystal nucleating agents and organic crystal nucleating agents are suitable.

Specific examples of the inorganic crystal nucleating agent include, but are not limited to, silica, talc, kaolin, alumina, alum, and titanium oxide.

Specific examples of the organic crystal nucleating agent include, but are not limited to, dibenzylidene sorbitol and lower alkyl dibenzylidene sorbitol such as bis(p-methyl benzylidene) sorbitol and bis(p-ethyl benzylidene) sorbitol, aluminium benzoate compounds, phosphoric acid ester metal salts, straight chain aliphatic acid metal salt such as sodium montanic acid, rosin acid portion metal salts, aliphatic acid amides, and aliphatic acid esters.

Preferable specific examples of the nucleating agent include, but are not limited to, phosphoric acid metal salts, complexes of phosphoric acid metal salts and organic compounds, and nitrogen-containing compounds.

These compounds accelerates the crystallization speed of a crystalline resin, in particular that of a crystalline polyester resin, which significantly improves the mechanical robustness.

In addition, unlike a sorbitol-based crystal nucleating agent, these compounds are free from concerns such as easy decomposition at high temperatures, odor produced upon decomposition, or degradation of performance.

A specific example of the metal salts in the phosphoric acid ester metal salts is a sodium salt.

A specific example of the sodium salt is a compound represented by the following Chemical Structure 1.

Chemical Structure 1

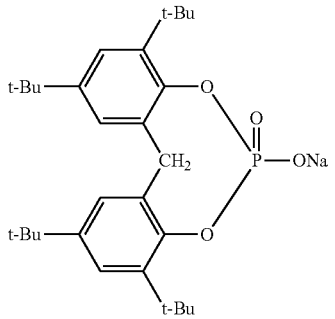

In the Chemical Structure 1, t-Bu represents a t-butyl group.

The nucleating agent is available from the market.

Specific examples of the marketed products thereof include, but are not limited to, ADK STAB NA-11, which is represented by the Chemical Structure 1 illustrated above, ADK STAB NA-27, and, ADK STAB NA-5 (all of which are manufactured by ADEKA Co., Ltd.).

There is no specific limit to the content of the nucleating agent. It is preferably from 0.10 parts by weight to 5.0 parts by weight and more preferably from 0.30 parts by weight to 2.0 parts by weight to 100 parts by weight of the binder resin.

When the content is too small, the crystallization is not sufficiently accelerated, so that power against a toner image sticking to another toner image or a printed material (recording medium) is not improved. When the content is too large, the nucleating agent in general has a higher melting point than a crystalline resin and toner so that it increases the viscoelasticity of toner, thereby failing to demonstrate a sufficient low temperature fixability.

The melt molded product of toner particles preferably has a Martens hardness of 20 N//mm$^2$ or greater at 50° C., more preferably 30 N//mm$^2$, and more preferably 40 N//mm$^2$ in terms of preventing damage to a toner image passing through the transfer path in an image forming apparatus.

When the Martens hardness is too low, the toner image is easily damaged in the transfer path after fixing.

The toner mainly consisted of a crystalline resin has a high potential when considering striking a balance between the low temperature fixability and the high temperature stability. However, the toner image is not crystallized yet after fixing when the toner image reaches a transfer member. For this reason, the surface of the toner image is more easily plastic-deformed by an external stress of the transfer member than when conventional toner containing a non-crystalline resin as the main component is used, so that the toner image is easily damaged in the transfer path.

However, if the Martens hardness of the melt molded toner particles at 50° C. is designed to be 20 N/mm or more, toner having a good balance between the low temperature fixability and the high temperature stability is obtained while subduing the occurrence of the damage in the transfer path even when the toner contains a crystalline resin as the main component.

As described above, considering the issue of damage to a toner image in the transfer path, which is peculiar to the toner containing a large amount of a crystalline resin and the tendency of inconsistency between the dynamic viscoelasticity of rheometer and the occurrence of the damage, the present inventors have found that there is a tendency of consistency between the melt molded toner particle and the occurrence of the damage.

The Martens hardness is measured by compressing an indenter into a melt molded toner under a predetermined maximum load at a predetermined loading rate and indicates the plastic-deformity of the melt molded toner as the mechanical property thereof when a toner image contacts a transfer member and receives an external stress therefrom. Therefore, the Martens hardness is considered to have a strong correlation with the damage in the transfer path.

At the same time, this suggests that the Martens hardness is an extremely important parameter when designing toner containing a crystalline resin as substantially the main component.

Moreover, the measuring condition of the Martens hardness in the present disclosure corresponds to a large deformation field so that the elastic plastic deformation behavior of melted toner can be measured in the large deformation field outside conventional rheometer measuring and the phenomenon occurring between the transfer member and the output image is truly repeated.

Furthermore, at the same time, the Martens hardness of melt molded toner at 50° C. being 80 N/mm$^2$ or less is preferable in term of the gloss and smear of an output image.

When the Martens hardness is 80 N/mm$^2$ or less, the gloss and the abrasion resistance of an output image become satisfactory.

In the present disclosure, the Martens hardness of a melt molded sample prepared by heating pressurization molded toner particles is measured by a micro-hardness tester.

The measuring method of the Martens hardness is deferred.

In the molecular weight distribution measured by gel permeation chromatography (GPC), when the tetrahydrofuran soluble of the toner contains a component having a molecular weight of 100,000 or more in an amount of 5.0% or more of the peak area and the ratio of the decomposed residue insoluble in methanol when decomposing the tetrahydrofuran soluble in 0.1N KOH methanol solution is 5.0% by weight, toner having both excellent high temperature stability and low temperature fixability can be provided while sustaining the strength of toner against the mechanical stress.

Other Components

There is no specific limit to the other components. Specific examples thereof include, but are not limited to, a releasing agent (wax), a colorant (coloring agent), a charge control agent, an external additive, a fluidity improver, a cleaning property improver, and a magnetic material.

Releasing Agent

There is no specific limit to the releasing agent and any known releasing agent can be suitably selected.

Specific examples of waxes of the releasing agent include, but are not limited to, vegetable waxes such as carnauba wax, cotton wax, Japan wax, and rice wax; animal waxes such as bee wax and lanolin; mineral waxes such as ozokelite and Cercine; and petroleum waxes such as paraffin wax, microcrystalline wax, and petrolatum wax.

In addition to these natural waxes, synthesis hydrocarbon waxes such as Fischer-Tropsch wax, polyethylene wax, and polypropylene wax and synthesis wax such as ester, ketone, and ether are also usable.

Furthermore, aliphatic acid amide compounds such as 12-hydroxystearic acid amide, stearic acid amide, phthalic acid anhydride imide, and chlorinated hydrocarbons; crystalline polymer resins having a low molecular weight such as homo polymers, for example, poly-n-stearylic methacrylate and poly-n-lauryl methacrylate, and copolymers (for example, copolymers of n-stearyl acrylate-ethylmethacrylate); and crystalline polymers having a long alkyl group in the branched chain are also usable.

In particular, hydrocarbon-based waxes such as paraffin wax, microcrystalline wax, Fischer-Tropsch wax, polyethylene wax, and polypropylene wax are preferable.

There is no specific limit to the melting point of the releasing agent. The melting point is preferably from 60° C. to 80° C.

When the melting point is too low, the releasing agent tends to melt at low temperatures, thereby degrading the high temperature stability.

When the melting point is too high, the releasing agent does not easily melt, which causes fixing offset even if the binder resin melts and is in the fixing temperature range. As a consequence, defective images are produced in some cases.

There is no specific limit to the content of the releasing agent. It is preferably from 2 parts by weight to 10 parts by weight and more preferably from 3 parts by weight to 8 parts by weight to 100 parts of the toner.

When the content is too small, the high temperature offset and the low temperature fixability during fixing tend to be inferior. When the content is too large, the high temperature stability tends to deteriorate and fogging of an image easily occurs.

A content that is within the preferable range is advantageous to improve the quality of image and the fixing stability.

Colorant

There is no specific limit to the colorant.

Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like.

In addition, there is no specific limit to the content of the colorant.

It is preferably from 1 part by weight to 15 parts by weight and more preferably from 3 parts by weight to 10 parts by weight to 100 parts of the toner.

The colorant and the resin can be used in combination as a master batch.

In addition to the resin crystalline polyester resins mentioned above, specific examples of the resins for use in manufacturing the master batch or kneading with the master batch include, but are not limited to, non-crystalline polyester resins; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc.

These resins can be used alone or in combination.

The master batch is prepared by mixing and kneading a resin for the master batch and a colorant upon application of high shear stress thereto.

In this case, an organic solvent can be used to boost the interaction of the colorant with the resin.

In addition, flushing methods in which an aqueous paste including a coloring agent is mixed with a resin solution of an organic solvent to transfer the coloring agent to the resin solution and then the aqueous liquid and organic solvent are separated to be removed can be preferably used because the resultant wet cake of the coloring agent can be used as it is.

In this case, a high shear dispersion device such as a three-roll mill, etc. can be preferably used for kneading the mixture.

Organic Particulate

The master batch is prepared by mixing and kneading a resin for the master batch and a colorant upon application of high shear stress thereto.

In mixing and kneading, an organic solvent can be used to boost the interaction of the colorant with the resin.

In addition, flushing methods in which an aqueous paste including a coloring agent is mixed with a resin solution of an organic solvent to transfer the coloring agent to the resin solution and then the aqueous liquid and organic solvent are separated to be removed can be preferably used because the resultant wet cake of the coloring agent can be used as it is.

A high shear dispersion device such as a three-roll mill, etc. is preferably used for kneading the mixture.

Charge Control Agent

There is no specific limit to the selection of the charge control agent. Specific examples of the charge control agent include, but are not limited to, nigrosine dyes, triphenylmethane dyes, chrome containing metal complexes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid and metal salts of salicylic acid derivatives.

Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

There is no specific limit to the content of the charge control agent. It is preferably from 0.1 parts by weight to 10 parts by weight and more preferably from 0.2 parts by weight to 5 parts by weight to 100 parts of the toner.

When the content is too large, the electrostatic attraction force between a developing roller and the toner increases, resulting in deterioration of the fluidity of the toner and a decrease in the image density.

These charge control agents can be melt-kneaded with a master batch and a resin and thereafter dispersed and dissolved in an organic solvent or can be added directly in an organic solvent. Alternatively, they can be fixed on the surface of manufactured toner particles.

External Additive

In addition to the oxide particulates, inorganic particulates and hydrophobized inorganic particulates can be used in combination as the external additives. The hydrophobized particulates preferably have an average primary particle diameter of from 1 nm to 100 nm. Inorganic particulates having an average primary particle diameter of from 5 nm to 70 nm are more preferable.

Furthermore, toner preferably contains at least one kind of inorganic particulates having a hydrophobized average primary particle diameter of 20 nm or less and at least one kind of inorganic particulates having a hydrophobized average primary particle diameter of 30 nm or greater.

In addition, it is preferable that the specific surface area of such inorganic particulates as measured by the BET method is from 20 $m^2/g$ to 500 $m^2/g$.

There is no specific limit to the external additive and any known external additives is suitably usable.

Specific examples thereof include, but are not limited to, silica particulates, hydrophobized silica particulates, aliphatic acid metal salts (such as zinc stearate and aluminum stearate); metal oxides (such as titania, alumina, tin oxide, antimony oxide), and fluoropolymers.

Preferable specific examples of the additive include, but are not limited to, silica, titania, titanium oxide, and alumina particulates.

Specific examples of the silica particulates include, but are not limited to, R972, R974, RX200, RY200, R202, R805, and R812 (manufactured by NIPPON AEROSIL CO., LTD.).

In addition, specific examples of the titania particulates include, but are not limited to, P-25 (manufactured by NIPPON AEROSIL CO., LTD.), STT-30 and STT-65C-S (manufactured by TITAN KOGYO, LTD.), TAF-140 (manufactured by FUJI TITANIUM INDUSTRY CO., LTD.), and MT-150W, MT-500B, MT-600B, and MT-150A (manufactured by TAYCA CORPORATION).

Specific examples of the hydrophobized titan oxide particulates include, but are not limited to, T-805 (manufactured by NIPPON AEROSIL CO., LTD.); STT-30A and STT-65S-S (manufactured by TITAN KOGYO, LTD.); TAF-500T and TAF-1500T (manufactured by FUJI TITANIUM INDUSTRY CO., LTD.); MT-100S and MT-100T (manufactured by TAYCA CORPORATION); and IT-S (manufactured by ISHIHARA SANGYO KAISHA LTD.).

The hydrophobized oxide particulates, the hydrophobized silica particulates, the hydrophobized titania particulates, and the hydrophobized alumina particulates can be obtained by treating hydrophillic particulates with a silane coupling agent such as methyl trimethoxyxilane, methyltriethoxy silane, and octyl trimethoxysilane.

Silicon oil treated oxide particulates and inorganic particulates, which are optionally treated with heated silicone oil, are also preferable.

Specific examples of the silicone oils include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, (meth)acryl-modified silicone oil, and α-methylstyrene-modified silicone oil.

Specific examples of such inorganic particulates include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Among these, silica and titanium dioxide are particularly preferred.

There is no specific limit to the content of the external additive in the toner. It is preferably from 0.1% by weight to 5% by weight and more preferably from 0.3% by weight to 3% by weight.

There is no specific limit to the average primary particle diameter of the inorganic particulates. For example, it is preferably 100 nm or less and more preferably from 3 nm to 70 nm.

When the average primary particle diameter is too small, the inorganic particulates are buried in the toner, which prevents demonstration of their power.

When the average primary particle diameter is too large, the surface of a photoreceptor is easily damaged non-uniformly.

Fluidity Improver

The fluidity improver is prepared by surface treatment to have a higher hydrophobic property and prevent deterioration of the fluidity and the chargeability even in a humid environment.

Specific examples of the fluidity improver include, but are not limited to, silane coupling agents, silylatng agents, silane coupling agents including an alkyl fluoride group, organic titanate coupling agents, aluminum containing coupling agents, silicone oil, and modified silicone oil.

Hydrophobic silica and hydrophobic titanium oxide, which are prepared by surface-treating the above-mentioned silica and titanium oxide with such a fluidity improver are particularly preferable.

Cleaning Property Improver

The cleaning property improver is added to the toner to remove the development agent remaining on the image bearing member (photoreceptor) or a primary intermediate transfer element after transfer of an image.

Specific examples thereof include, but are not limited to, zinc stearate, calcium stearate, and aliphatic metal salts of stearic acid, polymer particulates such as polymethyl methacrylate particulates and polystyrene particulates, which are prepared by a soap-free emulsion polymerization method.

The polymer particulates preferably have a relatively narrow particle size distribution and the volume average particle diameter thereof is preferably from 0.01 μm to 1 μm.

Magnetic Material

There is no specific limit to the magnetic materials and any known magnetic material can be suitably used.

Specific examples thereof include, but are not limited to iron powder, magnetite, and ferrite.

Among these, white materials are preferable in terms of coloring.

Toner Property

The method of manufacturing toner for use in the present disclosure is described below.

The following is preferable but the method of manufacturing toner is not limited thereto.

It is preferable to emulsify and/or disperse a solution of liquid dispersion of toner material in an aqueous medium to prepare an emulsion or liquid dispersion before granulation, which preferably include the following processes of (1) to (6).

(1) Preparation of Solution or Liquid Dispersion of Toner Material

A solution and/or a liquid dispersion of the toner material is prepared by dissolving and/or dispersing the toner material in an organic solvent.

There is no specific limit to the toner material and any material capable of forming toner can be suitably selected.

For example, the toner material contains at least the binder resin and optionally a releasing agent, a colorant, and a charge control agent.

The solution and/or the liquid dispersion of the toner material is prepared by dissolving and/or dispersing the toner material in an organic solvent.

The organic solvent is removed when or after toner granulation.

There is no specific limit to the selection of the organic solvent and any solvent that can dissolve or disperse the toner material is suitably selected. For example, a volatile solvent having a boiling point of 150° C. or lower is preferable to remove it easily. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. Among these, ester solvents are preferably and in particular ethyl acetate is preferable.

These can be used alone or in combination.

In addition, there is no specific limit to the content of the organic solvent. The content is preferably from 40 parts by weight to 300 parts by weight, more preferably from 60 parts by weight to 140 parts by weight, and furthermore preferably from 80 parts by weight to 120 parts by weight to 100 parts of the toner material.

(2) Preparation of Aqueous Medium

There is no specific limit to the aqueous medium. Specific examples thereof includes, but are not limited to, known aqueous media such as water, a solvent mixable with water, and a mixture thereof. Water is particularly preferable.

Specific examples of such water-mixable solvents include, but are not limited to, alcohols, dimethylformamide, tetrahydrofuran, cellosolves, and lower ketones.

Specific examples of the alcohols include, but are not limited to, methanol, isopropanol, and ethylene glycol.

Specific examples of the lower ketones include, but are not limited to, acetone and methyl ethyl ketone.

These can be used alone or in combination.

The aqueous medium is prepared by, for example, dispersing resin particles in an aqueous medium.

There is no specific limit to the addition amount of the resin particulate to the aqueous medium. For example, it is preferably from 0.5% by weight to 10% by weight.

Any resin that can form an aqueous liquid dispersion in an aqueous medium can be used as the resin particulates. Specific examples of these resins include, but are not limited to, thermoplastic resins or thermosetting (thermocuring) resins such as vinyl resins, polyurethane resins, epoxy resins, polyester resins, polyamide resins, polyimide resins, silicone resins, phenolic resins, melamine resins, urea resins, aniline resins, ionomer resins, and polycarbonate resins.

These can be used alone or in combination.

Among these resins, vinyl resins, polyurethane resins, epoxy resins, polyester resins, and mixtures thereof are preferably used because an aqueous liquid dispersion containing fine spherical resin particles can be easily prepared.

Specific examples of the vinyl resins include, but are not limited to, polymers, which are prepared by polymerizing a vinyl monomer or copolymerizing vinyl monomers, such as styrene-(meth)acrylate resins, styrene-butadiene copolymers, (meth)acrylic acid-acrylate copolymers, styrene-acrylonitrile copolymers, styrene-maleic anhydride copolymers, and styrene-(meth)acrylic acid copolymers.

In addition, copolymers having monomers having at least two unsaturated groups can be used as the resin particulate.

There is no specific limit to the monomers having at least two unsaturated groups.

Specific examples thereof include, but are not limited to, sodium salt of an adduct of sulfuric acid ester of an adduct of methacrylic acid with ethylene oxide (EREMINOL RS-30) and divinyl benzene, and 1,6-hexane diol acrylate.

Resin particulates can be obtained through polymerization using any known method. It is preferable to obtain through an aqueous liquid dispersion of resin particulates.

For example, as the method of preparing an aqueous liquid dispersion of the resin particulates, the following methods can be used.

(1) In the case of a vinyl resin, a method of manufacturing an aqueous liquid dispersion of resin particulates directly from the polymerization reaction by a suspension polymerization method, an emulsification polymerization method, a seed polymerization method, or a dispersion polymerization method using a vinyl monomer as the initial material of the resin particulates.

(2) A method of manufacturing an aqueous liquid dispersion of resin particulates by: dispersing a precursor (monomer, oligomer, etc.) of a polyaddition- or polycondensation-based resin such as a polyester resin, a polyurethane resin, and an epoxy resin or its solvent solution under the presence of a suitable dispersion agent; curing the liquid dispersion by heating or addition of a curing agent.

(3) In the case of a polyaddition or polycondensation resin such as a polyester resin, a polyurethane resin and an epoxy resin, a method of manufacturing an aqueous liquid dispersion of resin particulates by dissolving a suitable emulsification agent in a precursor (monomer, oligomer, etc.) or its solvent solution (liquid is preferred, e.g., liquidized by heating) followed by adding water for phase change.

(4) A method of pulverizing a resin preliminarily manufactured by a polymerization reaction (addition polymerization, ring scission polymerization, polyaddition, addition condensation, polycondensation, etc.) with a fine grinding mill of a mechanical rotation type or jet type, classifying the resultant to obtain resin particulates, and dispersing the resin particulates in water under the presence of a suitable dispersion agent.

(5) A method of spraying a resin solution in which a preliminarily manufactured resin by a polymerization reaction (addition polymerization, ring scission polymerization, polyaddition, addition condensation, polycondensation, etc.) is dissolved in a solvent in a form of a fine liquid mist to obtain resin particulates followed by dispersion thereof in water under the presence of a suitable dispersion agent.

(6) A method of adding a solvent to a resin solution in which a preliminarily manufactured resin by a polymerization reaction (addition polymerization, ring scission polymerization, polyaddition, addition condensation, polycondensation, etc.) is dissolved in a solvent or cooling down a resin solution preliminarily prepared by dissolving the resin in a solvent by heating to precipitate resin particulates; removing the solvent to obtain the resin particulates; and dispersing them in water under the presence of a dispersion agent.

(7) A method of dispersing a resin solution in which a preliminarily manufactured resin by a polymerization reaction (addition polymerization, ring scission polymerization, polyaddition, addition condensation, polycondensation, etc.) is dissolved in a solvent in an aqueous medium under the presence of a suitable dispersion agent; and removing the solvent by heating, reduced pressure, etc.

(8) A method of manufacturing an aqueous liquid dispersion of resin particulates by: dissolving a suitable emulsification agent in a resin solution in which resins preliminarily manufactured by a polymer reaction (addition polymerization, ring scission polymerization, polyaddition, addition condensation, polycondensation, etc.) are dissolved in a solvent; and adding water for phase change emulsification.

In the aqueous medium, it is preferable to optionally use a dispersant (dispersing agent) in the aqueous medium in terms of stabilizing oil droplets of the solution or liquid dispersion to obtain a sharp particle size distribution while making desired forms during emulsification or dispersion.

There is no specific limit to the dispersion agent and any known dispersion agent can be suitably used. Specific examples thereof include, but are not limited to, surface active agents, poorly-water-soluble inorganic compound dispersant, and polymeric protective colloids.

These can be used alone or in combination.

Among these, surface active agents are preferred.

For example, anionic surface active agents, cationic surface active agents, nonionic surface active agents, and ampholytic surface active agents can be preferably used.

Specific examples of the anionic surface active agents include, but are not limited to, alkylbenzene sulfonic acid salts, α-olefin sulfonic acid salts, and phosphoric acid salts. Among these, an anionic surface active agent having a fluoroalkyl group is preferably used.

Specific examples of the anionic surface active agents having a fluoroalkyl group include, but are not limited to, fluoroalkyl carboxylic acids having 2 to 10 carbon atoms and their metal salts, disodium perfluorooctane sulfonylglutamate, sodium 3-{omega-fluoroalkyl(having 6 to 11 carbon atoms) oxy}-1-alkyl(having 3 to 4 carbon atoms) sulfonate, sodium 3-{omega-fluoroalkanoyl(having 6 to 8 carbon atoms)-N-ethylamino}-1-propanesulfonate, fluoroalkyl(having 11 to 20 carbon atoms) carboxylic acids and their metal salts, perfluoroalkylcarboxylic acids and their metal salts, perfluoroalkyl(having 4 to 12 carbon atoms)sulfonate and their metal salts, perfluorooctanesulfonic acid diethanol amides, N-propyl-N-(2-hydroxyethyl)perfluorooctanesulfone amide, perfluoroalkyl(having 6 to 10 carbon atoms)sulfoneamidepropyltrimethylammonium salts, salts of perfluoroalkyl(having 6 to 10 carbon atoms)-N-ethylsulfonyl glycin, and monoperfluoroalkyl(having 6 to 16 carbon atoms)ethylphosphates.

Specific examples of the marketed products of such surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; and FUTARGENT F-100 and F150 manufactured by Neos Company limited.

Specific examples of the cationic surface active agents include, but are not limited to, amine salt type surface active agents, quaternary ammonium salt type cationic surface active agents, and cationic surface active agents having a fluoroalkyl group.

Specific examples of the amine salt type surface active agents include, but are not limited to, alkyl amine salts, amino alcohol aliphatic acid derivatives, polyamine fatty acid derivatives, and imidazoline.

Specific examples of the quaternary ammonium salt type cationic surface active agents include, but are not limited to, alkyl trimethyl ammonium salts, dialkyl dimethyl ammonium salts, alkyl dimethyl benzyl ammonium salts, pyridinium salts, alkyl isoquinolinium salts, and benzetonium chloride.

Specific examples of the cationic surface active agents having a fluoroalkyl group include, but are not limited to, primary and secondary aliphatic amino acids, secondary amino acids, aliphatic quaternary ammonium salts (for example, perfluoroalkyl(having 6 to 10 carbon atoms) sulfoneamide propyltrimethyl ammonium salts), benzalkonium salts, benzetonium chloride, pyridinium salts, and imidazolinium salts.

Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited).

Specific examples of the nonionic surface active agents include, but are not limited to, fatty acid amide derivatives, and polyalohol derivatives.

Specific examples of amopholytic surface active agents include, but are not limited to, alanine, dodecyldi(amino ethyl)glycine, di(octyl amonoethyl)glycine, and N-alkyl-N,N-dimethyl ammonium betaine.

Specific examples of the poorly-water-soluble inorganic compound dispersant include, but are not limited to, tricalcium phosphate, calcium phosphate, titanium oxide, colloidal silica, and hydroxyapatite.

Specific examples of the polymeric protective colloids include, but are not limited to, acids, (meth)acrylic monomer having a hydroxyl group, vinyl alcohol or ethers thereof, esters of vinyl alcohol and a compound having a carboxylic group, amide compounds or methylol compounds thereof, chlorides, homopolymers or copolymers having a nitrogen atom or a heterocyclic ring thereof, polyoxyethylene based compounds and celluloses.

Specific examples of the acids include, but are not limited to, acrylic acid, methacrylic acid, α-cyanoacrylic acid, α-cyanomethacrylic acid, itaconic acid, crotonic acid, fumaric acid, maleic acid and maleic anhydride.

Specific examples of (meth)acrylic monomers having a hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylate, diethyleneglycolmonomethacrylate, glycerinmonoacrylate, glycerinmonomethacrylate, N-methylol acryl amide, and N-methylol methacryl amide.

Specific examples of vinyl alcohols mentioned above or its ethers include vinyl methyl ether, vinyl ethyl ether and vinyl propyl ether.

Specific examples of the esters mentioned above of vinyl alcohol and a compound having a carboxylic group include, but are not limited to, vinyl acetate, vinyl propionate and vinyl butyrate.

Specific examples of the amide compounds mentioned above or their methylol compounds include, but are not limited to, acrylamide, methacrylamide and diacetone acrylamide acid and their methylol compounds.

Specific examples of the chlorides mentioned above include, but are not limited to, acrylic acid chloride and methacrylic acid chloride.

Specific examples of homopolymers or copolymers mentioned above having a nitrogen atom or a heterocyclic ring thereof include, but are not limited to, vinyl pyridine, vinyl pyrrolidone, vinyl imidazole, and ethylene imine.

Specific examples of the polyoxyethylene mentioned above include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the celluloses mentioned above include, but are not limited to, methyl cellulose, hydroxyethyl cellulose and hydroxypropyl cellulose.

Dispersion stabilizers can be optionally used in preparation of the liquid dispersion mentioned above.

Specific examples of the dispersion stabilizers include, but are not limited to, compounds such as calcium phosphate which are soluble in an alkali or an acid.

In addition, in a case in which a modified polyester (prepolymer) reactive with a compound containing an active hydrogen group is contained as the binder resin for the solution or the liquid dispersion mentioned above, it is possible to use a catalyst for the reaction such as dibutyltin laurate and dioctyl tin laurate in the aqueous medium mentioned above.

(3) Emulsion and Liquid Dispersion

With regard to emulsification or dispersion of a solution or a liquid dispersion of the toner material mentioned above in the aqueous medium mentioned above, it is preferable to disperse the solution or the liquid dispersion of the toner material in the aqueous medium while stirring.

There is no specific limit to a dispersing machine for use in the dispersion. Specific examples thereof include, but are not limited to, continuous type emulsifiers such as HOMOGENIZER (manufactured by IKA Japan), Polytron (manufactured by Kinematic AG), TK AUTOHOMOMIXER (manufactured by PRIMIX Corporation), Ebara Milder (manufactured by EBARA CORPORATION), T.K.FILMICS, T.K. Pipeline Homo Mixer (both manufactured by PRIMIX Corporation), colloid mill (manufactured by Kobelco Eco-Solutions Co., Ltd.), Slusher, trigonal wet type fine dispersing machine (manufactured by NIPPON COKE & ENGINEERING CO., LTD.), Cavitron (manufactured by EUROTEC. CO, LTD.), Fine flow mill (manufactured by Pacific Machinery & Engineering Co., Ltd.), high pressure emulsifiers such as Microfluidizer (manufactured by MIZUHO Industrial CO., LTD.) and nanomizer (manufactured by NANOMIZER Inc.), and APV. GAULIN (APV Gaulin Inc.), membrane emulsifiers such as membrane emulsifying machine (manufactured by Reica Co., Ltd.), vibration type emulsifying machines such as Vibro Mixer (manufactured by Reica Co., Ltd.), and ultrasonic emulsifiers such as ultrasonic homogenizers (manufactured by emulsifying machines such as Branson Ultrasonics, Emerson Japan Ltd.).

Among these, in terms of unifying the particle diameter, it is preferable to use APV. GAULIN, HOMOGENIZER, TK auto homomixer, Ebara milder, T.K.FILMICS, and T.K. Pipeline Homo Mixer.

(4) Removal of Solvent

The organic solvent is removed from the emulsified slurry obtained by the emulsification and dispersion.

The organic solvent is removed by: (1) a method in which the organic solvent in the oil droplet is completely evaporated and removed by gradually raising the entire system: and (2) a method in which the emulsified dispersion element is sprayed in a dry atmosphere to completely remove the water-insoluble organic solvent in the oil droplet to form toner particles while evaporating and removing aqueous aqueous dispersing agent.

(5) Washing, Drying, Classifying

When the organic solvent is removed, toner particles are formed.

The mother toner particles can be washed and dried and optionally classified.

Fine particles are removed by a cyclone, a decanter, a centrifugal, etc., in liquid in the classification. Alternatively, the classification can be operated for powder obtained after drying.

When compounds, for example, calcium phosphate, which are soluble in both an acid and an alkali, are used in the aqueous medium as a dispersion stabilizer, it is possible to dissolve the calcium phosphate by adding an acid, for example, hydrochloric acid, followed by washing of the resultant particles with water, to remove the calcium phosphate from the particulates.

(6) External Addition of Charge Control Agent and Releasing Agent

It is possible to prevent particles such as releasing agents from detaching from the surface of the thus-obtained toner particle by mixing the toner particle together with the releasing agent, which is inorganic particles such as silica particulates and titanium oxide particulates and particles such as charge control agents or applying a mechanical impact thereto.

Specific examples of such mechanical impact application methods include, but are not limited to, methods in which an impact is applied to a mixture by using a blade rotating at a high speed, a method in which a mixture is put into a jet air to collide particles against each other or complex particles into a collision plate.

Specific examples of such mechanical impact applicators include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

There is no specific limit to the size and form of the toner. It is preferable that the toner has the volume average particle diameter (Dv), the ratio of the volume average particle diameter (Dv) to the number average particle diameter (Dn), the penetration degree, the offset non-occurring temperature, etc.

The volume average particle diameter (Dv) of the toner is preferably from 3 μm to 8 μm.

When the volume average particle diameter (Dv) is too small, toner tends to adhere to the surface of the carrier while stirring in the development device over an extended period of time, thereby degrading the charging power of the carrier in the case of a two component development agent and the toner tends to form filming on the development roller or adhere to members such as the blade by regulating the layer thickness of the toner in the case of a single component development agent. When the volume average particle diameter (Dv) is too large, it tends to be difficult to obtain quality images with high definition and the particle diameter of the toner tends to vary significantly by replenishing the toner in the development agent.

The ratio of Dv/Dn in the toner is preferably from 1.00 to 1.25.

When the ratio of Dv/Dn is too small, toner tends to adhere to the surface of the carrier while stirring in the development device over an extended period of time, thereby degrading the charging power of the carrier and the cleanability in a case of a two component development agent and the toner tends to form filming on the development roller or adhere to members such as the blade by regulating the layer thickness of the toner in the case of a single component development agent. When the ratio of Dv/Dn is too large, it tends to be difficult to obtain quality images with high definition and the particle diameter of the toner tends to vary significantly by replenishing the toner in the development agent.

When the ratio of Dv/Dn is within the range of from 1.00 to 1.25, the toner has excellent preservation stability, low temperature fixability, and hot offset resistance and in particular, excellent gloss when used in a full color photocopier.

In addition, when a two-component development agent is used and replenished a number of times, the variability of the particle diameter of the toner is small and good developability is stably obtained even when stirred in a development device for a long period of time.

When a single-component development agent is used and replenished a number of times, the variability of the particle diameter of the toner is small and filming of the toner on a developing roller and fusion bonding of the toner onto members such as a blade for regulating the thickness of the toner layer, hardly occurs. Therefore, good developability is sustained even when the development agent is stirred for an extended period of time so that quality images can be produced.

The volume average particle diameter and the ratio (Dv/Dn) of the volume average particle diameter to the number average particle diameter can be measured by using the particle size measuring device, MULTISIZER II (manufactured by Beckman Coulter, Inc.) as follows:

As for the penetration degree, for example, the penetration degree is preferably 6 mm or greater and more preferably 15 mm or greater as measured by the penetration degree test (according to JIS K2235-1991).

When the penetration degree is too small, the high temperature stability tends to deteriorate.

The penetration degree is measured according to JIS K2235-1991, in which, to be specific, a glass container is filled with toner and left in a constant temperature tank at 50° C. for 20 hours.

This toner is cooled down to room temperature followed by the penetration degree test to measure the penetration degree.

The higher the penetration degree is, the better the high temperature stability is.

In terms of striking a balance between the drop of the fixing temperature and non-occurrence of offset, the lower limit of the fixing temperature is preferably low and the offset non-occurring temperature is preferably high. The temperature range of keeping a good balance between both is that the lower limit of the fixing temperature is 130° C. or lower and the offset non-occurring temperature is 180° C. or higher.

The lower limit of the fixing temperature is determined as, for example, the fixing roller temperature at which the remaining ratio of the image density of a fixed image rubbed by a pad is 70% when a photocopying test is conducted for a transfer sheet using an image forming apparatus.

The offset non-occurring temperature is obtained by, for example, measuring a temperature at which no offset occurs while adjusting the temperature of a fixing belt in an image forming apparatus adjusted to develop monochrome solid images of yellow, magenta, cyan, and black and intermediate color solid images of red, blue, and green on transfer sheets set in the image forming apparatus.

There is no specific limit to the color of the coloring of the toner of the present disclosure. One or more can be selected from black toner, cyan toner, magenta toner, and yellow toner and various kinds of colors can be obtained by suitably selecting the coloring agents.

Development Agent

The development agent of the present disclosure contains the toner of the present disclosure and other suitably selected components such as toner carriers (hereinafter simply referred to as carrier).

A single-component development agent and a two-component development agent are suitably usable.

In terms of the length of the working life particularly when used in a high speed performance printer that meets the demand for high speed data processing of late, the two-component development agent is preferable.

When a single-component development agent using the toner of the present disclosure is used and replenished a number of times, the variability in the particle diameter of the toner is small, no filming of the toner on the developing roller occurs, and no fusion bonding of the toner onto members such as a blade for regulating the thickness of the toner layer occurs. Therefore, good developability is stably sustained to produce quality images even when the development agent is stirred for an extended period of time.

In a case of a two-component development agent using the toner of the present disclosure is used, even when the toner is replenished for an extended period of time, the variability of the particle diameter of the toner in the development agent is small. In addition, good developability is suitably sustained even when the development agent is stirred in the development device for an extended period of time.

There is no specific limit to the carrier. A carrier is preferable which contains a core material and a resin layer that covers the core material.

There is no specific limit to the material for the core material and any known material can be suitably used. For example, manganese-strontium (Mn—Sr) based materials and manganese-magnesium (Mn—Mg) based materials having 50 emu/g to 90 emu/g are preferable. To secure the image density, highly magnetized materials such as iron powder having 100 emu/g or more and magnetite having 75 emu/g to 125 emu/g are preferable.

In addition, in terms of reducing the impact of the contact between the toner filaments formed on the development roller and the image bearing member, weakly magnetized copper-zinc (Cu—Zn) based materials having 30 emu/g to 80 emu/g are preferable, which is advantageous in improvement of the image quality.

These can be used alone or in combination.

The core material preferably has a volume average particle diameter of from 10 μm to 150 μm and more preferably from 20 μm to 80 μm.

When the volume average particle diameter D50 is too small, fine powder tends to increase in the distribution of the carrier particles and the magnetization per particle tends to decrease, which leads to scattering of the carrier particles. When the volume average particle diameter D50 is too large, the specific surface area tends to decrease, resulting in scattering of toner. In a full color image in which solid portions occupy a large ratio, reproducibility tends to deteriorate particularly in the solid portions.

There is no specific limit to the selection of the materials for the resin layer mentioned above and any known resin can be suitably used. Specific examples thereof include, but are not limited to, amino-based resins, polyvinyl-based resins, polystyrene-based resins, polycarbonate-based resins, polyethylene resins, polyvinyl fluoride resins, polyvinylidene fluoride resins, polytrifluoroethylene resins, polyhexafluoropropylene resins, copolymers of vinylidenefluoride and acrylate monomer, copolymers of vinylidenefluoride and vinylfluoride, fluoroterpolymers such as terpolymers of tetrafluoroethylene, fluorovinylidene, and monomer including no fluorine atom, and silicone resins.

These can be used alone or in combination.

Specific examples of the amino-based resins include, but are not limited to, urea-formaldehyde resins, melamine resins, benzoguanamine resins, urea resins, polyamide resins, epxy resins.

Specific examples of the polyvinyl-base resins include, but are not limited to, acrylic resins, polymethylmethacrylate resins, polyacrylonitrile resins, polyvinyl acetate resins, polyvinyl alcohol resins, and polyvinyl butyral resins.

Specific examples of the polystyrene resins include, but are not limited to, polystyrene resins and styrene-acrylic copolymers.

A specific example of the halogenated olefin resins includes, but are not limited to, polyvinly chloride.

Specific examples of the polyester resins include, but are not limited to, polyethylene terephthalate resins and polybutylene terephthalate resins.

The resin layer may contain electroconductive powder such as metal powder, carbon black, titanium oxide, tin oxide, and zinc oxide.

The average particle diameter of such electroconductive powder is preferably not greater than 1 μm.

When the average particle diameter is too large, controlling the electric resistance may become difficult.

The resin layer described above can be formed by, for example, dissolving the silicone resin described above, etc. in a solvent to prepare a liquid application and applying the liquid application to the surface of the core material described above by a known application method followed by drying and baking.

Specific examples of the known application methods include, but are not limited to, a dip coating method, a spray coating method, and a brushing method.

There is no specific limit to the solvent. Specific examples thereof include, but are not limited to, toluene, xylene, methylethylketone, methylisobutyll ketone, and cellosolve, and butylacetate.

There is no specific limit to the baking. An external heating system or an internal heating system can be used. For example, a fixed electric furnace, a fluid electric furnace, a rotary electric furnace, a method of using a burner furnace, and a method of using a microwave can be suitably used.

The content of the carrier in the resin layer is preferably from 0.01% by weight to 5.0% by weight.

A content that is too small tends to make it difficult to form a uniform layer on the surface of the core material. A content that is too large tends to result in an excessively thick layer, thereby causing granulation between carrier particles so that uniform carrier particles are not obtained.

When the development agent is the two component development agent, there is no specific limit to the content of the carrier in the two component development agent. For example, the content is preferably from 90% by weight to 98% by weight and more preferably from 93% by weight to 97% by weight.

Latent Electrostatic Image Bearing Member

There is no specific limit to the latent electrostatic image bearing member with regard to the material, form, structure, size, etc. Specific examples of the form include, but are not limited to, a drum-like form, a sheet-like form, and an endless belt-like form.

As for the structure, it may employ a single-layer structure or a laminate structure.

The size can be suitably determined according to the size of the image forming apparatus and specifications.

Specific examples of the materials include, but are not limited to, inorganic compounds such as amorphous silicon, selenium, CdS, and ZnO; and organic compounds such as polysilane and phthalopolymethine.

Charger

The charger charges the surface of the latent electrostatic image bearing member.

There is no specific limit to the charger that can apply a voltage to the surface of the latent electrostatic image bearing member to uniformly charge it. These are generally classified into (1): a contact type charger that charges the latent electrostatic image bearing member by contact; and (2) a non-contact type charger that charges the latent electrostatic image bearing member in a non-contact manner.

Specific examples of the contact-type charger of (1) include, but are not limited to, an electroconductive or semi-electroconductive charging roller, a magnetic brush, a fur brush, a film, and a rubber blade.

Among these, the charging roller possibly reduces the produced amount of ozone in comparison with corona discharging and has an excellent stability during repetitive use of the latent electrostatic image bearing member, which is suitable to prevent the deterioration of the image quality.

Specific examples of the non-contact-type charger of (2) include, but are not limited to, a non-contact type charger, a needle electrode device, and a solid discharging element using corona discharging; and an electroconductive or semi-electroconductive charging roller arranged against the latent electrostatic image bearing member with a minute gap therebetween.

Irradiator

The irradiator irradiates the surface of the latent electrostatic image bearing member to form latent electrostatic images thereon.

There is no specific limit to any irradiator that irradiates the surface of the latent electrostatic image bearing member charged by the charger with a light pattern of an original image. Specific examples of such irradiators include, but are not limited to, a photocopying optical system, a rod lens array system, a laser optical system, a liquid crystal shutter optical system, and an LED optical system.

The rear side irradiation system in which a latent electrostatic image bearing member is irradiated from the rear side thereof can be also employed.

Any known development device that can perform development with the toner of the present disclosure is suitably selected. For example, a development device that accommodates the toner of the present disclosure and includes a development unit which attaches the toner to the latent electrostatic image in a contact or non-contact manner can be suitably used.

Development Device

The development device forms visible images by developing the latent electrostatic image with the toner of the present disclosure.

The development device may employ a dry-type development system or a wet-type development system.

In addition, a single color development device or a multiple-color development device is usable. For example, it is suitable to use a development device that includes a stirrer to triboelectrically charge toner, a magnetic field generating device fixed inside, and a rotatable development agent bearing member that bears a development agent containing the toner.

In the development device, for example, the toner and the carrier are mixed and stirred so that the toner is triboelectrically charged. As a result, toner filament is held on the surface of the rotating magnet roller to form a magnet brush.

Since the magnet roller is disposed close to the latent electrostatic image bearing member, part of the toner forming the magnet brush formed on the surface of the magnet roller is electrically attracted to the surface of the latent electrostatic image bearing member.

As a result, the latent electrostatic image is developed with the toner to form a visible toner image on the surface of the latent electrostatic image bearing member.

Figure 2:
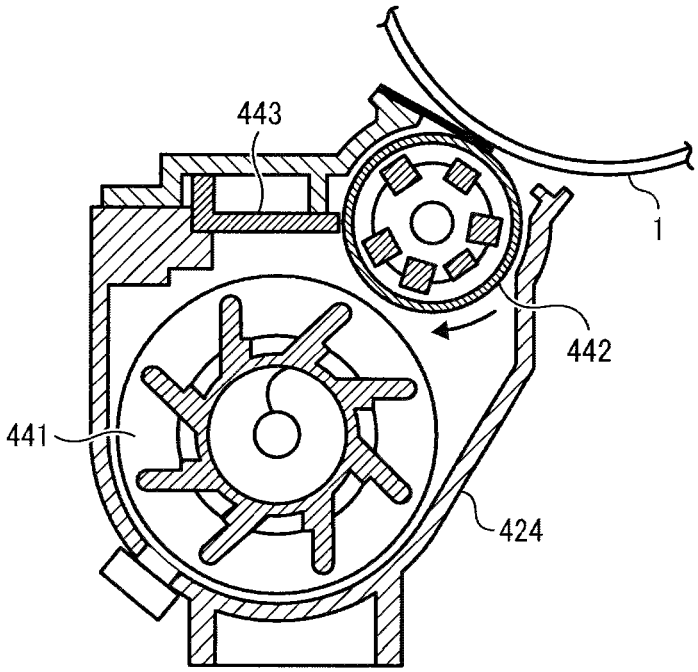
FIG. 2 is a schematic diagram illustrating an example of a two-component development agent device in the image forming apparatus according to an embodiment of the present disclosure.

FIG. 2 is a schematic diagram illustrating an example of a two component development device using a two component development agent containing toner and magnetic carrier.

In the two component development agent device of FIG. 2, a screw 441 stirs the two component development agent and transfers and supplies it to a development sleeve 442 serving as the development agent bearing member.

The two component development agent supplied to the development sleeve 442 is regulated by a doctor blade 443 serving as a layer thickness regulator. The supplying amount of the development agent is controlled by a doctor gap formed between the doctor blade 443 and the development sleeve 442.

When this doctor gap is too small, the amount of development agent tends to be excessively small, resulting in the shortage of the image density. When this doctor gap is too large, the development agent is easily supplied excessively, which causes the carrier to attach to an image bearing drum 1 serving as the latent electrostatic image bearing member.

Therefore, inside the development sleeve 442, a magnet is provided to serve as a magnetic field generating device that forms a magnetic field to hold development agent filaments on the circumference surface of the development sleeve 442 so that the magnetic chain-like filament brush is formed on the development sleeve 442 following the magnetic line in the normal line direction generated by the magnet.

The development sleeve 442 and the image bearing drum 1 are arranged in the vicinity of each other with a constant gap (development gap) to form development areas on both opposing portions.

The development sleeve 442 has a cylindrical form made of non-magnetic substance such as aluminum, brass, stainless steel, and electroconductive resin and is rotatable by a rotation driving mechanism.

The magnetic brush is transferred to the development area by the rotation of the development sleeve 442.

A development bias is applied to the development sleeve 442 by a power source for development so that the toner on the magnet brush is separated from the carrier by the development electric field formed between the development sleeve 442 and the image bearing drum 1 to develop the latent electrostatic image on the image bearing drum 1.

An AC voltage can be superimposed on the development voltage.

The development gap is preferably from about 5 times to 30 times as large as the particle diameter of the development agent. If the development agent has a particle diameter of 50 μm, a suitable development gap is from 0.25 mm to 1.5 mm. When the development gap is too large, a desired image density is not easily obtained.

In addition, the doctor gap is preferably about the same as the development gap or slightly larger than that.

The drum diameter of the image bearing drum 1, the drum linear speed thereof, the sleeve diameter of the development sleeve 442, and the sleeve linear speed thereof are determined by limitation with regard to the photocopying speed and the size of the device.

The ratio of the sleeve linear speed to the drum linear speed is preferably 1.1 or greater to obtain a required image density.

It is also possible to provide a sensor at a position from downstream of the development that detects the attachment amount of the toner from the optical reflectivity to control the process conditions.

Transfer Device

The transfer device transfers the visible image to a recording medium.

The transfer device is typified into a transfer device that directly transfers a visible image on the latent electrostatic image bearing member to a recording medium and a transfer device including an intermediate transfer element to which a visible image is primarily transferred and from which the visible image is secondarily transferred to a recording medium.

There is no specific limit to either of the transfer devices and any known transfer device is usable.

Fixing Device

The fixing device fixes the transfer image on the recording medium.

There is no specific limit to the fixing device. A fixing device having a fixing member and a heating source that heats the fixing member is preferably used.

There is no specific limit to the fixing device that forms a nip portion with members while in contact with each other. For example, a combination of an endless belt and a roller and a combination of rollers are suitably used. It is preferable to use the combination of the endless belt and the roller and a method of heating the surface of the fixing member by induction-heating in terms of lessening the warm-up time and saving energy.

The fixing device is classified into (1): a system (interior heating system) in which a fixing device has at least one of a roller and a belt and conducts heating from the side of the surface not in contact with the toner to fix a transfer image transferred onto a recording medium by heat and a pressure; and (2): a system (exterior heating system) in which a fixing device has at least one of a roller and a belt and conducts heating from the side of the surface in contact with the toner to fix a transfer image transferred onto a recording medium by heat and a pressure.

It is possible to use both in combination.

As the fixing device of the interior heating system of (1), for example, a fixing device itself having a heating device inside thereof can be used.

A heat source such as a heater and a halogen lamp can be used as such a heating system.

As the fixing device of the exterior heating system of (2), for example, a system is preferable in which at least part of the surface of at least one of the fixing members is heated by a heating device.

There is no specific limit to the heating device. A specific example thereof include, but are not limited to, an electromagnetic induction heating device.

There is no specific limit to the electromagnetic induction heating device. A system having a device to generate a magnetic field and a device to generate heat by electromagnetic induction is preferable.

As the electromagnetic induction heating device, a device is preferable which has an induction coil arranged close to the fixing member (for example, the heating roller), a shielding layer to which the induction coil is provided, and an insulation layer provided onto the side of the shielding layer which is reverse to the side on which the induction coil is provided.

It is preferable that the heating roller has a system having a magnetic substance or a heating pipe.

It is preferable that the induction coil is arranged facing the heating roller while encapsulating at least the semi-cylindrical portion of the heating roller on the reverse side of the contact side of the heating roller and the fixing member (for example, the pressure roller and the endless belt).

Process Cartridge

The process cartridge of the present disclosure includes at least a latent electrostatic image bearing member and a development device with other optional devices such as a charger, an irradiator, a transfer device, a cleaner, and a discharging device.

The development device forms visible images by developing the latent electrostatic image borne on the latent electrostatic image bearing member with the toner of the present disclosure.

The development device includes at least a toner container to accommodate the toner and a toner bearing member to bear and transfer the toner accommodated in the toner container. It optionally has a layer thickness regulator to regulate the toner layer thickness borne on the development device.

It is preferable that the development device includes at least a development agent container to accommodate the development agent and a development agent bearing member to bear and transfer the development agent accommodated in the development agent container.

To be specific, either of the development device described in the image forming apparatus can be suitably used.

In addition, as for the charger, the irradiator, the transfer device, the cleaner, and the discharging device, the same devices as described in the image forming apparatus can be suitably used.

The process cartridge described above is detachably attachable to various electrophotographic image forming apparatuses, facsimile machines, and printers and preferably detachably attachable to the image forming apparatus of the present disclosure.

The process cartridge includes, for example, a latent electrostatic image bearing member 101, a charger 102, a development device 104, a transfer device 106, a cleaner 107, and other optional devices.

Figure 5:
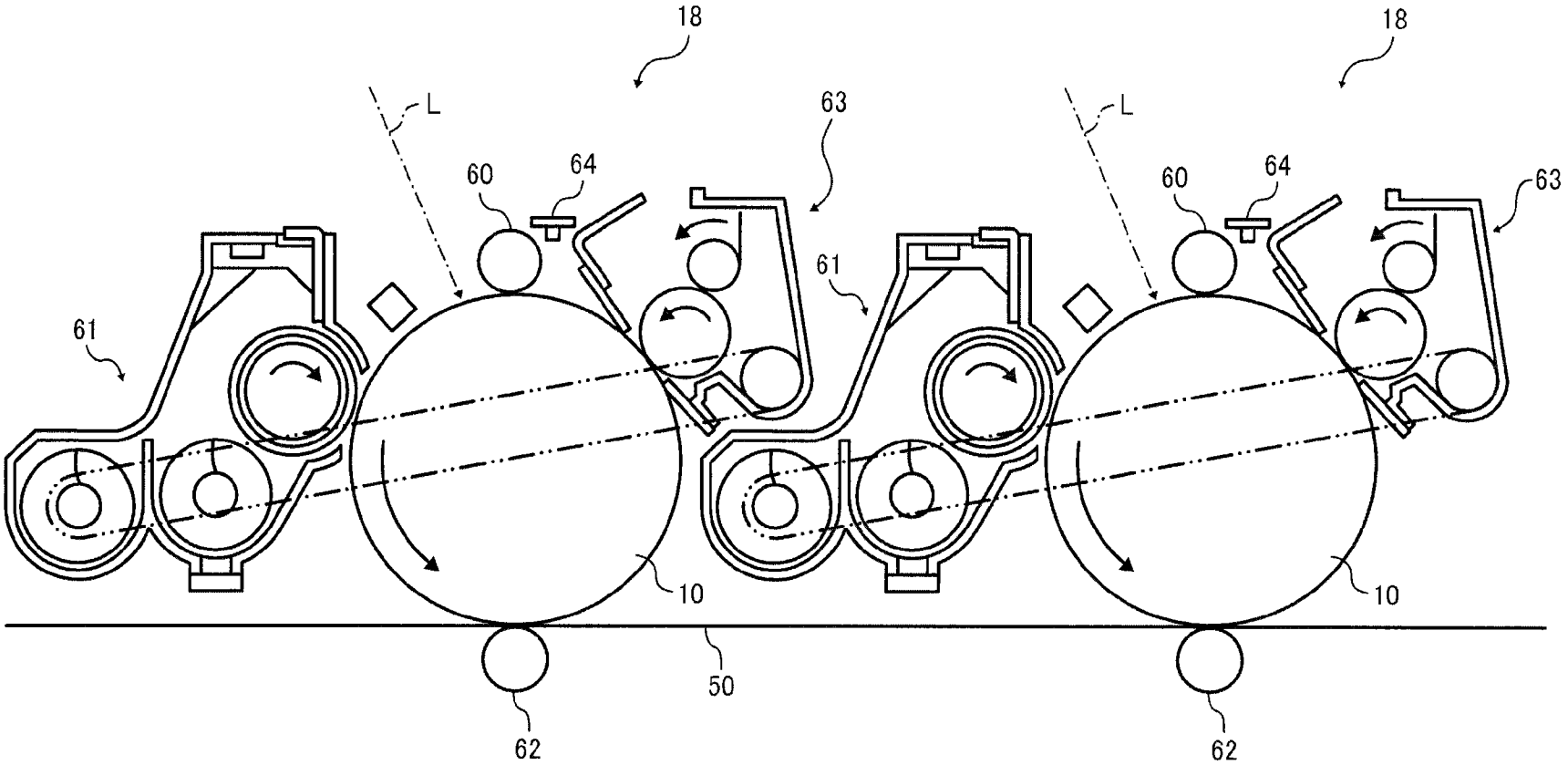
FIG. 5 is an enlarged diagram illustrating the image forming element illustrated in FIG. 3.

In FIG. 5, the numeral references 103 and 105 represent beams of light by an irradiator and a recording medium, respectively.

Figure 3:
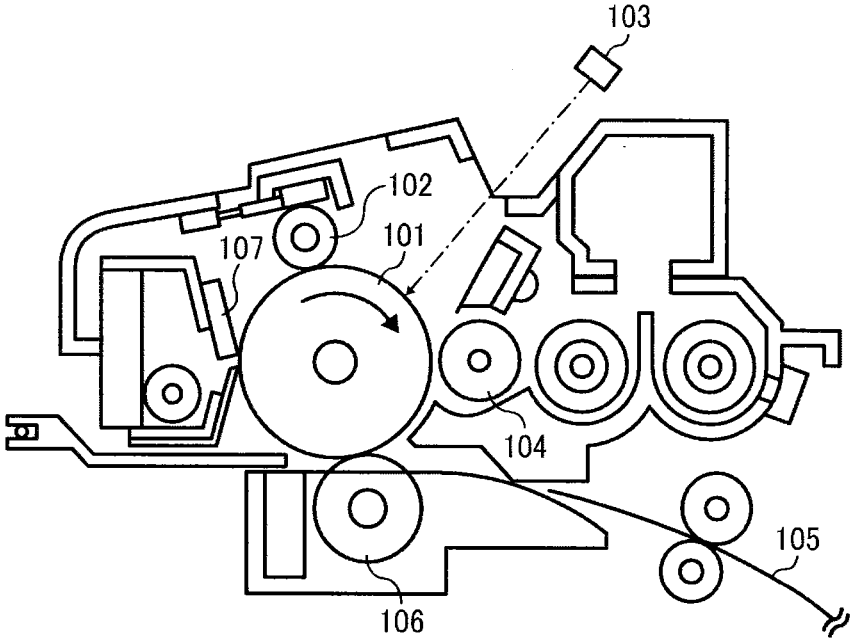
FIG. 3 is a schematic diagram illustrating an example of a process cartridge according to an embodiment of the present disclosure.

Next, the image forming process by the process cartridge illustrated in FIG. 3 is described. The latent electrostatic image bearing member 101 is charged by the charger 102 and irradiated with the beams of light 103 by an irradiator while rotating in the direction indicated by an arrow to form a latent electrostatic image on the surface of the latent electrostatic image bearing member 101 corresponding to the light pattern of an original document.

This latent electrostatic image is developed with toner by the development device 104 and the developed toner image is transferred by the transfer device 108 to the recording medium 105 and printed out.

The surface of the latent electrostatic image bearing member 101 is cleaned after the image transfer by the cleaner 107 and discharged by the discharging device to be ready for the next image forming.

Tandem Type Image Forming Apparatus

An embodiment of the image forming apparatus is described in detail.

This image forming apparatus is a tandem type image forming apparatus (image forming apparatus A) employing an indirect transfer system, a contact charging system, a two component development system, a secondary transfer system, a blade cleaning system, and a roller fixing system using external heating and is used to evaluate the performance of the toner of Examples and Comparative Examples described later.

Figure 4:
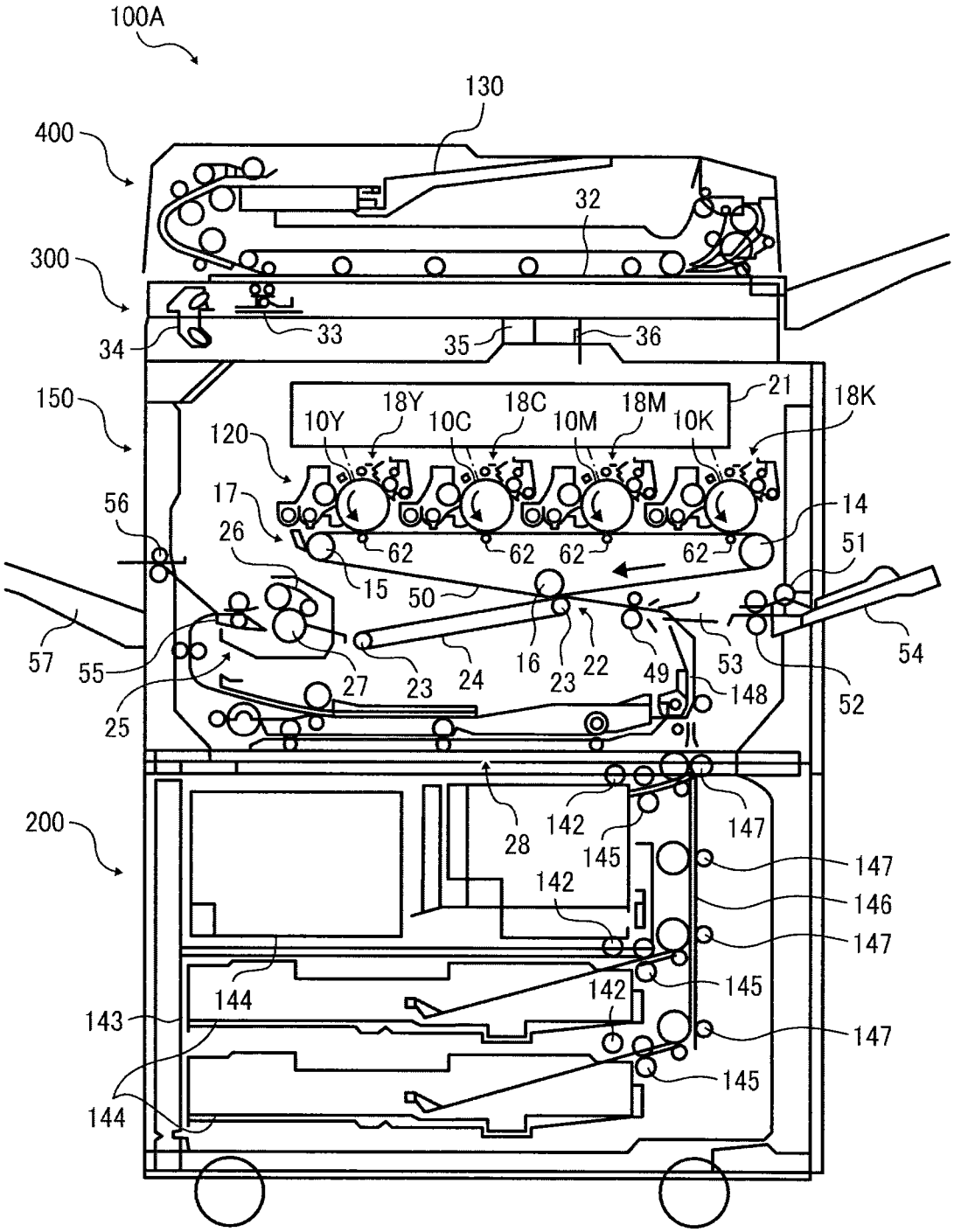
FIG. 4 is a schematic diagram illustrating an example of an image forming apparatus employing a tandem system according to an embodiment of the present disclosure.

FIG. 4 is a diagram illustrating the image forming apparatus 100A of a tandem type color image forming apparatus.

An image forming apparatus 100 includes a main functional portion 150, a sheet feeder table 200, a scanner 300, and an automatic document feeder (ADF) 400.

The main portion 150 of the image forming apparatus has an intermediate transfer body 50 having an endless belt form at the center thereof.

The intermediate transfer 50 is stretched over a support rollers 14, 15 and 16 and rotatable clockwise in FIG. 4.

An intermediate transfer cleaner 17 to remove the residual toner on the intermediate transfer body 50 is arranged around the support roller 15.

The tandem development device 120, which has four image forming units 18 of yellow, cyan, magenta and black, is arranged facing the intermediate transfer body 50 stretched over the support rollers 14 and 15 along the transfer direction thereof.

An irradiator 21 is arranged close to the tandem development device 120.

A secondary transfer device 22 is arranged facing the tandem development device 120 with the intermediate transfer body 50 therebetween.

In the secondary transfer device 22, a secondary transfer belt 24 having an endless belt form is stretched over a pair of rollers 23 and a recording medium transferred to the secondary transfer belt 24 is contactable with the intermediate transfer body 50 with each other.

A fixing device 25 is arranged close to the secondary transfer device 22.

In addition, in the tandem image forming apparatus 100A, a sheet reversing device 28 to form images on both sides of the recording medium by reversing the recording medium is arranged close to the secondary transfer device 22 and the fixing device 25.

Next, the formation of a full color image using the tandem development device 120 is described with reference to FIGS. 4 and 5.

First, a document (original) is placed on a document table 130 on the automatic document feeder 400. Alternatively, the automatic document feeder 400 is opened and a document is placed on a contact glass 32 of the scanner 300, and the automatic document feeder 400 is closed.

When a start button is pressed, the scanner is driven to start scanning with a first scanning unit 33 and a second scanning unit 34 after the document is moved to the contact glass 32 in the case in which the document is set on the automatic document feeder 400 or immediately in the case in which the document is set on the contact glass 32.

Then, the document is irradiated with light emitted from a light source by the first scanning unit 33 and the reflection light from the document is redirected at the mirror of the second scanning unit 34. The redirected light at the mirror of the second scanning unit 34 passes through an image focusing lens 35 and is received at a reading sensor 36 to read the document (color image), thereby obtaining black, yellow, magenta and cyan image data.

Each image data for black, yellow, magenta, and cyan are transmitted to each image forming unit 18 (image forming units 18K, 18Y, 18M, and 18C for black, yellow, magenta, and cyan, respectively) in the tandem development device 120 to form each color toner image of black, yellow, magenta, and cyan at each image forming unit.

As illustrated in FIG. 5, each image forming unit 18 (image forming units 18K, 18Y, 18M, and 18C for black, yellow, magenta, and cyan, respectively) in the tandem development device 120 includes a latent electrostatic image bearing member 10 (latent electrostatic image bearing members 10K, 10Y, 10M, and 10C for black, yellow, magenta, and cyan, respectively), a charger 60 that uniformly charges the latent electrostatic image bearing member 10, an irradiator that irradiates the latent electrostatic image bearing member 10 with beams of light L according to each color image data to form a latent electrostatic image corresponding to each color image on the latent electrostatic image bearing member 10, a development unit 61 that forms a toner image with each color toner by developing each latent electrostatic image with each color toner (black toner, yellow toner, magenta toner, and cyan toner), a transfer charger 62 that transfers the toner image to the intermediate transfer body 50, a cleaner 63, and a discharging device 64. Therefore, each single color image (black image, yellow image, magenta image, and cyan image) can be formed based on each color image data.

The black image, the yellow image, the magenta image, and the cyan image formed on the latent image bearing member 10K for black, the latent image bearing member 10Y for yellow, the latent image bearing member 10M for magenta, and the latent image bearing member 10C for cyan, respectively, are primarily transferred sequentially to the intermediate transfer body 50 rotated by the support rollers 14, 15, and 16.

Then, the black image, the yellow image, the magenta image, and the cyan image are superimposed on the intermediate transfer body 50 to form a synthesized color image (color transfer image).

In the sheet feeder table 200, one of the sheet feeder rollers 142 is selectively rotated to feed recording media (sheets) from one of multiple sheet cassettes 144 stacked in a sheet bank 143. A separating roller 145 separates the recording media one by one to feed it to a sheet path 146. Transfer rollers 147 transfer and guide the recording medium to a sheet path 148 in the main portion 150 of the image forming apparatus 100 and the recording medium is held at a pair of registration roller 49.

Alternatively, the recording media (sheets) on a manual tray 54 are fed by rotating a sheet feeding roller 51, and separated one by one by a separating roller 52, transferred to a manual sheet path 53, and also halted at the registration roller 49.

The registration roller 49 is typically grounded but a bias can be applied thereto to remove paper dust on the recording medium.

The registration roller 49 is rotated in synchronization with the synthesized color image (color transfer image) on the intermediate transfer body 50 to send the recording medium (sheet) between the intermediate transfer body 50 and the secondary transfer device 22. The synthesized color image (color transfer image) is secondarily transferred to the recording medium to form a synthesized color image thereon.

The residual toner remaining on the intermediate transfer body 50 after the image transfer is removed by the intermediate transfer body cleaner 17.

The recording medium to which the color image is transferred is sent to the fixing device 25 by the secondary transfer device 22 and the synthesized color image (color transfer image) is fixed on the recording medium by heat and pressure at the fixing device 25.

Thereafter, the paper path is switched by a switching claw 55 and a discharging roller 56 discharges the recording medium to stack it on a discharging tray 57. Alternatively, the paper path is switched by the switching claw 55, a sheet reversing device 28 reverses and guides the recording medium to the transfer position again, an image is recorded on the reverse side of the recording medium, and a discharging roller 56 discharges the recording medium to stack it on the discharging tray 57.

Reference numerals 26 and 27 in FIG. 4 represent a fixing belt and a pressure roller, respectively.

In the case of the image forming apparatus 100A, damage to image during transfer thereof in the transfer (paper) path occurs when the recording medium passes through the discharging roller 56 or the transfer roller arranged in the sheet reversing device 28 in the middle of re-crystallization of the toner immediately after heat fixing.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples and Comparative examples but not limited thereto.

The methods of manufacturing binder resins for use in manufacturing toners of Examples and Comparative Examples are described first.

Manufacturing of Resin 1-A-1

Alcohol components and acid components were added in a reaction container equipped with a condenser, a stirrer, and a nitrogen introducing tube with ratios shown in Table 1-1 such that the mass of the entire agents was 250 g.

Titan tetraisopropoxide (1,000 ppm to the resin component) serving as a polymerization catalyst was also placed therein.

In nitrogen atmosphere, the system was heated to 200° C. in about 4 hours and further heated to 230° C. in 2 hours to continue the reaction until no component flew out. Thereafter, reaction was conducted for 5 hours with a reduced pressure of from 10 mmHg to 15 mmHg to obtain [Resin 1-A-1].

With regard to [Resin 1-A-1], the weight average molecular weight was 13,000, the melting point was 66° C., and the hydroxyl value was 40 mgKOH/g as measured by gel permeation chromatography (GPC) (manufactured by Tosoh Corporation, solvent: tetrahydrofuran (THF), conversion in polystyrene).

Manufacturing of Resins 1-A-2 to 1-A-5

[Resin 1-A-2] to [Resin 1-A-5] were synthesized in the same manner as in Manufacturing of [Resin 1-A-1] except that the alcohol component and the acid component were changed as shown in Table 1-1.

Manufacturing of Resin 1-B-1

[Resin 1-A-1] and 4,4'-diphenyl methane diisocyanate (MDI) were placed in a reaction container equipped with a condenser, a stirrer, and a nitrogen introducing tube in such a manner that the molar ratio of isocyanate group to hydroxyl group was 0.5.

[Resin 1-B-1] was obtained after placing ethyl acetate in such a manner that the concentration of [Resin 1-A-1] and MDI were 50% by weight and conducting reaction at 100° C. for 5 hours followed by distillation away of ethyl acetate.

Manufacturing of Resin 1-B-2

[Resin 1-A-1] and an adduct of bisphenol A with 2 mols of proopylene oxide were placed in a reaction container equipped with a condenser, a stirrer, and a nitrogen introducing tube with a ratio of 90% by weight to 10% by weight and MDI was added thereto such that the molar ratio of isocyanate group to hydroxyl group was 0.5.

[Resin 1-B-2] was obtained after placing ethyl acetate in such a manner that the concentration of [Resin 1-A-1] and MDI were 50% by weight and conducting reaction at 100° C. for 5 hours followed by distillation away of ethyl acetate.

Manufacturing of Resin 1-B-3

An adduct of bisphenol A with 2 mols of proopylene oxide and MDI were placed in a reaction container equipped with a condenser, a stirrer, and a nitrogen introducing tube in such a manner that the molar ratio of isocyanate group to the hydroxyl group was 2.0.

Next, after ethyl acetate was placed therein such that the concentration of an adduct of bisphenol A with 2 mols of proopylene oxide and MDI were 50% by weight to conduct reaction at 45° C. for 10 hours.

The reactant obtained by the reaction of the adduct of bisphenol A with 2 mols of propylene oxide and MDI and [Resin 1-A-1] were placed in a reaction container equipped with a condenser, a stirrer, and a nitrogen introducing tube in such a manner that the molar ratio of isocyanate group to the hydroxyl group was 0.5.

[Resin 1-B-3] was obtained after placing ethyl acetate in such a manner that the concentration of the reactant of [Resin 1-A-1] and MDI were 50% by weight and conducting reaction at 100° C. for 5 hours followed by distillation away of ethyl acetate.

Manufacturing of Resin 1-B-4

Hexamethylene diamine and MDI were placed in a reaction container equipped with a condenser, a stirrer, and a nitrogen introducing tube in such a manner that the molar ratio of isocyanate group to the hydroxyl group was 2.0.

Next, after ethyl acetate was placed therein such that the concentration of hexamethylene diamine and MDI were 50% by weight to conduct reaction at 45° C. for 10 hours.

The reactant obtained by the reaction of hexamethylene diamine and MDI and [Resin 1-A-1] were placed in a reaction container equipped with a condenser, a stirrer, and a nitrogen introducing tube in such a manner that the molar ratio of isocyanate group to the hydroxyl group was 0.5.

[Resin 1-B-4] was obtained after placing the reactant obtained by the reaction of hexamethylene diamine and MDI and [Resin 1-A-1] were 50% by weight and conducting reaction at 100° C. for 5 hours followed by distillation away of ethyl acetate.

Manufacturing of Resin 1-B-5

[Resin 1-B-5], which was a crystalline polyester resin was synthesized in the same manner as in manufacturing of [Resin 1-B-4] except that hexamethylene diamine was changed to ethylene diamine.

Manufacturing of Resin 1-B-6

[Resin 1-B-6], which was a crystalline polyester resin was synthesized in the same manner as in manufacturing of [Resin 1-B-1] except that 1,000 ppm to [Resin 1-A-1] was placed.

Manufacturing of Resin 1-B-7

An adduct of bisphenol A with 2 mols of proopylene oxide and MDI were placed in a reaction container equipped with a condenser, a stirrer, and a nitrogen introducing tube in such a manner that the molar ratio of isocyanate group to hydroxyl group was 2.0.

Next, ethyl acetate was placed therein such that the concentration of an adduct of bisphenol A with 2 mols of proopylene oxide and MDI were 50% by weight and thereafter hexamethylene diamine was placed therein to conduct reaction at 45° C. for 10 hours such that the molar ratio of isocyanate group to amino group was 3.0.

Thereafter, the reactant and [Resin 1-A-2] were placed in a reaction container equipped with a condenser, a stirrer, and a nitrogen introducing tube in such a manner that the molar ratio of isocyanate group to hydroxyl group was 0.6.

After ethyl acetate was added thereto in such a manner that the concentration of the reactant and [Resin 1-A-2] were 50% by weight to conduct reaction at 100° C. for 5 hours, ethyl acetate was distilled away to obtain [Resin 1-B-7], which was a crystalline polyester resin.

Manufacturing of Resin 1-B-8

[Resin 1-B-8], which was a crystalline polyester resin was synthesized in the same manner as in manufacturing of [Resin 1-B-7] except that [Resin 1-A-2] was changed to [Resin 1-A-3].

Manufacturing of Resin 1-B-8

[Resin 1-B-9], which was a crystalline polyester resin was synthesized in the same manner as in manufacturing of [Resin 1-B-7] except that [Resin 1-A-2] was changed to [Resin 1-A-4].

Manufacturing of Resin 1-B-10

[Resin 1-B-10], which was a crystalline polyester resin was synthesized in the same manner as in manufacturing of [Resin 1-B-7] except that [Resin 1-A-2] was changed to [Resin 1-A-5].

Manufacturing of Resin 1-C-1

Thereafter, [Resin 1-A-1] and MDI were placed in a reaction container equipped with a condenser, a stirrer, and a nitrogen introducing tube in such a manner that the molar ratio of isocyanate group to hydroxyl group was 2.0.

After ethyl acetate was added thereto in such a manner that the concentration of the reactant and [Resin 1-A-1] and MDI were 50% by weight to conduct reaction at 100° C. for 5 hours, hexamethylene diamine was placed therein to conduct reaction at 45° C. for 10 hours such that the molar ratio of isocyanate group to amino group was 0.1 and ethyl acetate was distilled away to obtain [Resin 1-C-1], which was crystalline polyester resin.

Manufacturing of Resin 1-C-2

Thereafter, [Resin 1-A-1] and MDI were placed in a reaction container equipped with a condenser, a stirrer, and a nitrogen introducing tube in such a manner that the molar ratio of isocyanate group to hydroxyl group was 2.0.

[Resin 1-C-2] was obtained after placing ethyl acetate in such a manner that the concentration of [Resin 1-A-1] and MDI were 50% by weight and conducting reaction at 100° C. for 5 hours followed by distillation away of ethyl acetate.

Manufacturing of Resin 1-C-3

[Resin 1-C-3], which was a crystalline polyester resin was synthesized in the same manner as in manufacturing of [Resin 1-C-1] except that [Resin 1-A-1] was changed to [Resin 1-A-2].

Manufacturing of Resin 1-C-4

[Resin 1-C-4], which was a crystalline polyester resin was synthesized in the same manner as in manufacturing of [Resin 1-C-1] except that [Resin 1-A-1] was changed to [Resin 1-A-3].

Manufacturing of Resin 1-C-5

[Resin 1-C-5], which was a crystalline polyester resin was synthesized in the same manner as in manufacturing of [Resin 1-C-1] except that [Resin 1-A-1] was changed to [Resin 1-A-4].

Manufacturing of Resin 1-C-6

[Resin 1-C-6], which was a crystalline polyester resin was synthesized in the same manner as in manufacturing of [Resin 1-C-1] except that [Resin 1-A-1] was changed to [Resin 1-A-5].

Manufacturing of Non-crystalline Polyester Resin D-1

An adduct of bisphenol A with 2 mols of ethylene oxide, an adduct of bisphenol A with 3 mols of proopylene oxide, isophthalic acid, and adipic acid were placed in a reaction container equipped with a condenser, a stirrer, and a nitrogen introducing tube in such a manner that the molar ratio of hydroxyl group to carboxylic acid was 1.3.

At this moment, diol was composed of 80 mol % of an adduct of bisphenol A with 2 mols of ethylene oxide and 20 mol % of an adduct of bisphenol A with 3 mols of proopylene oxide.

Dicarboxylic acid was composed of 80 mol % of isophtalic acid and 20 mol % adipic acid.

Furthermore, titan tetraisopropoxide was placed therein such that the mass ratio thereof to the entire monomer was 500 ppm.

[Resin D-1] was obtained after 8 hour reaction at 230° C. followed by 4 hour reaction with a reduced pressure of 10 mmHg to 15 mmHg.

[Resin 1-A-1] to [Resin 1-A-5], [Resin 1-B-1] to [Resin 1-B-10], [Resin 1-C-1] to [Resin 1-C-6], and [Resin 1-D-1] have weight average molecular weights and melting points, and glass transition temperatures (Tg) shown in Tables 1-1 to 1-4.

Example 1-1

Preparation of Master Batch 1

1,200 parts of water, 500 parts of carbon black (Printex 35, manufactured by Degussa AG) having an DBP oil absorption amount of 42 ml/100 mg and a pH of 9.5, and 500 parts of [Resin 1-A-1] were mixed followed by kneading at 150° C. for 30 minutes by a twin-shaft roll.

Next, after cooling and rolling, the resultant was pulverized by a pulverizer to obtain [Master batch 1].

Preparation of Master Batch 2

1,200 parts of water, 500 parts of carbon black (Printex 35, manufactured by Degussa AG) having an DBP oil absorption amount of 42 ml/100 mg and a pH of 9.5, and 500 parts of [Resin 1-D-1] were mixed followed by kneading at 150° C. for 30 minutes by a twin-shaft roll.

Next, after cooling and rolling, the resultant was pulverized by a pulverizer to obtain [Master batch 2].

Manufacturing of Liquid Dispersion of Wax 100 parts of paraffin wax (HNP-9, melting point: 75° C., manufactured by NIPPON SEIRO CO., LTD.) and 400 parts of ethyl acetate were placed in reaction container equipped with a condenser, a thermometer, and a stirrer. The system was heated to 78° C. to dissolve the wax followed by cooling down to 30° C. in one hour while stirring. Thereafter, the resultant was wet-pulverized under the conditions of: liquid transfer speed 1.0 kg/h; disk circumferential speed: 10 m/s; filling amount of 0.5 mm zirconia beads: 80% by volume; number of passes: 6 to obtain [Wax liquid dispersion].

Preparation of Liquid Dispersion of Styrene and Acrylic Resin Particle 1

The following recipe was placed in a container equipped with a stirrer and a thermometer and stirred at 400 rpm for 15 minutes:

Deionized water: 683 parts

Sodium salt of sulfate of an adduct of methacrylic acid with ethyleneoxide (EREMINOR RS-30, manufactured by Sanyo Chemical Industries, Ltd.): 16 parts Styrene: 83 parts Methacrylic acid: 83 parts Butyl acrylate: 110 parts Ammonium persulfate: 1 part Furthermore, the system was heated to 75° C. for 5 hours and 30 parts of 1 weight % aqueous solution of ammonium persulfate was added thereto followed by aging at 75° C. for 5 hours to obtain [Liquid dispersion of styrene/acrylic resin particle 1].

Styrene/acrylic resin particle 1 had a volume average particle diameter of 14 nm, an acid value of 45 mg/KOH, a weight average molecular weight of 300,000, and a glass transition temperature of 60° C.

Preparation of Liquid Dispersion of Acrylic Resin Particle 1

The following recipe was placed in a container equipped with a stirrer and a thermometer and stirred at 400 rpm for 15 minutes:

Water: 683 parts
Sodium sulfate of alkyl benzene: 10 parts
Methyl methacrylate: 176 parts
Butyl acrylate: 18 parts
Acrylic acid: 6 parts
Ammonium persulfate: 1 part
Ethylene glycol dimethacrylate: 2 parts Thereafter, the system was heated to 65° C. to conduct reaction for 10 hours and 30 parts of 1 weight % aqueous solution of ammonium persulfate was added thereto followed by aging at 75° C. for 5 hours to obtain [Liquid dispersion of acrylic resin particle 1].

The acrylic resin particle 1 had a volume average particle diameter of 35 nm, a weight average molecular weight of 300,000, and a glass transition temperature of 82° C.

Manufacturing of Toner 1

Preparation of Oil Phase 40 parts of wax liquid dispersion, 500 parts of [Resin 1-B-1], 200 parts of [Resin 1-A-1], 140 parts of [Resin 1-C-1], 120 parts of [Master batch 1], and 1,300 parts of ethyl acetate were placed in a container followed by mixing at 50° C. at 5,000 rpm for 60 minutes using a TK Homomixer (manufactured by Primix Corporation) to obtain the first liquid.

The following components were mixed:

Water: 426 parts
[Liquid dispersion of stryene/acrylic resin particle 1]: 11 parts
EREMINOL MON-7 of aqueous solution of 48.5% by weight dodecyldiphenyl ether dosium sulfate (manufactured by Sanyo Chemical Industries, Ltd.): 87 parts
Ethyl acetate: 48 parts Thereafter, 29 parts of [Liquid dispersion of acrylic resin particle 1] was added thereto followed by mixing at 50° C. at 5,000 rpm for 10 minutes.

600 parts of an aqueous medium were added to 400 parts of the first liquid followed by mixing at 50° C. at 13,000 rpm for 20 minutes by using a TK Homomixer (manufactured by Primix Corporation) to obtain en emulsified slurry.

The emulsified slurry was placed in a reaction container equipped with a stirrer and a thermometer followed by removal of the solvent at 50° C. for 8 hours. A slurry dispersion was obtained after elongation reaction or annealing by water at 45° C. for 10 hours.

After 100 parts of the slurry dispersion was filtered with a reduced pressure, the following operations of 1 to 4 were repeated twice to obtain a filtered cake:

1): 100 parts of water was added to the filtered cake and they were mixed at 12,000 rpm for 10 minutes by a TK Homomixer (manufactured by Primix Corporation) followed by filtration.

2): 100 parts of an aqueous solution of 10% by weight sodium hydroxide was added to the filtered cake and the mixture was mixed by a TK Homomixer (manufactured by Primix Corporation) at 12,000 rpm for 30 minutes followed by filtration with a reduced pressure;

3): 100 parts of 10% by weight hydrochloric acid was added to the filtered cake, which were mixed at 12,000 rpm for 10 minutes by a TK Homomixer (manufactured by Primix Corporation) followed by filtration.

4): 300 parts of water was added to the filtered cake and mixed at 12,000 rpm for 10 minutes by a TK Homomixer (manufactured by Primix Corporation) followed by filtration.

The obtained filtered cake was dried by a circulation drier at 45° C. for 48 hours. The dried cake was sieved by using a screen having an opening of 75 μm to obtain mother particles.

100 parts of the mother particles, 0.7 parts of a hydrophobic silica, and 0.3 parts of hydrophobic titanium oxide were mixed by a HENSCHEL MIXER to obtain [Toner 1].

Manufacturing of Carrier 1

100 parts of toluene, 100 parts of organo straight silicone, 5 parts of γ-(2-aminoethyl)aminopropyl trimethoxy silane, and 10 parts of carbon black were dispersed by a HOMOMIXER for 20 minutes to prepare a resin layer liquid application.

Using a fluid bed type coating device, the resin layer liquid application was applied to the surface of spherical magnetite having an average particle diameter of 50 μm to manufacture [Carrier 1].

Manufacturing of Development Agent 15 parts of [Toner 1] and 95 parts of the [Carrier 1] were mixed by a ball mill to manufacture [Development agent 1].

Thereafter, using [Development agent 1], the lower limit of the fixing temperature and the upper limit of the fixing temperature were evaluated.

[Toner 1] was used to evaluate the high temperature stability.

Evaluation

The performance evaluation method of the binder resin, the toner, and the development agent for use in the present disclosure is described in detail.

The image output by using the toner was evaluated by using the image forming apparatus illustrated in FIG. 4.

Maximum Endothermic Peak of Toner

The maximum endothermic peak was measured by DSC SYSTEM Q-200 (manufactured by TA INSTRUMENTS. JAPAN).

To be specific, about 5.0 g of the resin was placed in an aluminum sample container; the container was placed on a holder unit; and the holder unit was set in an electric furnace; then, the temperature was raised from 0° C. to 100° C. in a nitrogen atmosphere at a temperature rising speed of 10° C./min.; the temperature was lowered from 100° C. to 0° C. at a temperature falling speed of 10° C./min; the DSC curve at the first time temperature rising was selected and the maximum endothermic peak temperature T1 of the toner was measured by using the analysis program installed on the DSC SYSTEM Q-200 (manufactured by TA INSTRUMENTS. JAPAN).

Similarly, the maximum exothermic peak temperature T2 of the toner was also measured in the first time temperature falling.

Low Temperature Fixability (Lowest Fixing Temperature)

A solid image (image size: 3 cm×8 cm) having a toner attachment amount of from 0.75 mg/cm$^2$ to 0.95 mg/cm$^2$ after image transfer was formed on a transfer sheet (photocopying paper <70>, manufactured by RICOH BUSINESS EXPERT CO., LTD.) using the image forming apparatus and fixing was conducted while changing the temperature of the fixing belt. A picture of the surface of the obtained fixed image was drawn by a drawing tester (AD-401, manufactured by UESHIMA SEISAKUSHO CO., LTD.) with a ruby needle having a tip diameter of from 260 μmR to 320 μmR with a tip angle of 60 degrees under a load of 50 g and the drawn surface was rubbed by a fiber (HONECOTTO #440, manufactured by SAKATA INX ENG. CO., LTD.) five times. The temperature of the fixing belt at which almost no image scraping occurs is determined as the lowest fixing temperature.

In addition, the solid image was formed at a position 3.0 cm from the leading end of the transfer sheet relative to the transfer direction.

The speed of the transfer sheet passing through the nipping portion of the fixing device is 280 mm/s.

The lower the lowest fixing temperature is, the better the low temperature fixing property is.

The results are shown in Table 1-4.

Hot Offset Resistance (Upper Limit of Fixing Temperature)

A solid image (image size: 3 cm×8 cm) having a toner attachment amount of from 0.75 mg/cm$^2$ to 0.95 mg/cm$^2$ after image transfer was formed on a transfer sheet TYPE 6200, manufactured by RICOH CO., LTD.) using the image forming apparatus and fixing was conducted while changing the temperature of the fixing belt. Whether hot offset occurred was observed by naked and the highest temperature above which hot offset occurs is determined as the upper limit of fixing temperature.

In addition, the solid image was formed on the transfer sheet at a position 3.0 cm from the leading end of the transfer sheet relative to the transfer direction.

The speed of the transfer sheet passing through the nipping portion of the fixing device was 280 mm/s.

The wider the fixable temperature range is, the better the hot offset resistance is. The average temperature range of conventional full color toner is about 50° C.

The results are shown in Table 1-4.

High Temperature Stability

Glass container was filled with the toner and left in a constant bath at 50° C. for 24 hours. Subsequent to cooling-down to 24° C., the needle penetration level of the toner was measured by a needle penetration test (according to JIS K2235-1991) to evaluate the high temperature stability by the following criteria:

The penetration degree is indicated by the piercing depth (mm):

A large needle penetration value indicates excellent high temperature stability. Toner having a needle penetration level less than 5 mm is likely to cause a problem.

The results are shown in Table 1-4.

Evaluation Criteria

E (Excellent): 25 mm or more
G (Good): 20 mm to less than 25 mm
F (Fair): 15 mm to less than 20 mm
G (Good): 10 mm to less than 15 mm
VB (Very Bad): Less than 10 mm Damage to Image During Transfer in Paper Path A solid image having a toner attachment amount of from 0.75 mg/cm$^2$ to 0.95 mg/cm$^2$ after image transfer was formed on a transfer sheet (Type 6200, manufactured by RICOH CO., LTD.) using the image forming apparatus and fixing was conducted at a temperature 10° C. higher than the lower limit of the fixing temperature of the toner. The degree of the damage to the image caused by the discharging roller (the discharging roller 56 in FIG. 4) during transfer in the paper path was evaluated according to the following criteria:

The speed of the transfer sheet passing through the nipping portion of the fixing device was 280 mm/s, which was conducted for A4 size in the landscape direction.

The results are shown in Table 1-3.

G (Good): No damage
F (Fair): Slightly damaged but causing no practical problem
B (Bad): Significantly damaged causing a practical problem Example 1-2

Manufacturing of Toner 2

[Toner 2] and [Development agent 2] were manufactured in the same manner as in the Preparation of Oil Phase of Example 1-1 except that the recipe was changed to 40 parts of [Wax liquid dispersion], 580 parts of [Resin 1-B-2], 100 parts of [Resin 1-A-1], 160 parts of [Resin 1-C-1], 120 parts of [Master batch 1], and 1,300 parts of ethyl acetate and the performance of [Toner 2] and [Development agent 2] was evaluated.

Example 1-3

Manufacturing of Toner 3

[Toner 3] and [Development agent 3] were manufactured in the same manner as in the Preparation of Oil Phase of Example 1-1 except that the recipe was changed to 40 parts of wax liquid dispersion, 620 parts of [Resin 1-B-3], 50 parts of [Resin 1-A-1], 170 parts of [Resin 1-C-1], 120 parts of [Master batch 1], and 1,300 parts of ethyl acetate and the performance of [Toner 3] and [Development agent 3] was evaluated.

Example 1-4

Manufacturing of Toner 4

[Toner 4] and [Development agent 4] were manufactured in the same manner as in the Preparation of Oil Phase of Example 1-1 except that the recipe was changed to 40 parts of [Wax liquid dispersion], 640 parts of [Resin 1-B-4], 25 parts of [Resin 1-A-1], 175 parts of [Resin 1-C-1], 120 parts of [Master batch 1], and 1,300 parts of ethyl acetate and the performance of [Toner 4] and [Development agent 4] was evaluated.

Example 1-5

Manufacturing of Toner 5

[Toner 5] and [Development agent 5] were manufactured in the same manner as in the Preparation of Oil Phase of Example 1-1 except that the recipe was changed to 40 parts of [Wax liquid dispersion], 380 parts of [Resin 1-B-5], 350 parts of [Resin 1-A-1], 110 parts of [Resin 1-C-1], 120 parts of [Master batch 1], and 1,300 parts of ethyl acetate and the performance of [Toner 5] and [Development agent 5] was evaluated.

Example 1-6

Manufacturing of Toner 6

[Toner 6] and [Development agent 6] were manufactured in the same manner as in the Preparation of Oil Phase of Example 1-1 except that the recipe was changed to 40 parts of wax liquid dispersion, 260 parts of [Resin 1-B-6], 500 parts of [Resin 1-A-1], 80 parts of [Resin 1-C-1], 120 parts of [Master batch 1], and 1,300 parts of ethyl acetate and the performance of [Toner 6] and [Development agent 6] was evaluated.

Example 1-7

Manufacturing of Toner 7

[Toner 7] and [Development agent 7] were manufactured in the same manner as in the Preparation of Oil Phase of Example 1-1 except that the recipe was changed to 40 parts of [Wax liquid dispersion], 316 parts of [Resin 1-B-2], 430 parts of [Resin 1-A-1], 94 parts of [Resin 1-C-1], 120 parts of

[Master batch 1], and 1,300 parts of ethyl acetate and the performance of [Toner 7] and [Development agent 7] was evaluated.

Example 1-8

Manufacturing of Toner 8

[Toner 8] and [Development agent 8] were manufactured in the same manner as in the Preparation of Oil Phase of Example 1-1 except that the recipe was changed to 40 parts of [Wax liquid dispersion], 500 parts of [Resin 1-B-2], 100 parts of [Resin 1-A-1], 140 parts of [Resin 1-C-1], 100 parts of [Resin 1-D-1], 120 parts of [Master batch 1], and 1,300 parts of ethyl acetate and the performance of [Toner 8] and [Development agent 8] was evaluated.

Example 1-9

Manufacturing of Toner 9

[Toner 9] and [Development agent 9] were manufactured in the same manner as in the Preparation of Oil Phase of Example 1-1 except that the recipe was changed to 40 parts of [Wax liquid dispersion], 420 parts of [Resin 1-B-2], 100 parts of [Resin 1-A-1], 200 parts of [Resin 1-D-1], 120 parts of [Master batch 1], and 1,300 parts of ethyl acetate and the performance of [Toner 9] and [Development agent 9] was evaluated.

Example 1-10

Manufacturing of Toner 10

[Toner 10] and [Development agent 10] were manufactured in the same manner as in the Preparation of Oil Phase of Example 1-1 except that the recipe was changed to 40 parts of [Wax liquid dispersion], 500 parts of [Resin 1-B-3], 200 parts of [Resin 1-A-1], 140 parts of [Resin 1-C-2], 120 parts of [Master batch 1], and 1,300 parts of ethyl acetate and the performance of [Toner 10] and [Development agent 10] was evaluated.

Example 1-11

Manufacturing of Toner 11

[Toner 11] and [Development agent 11] were manufactured in the same manner as in the Preparation of Oil Phase of Example 1-1 except that the recipe was changed to 40 parts of [Wax liquid dispersion], 500 parts of [Resin 1-B-2], 100 parts of [Resin 1-A-4], 140 parts of [Resin 1-C-2], 120 parts of [Master batch 1], and 1,300 parts of ethyl acetate and the performance of [Toner 10] and [Development agent 10] was evaluated.

Example 1-12

Manufacturing of Toner 12

[Toner 12] and [Development agent 12] were manufactured in the same manner as in the Preparation of Oil Phase of Example 1-1 except that the recipe was changed to 40 parts of [Wax liquid dispersion], 500 parts of [Resin 1-B-3], 100 parts of [Resin 1-A-5], 140 parts of [Resin 1-C-2], 120 parts of [Master batch 1], and 1,300 parts of ethyl acetate and the performance of [Toner 12] and [Development agent 12] was evaluated.

Example 1-13

Manufacturing of Toner 13

[Toner 13] and [Development agent 13] were manufactured in the same manner as in the Preparation of Oil Phase of Example 1-1 except that the recipe was changed to 40 parts of [Wax liquid dispersion], 500 parts of [Resin 1-B-2], 200 parts of [Resin 1-A-1], 140 parts of [Resin 1-C-2], 120 parts of [Master batch 1], and 1,300 parts of ethyl acetate and the performance of [Toner 13] and [Development agent 13] was evaluated.

Example 1-14

Manufacturing of Toner 14

[Toner 14] and [Development agent 14] were manufactured in the same manner as in the Preparation of Oil Phase of Example 1-1 except that the recipe was changed to 40 parts of [Wax liquid dispersion], 500 parts of [Resin 1-B-7], 200 parts of [Resin 1-A-1], 140 parts of [Resin 1-C-3], 120 parts of [Master batch 1], and 1,300 parts of ethyl acetate and the performance of [Toner 14] and [Development agent 14] was evaluated.

Example 1-15

Manufacturing of Toner 15

[Toner 15] and [Development agent 15] were manufactured in the same manner as in the Preparation of Oil Phase of Example 1-1 except that the recipe was changed to 40 parts of [Wax liquid dispersion], 500 parts of [Resin 1-B-8], 200 parts of [Resin 1-A-3], 140 parts of [Resin 1-C-4], 120 parts of [Master batch 1], and 1,300 parts of ethyl acetate and the performance of [Toner 15] and [Development agent 15] was evaluated.

Example 1-16

Manufacturing of Toner 16

[Toner 16] and [Development agent 16] were manufactured in the same manner as in the Preparation of Oil Phase of Example 1-1 except that the recipe was changed to 40 parts of wax liquid dispersion, 500 parts of [Resin 1-B-9], 200 parts of [Resin 1-A-4], 140 parts of [Resin 1-C-5], 120 parts of [Master batch 1], and 1,300 parts of ethyl acetate and the performance of [Toner 16] and [Development agent 16] was evaluated.

Example 1-17

Manufacturing of Toner 17

[Toner 17] and [Development agent 17] were manufactured in the same manner as in the Preparation of Oil Phase of Example 1-1 except that the recipe was changed to 40 parts of [Wax liquid dispersion], 500 parts of [Resin 1-B-10], 200 parts of [Resin 1-A-5], 140 parts of [Resin 1-C-6], 120 parts of [Master batch 1], and 1,300 parts of ethyl acetate and the performance of [Toner 17] and [Development agent 17] was evaluated.

Example 1-18

Manufacturing of Toner 18

[Toner 18] and [Development agent 18] were manufactured in the same manner as in the Preparation of Oil Phase of Example 1-1 except that the recipe was changed to 40 parts of [Wax liquid dispersion], 640 parts of [Resin 1-B-2], 200 parts of [Resin 1-A-1], 120 parts of [Master batch 1], and 1,300 parts of ethyl acetate and the performance of [Toner 18] and [Development agent 18] was evaluated.

Example 1-19

Manufacturing of Toner 19

[Toner 19] and [Development agent 19] were manufactured in the same manner as in the Preparation of Oil Phase of Example 1-1 except that the recipe was changed to 40 parts of [Wax liquid dispersion], 340 parts of [Resin 1-B-2], 100 parts of [Resin 1-A-1], 100 parts of [Resin 1-C-1], 300 parts of [Resin 1-D-1], 120 parts of [Master batch 1], and 1,300 parts of ethyl acetate and the performance of [Toner 19] and [Development agent 19] was evaluated.

Example 1-20

Manufacturing of Toner 20

[Toner 20] and [Development agent 20] were manufactured in the same manner as in the Preparation of Oil Phase of Example 1-1 except that the recipe was changed to 40 parts of [Wax liquid dispersion], 300 parts of [Resin 1-B-2], 100 parts of [Resin 1-A-1], 90 parts of [Resin 1-C-1], 350 parts of [Resin 1-D-1], 120 parts of [Master batch 1], and 1,300 parts of ethyl acetate and the performance of [Toner 20] and [Development agent 20] was evaluated.

Example 1-21

Manufacturing of Toner 21

[Toner 21] and [Development agent 21] were manufactured in the same manner as in the Preparation of Oil Phase of Example 1-1 except that the recipe was changed to 40 parts of [Wax liquid dispersion], 260 parts of [Resin 1-B-2], 100 parts of [Resin 1-A-1], 80 parts of [Resin 1-C-1], 400 parts of [Resin 1-D-1], 120 parts of [Master batch 1], and 1,300 parts of ethyl acetate and the performance of [Toner 21] and [Development agent 21] was evaluated.

Comparative Example 1-1

Manufacturing of Toner 22

[Toner 22] and [Development agent 22] were manufactured in the same manner as in the Preparation of Oil Phase of Example 1-1 except that the recipe was changed to 40 parts of [Wax liquid dispersion], 660 parts of [Resin 1-B-1], 0 parts of [Resin 1-A-1], 180 parts of [Resin 1-C-1], 120 parts of [Master batch 1], and 1,300 parts of ethyl acetate and the performance of [Toner 22] and [Development agent 22] was evaluated.

Comparative Example 1-2

Manufacturing of Toner 23

[Toner 23] and [Development agent 23] were manufactured in the same manner as in the Preparation of Oil Phase of Example 1-1 except that the recipe was changed to 40 parts of [Wax liquid dispersion], 652 parts of [Resin 1-B-1], 10 parts of [Resin 1-A-1], 178 parts of [Resin 1-C-1], 120 parts of [Master batch 1], and 1,300 parts of ethyl acetate and the performance of [Toner 23] and [Development agent 23] was evaluated.

Comparative Example 1-3

Manufacturing of Toner 24

[Toner 24] and [Development agent 24] were manufactured in the same manner as in the Preparation of Oil Phase of Example 1-1 except that the recipe was changed to 40 parts of [Wax liquid dispersion], 644 parts of [Resin 1-B-1], 20 parts of [Resin 1-A-1], 176 parts of [Resin 1-C-1], 120 parts of [Master batch 1], and 1,300 parts of ethyl acetate and the performance of [Toner 24] and [Development agent 24] was evaluated.

Comparative Example 1-4

Manufacturing of Toner 25

[Toner 25] and [Development agent 25] were manufactured in the same manner as in the Preparation of Oil Phase of Example 1-1 except that the recipe was changed to 40 parts of [Wax liquid dispersion], 0 parts of [Resin 1-B-1], 840 parts of [Resin 1-A-1], 0 parts of [Resin 1-C-1], 120 parts of [Master batch 2], and 1,300 parts of ethyl acetate and the performance of [Toner 23] and [Development agent 23] was evaluated.

Comparative Example 1-5

Manufacturing of Toner 26

[Toner 26] and [Development agent 26] were manufactured in the same manner as in the Preparation of Oil Phase of Example 1-1 except that the recipe was changed to 40 parts of [Wax liquid dispersion], 0 parts of [Resin 1-B-1], 0 parts of [Resin 1-A-1], 0 parts of [Resin 1-C-1], 840 parts of [Resin 1-D-1], 120 parts of [Master batch 1], and 1,300 parts of ethyl acetate and the performance of [Toner 26] and [Development agent 26] was evaluated.

Comparative Example 1-6

Manufacturing of Toner 27

[Toner 27] and [Development agent 27] were manufactured in the same manner as in the Preparation of Oil Phase of Example 1-1 except that the recipe was changed to 40 parts of [Wax liquid dispersion], 180 parts of [Resin 1-B-2], 100 parts of [Resin 1-A-1], 60 parts of [Resin 1-C-1], 500 parts of [Resin 1-D-1], 120 parts of [Master batch 1], and 1,300 parts of ethyl acetate and the performance of [Toner 21] and [Development agent 21] was evaluated.

TABLE 1-1

| | Diol component | Acid component | OH/COOH | Weight average molecular weight | Melting point (° C.) |
|---|---|---|---|---|---|
| Resin 1-A-1 | Hexane diol | Sebacic acid | 1.2 | 13.,000 | 66 |
| Resin 1-A-2 | 1,3-propane diol | Sebacic acid | 1.2 | 12.,000 | 54 |
| Resin 1-A-3 | Hexane diol | Adipic acid | 1.2 | 12.,000 | 56 |

TABLE 1-1-continued

| | Diol component | Acid component | OH/COOH | Weight average molecular weight | Melting point (° C.) |
|---|---|---|---|---|---|
| Resin 1-A-4 | Butane diol | Sebacic acid | 1.2 | 13.,000 | 63 |
| Resin 1-A-5 | Ethylene glycol | Sebacic acid | 1.2 | 13.,000 | 72 |

TABLE 1-2

| | Base polyester | Manufacturing method | Additional component | Weight average molecular weight | Melting point (° C.) |
|---|---|---|---|---|---|
| Resin 1-B-1 | Resin 1-A-1 | One-shot method | — | 26,000 | 60 |
| Resin 1-B-2 | Resin 1-A-1 | One-shot method | Adduct of bisphenol A with 2 mols of propylene oxide | 28,000 | 57 |
| Resin 1-B-3 | Resin 1-A-1 | Prepolymer method | Adduct of bisphenol A with 2 mols of propylene oxide | 28,000 | 58 |
| Resin 1-B-4 | Resin 1-A-1 | Prepolymer method | Hexamethylene diamine | 27,000 | 58 |
| Resin 1-B-5 | Resin 1-A-1 | Prepolymer method | Ethylene diamine | 27,000 | 59 |
| Resin 1-B-6 | Resin 1-A-1 | One-shot method | Water | 26,000 | 60 |
| Resin 1-B-7 | Resin 1-A-2 | Prepolymer method | Adduct of bisphenol A with 2 mols of propylene oxide/ Hexamethylene diamine | 29,000 | 46 |
| Resin 1-B-8 | Resin 1-A-3 | Prepolymer method | Adduct of bisphenol A with 2 mols of propylene oxide/ Hexamethylene diamine | 29,000 | 49 |
| Resin 1-B-9 | Resin 1-A-4 | Prepolymer method | Adduct of bisphenol A with 2 mols of propylene oxide/ Hexamethylene diamine | 29,000 | 56 |
| Resin 1-B-10 | Resin 1-A-5 | Prepolymer method | Adduct of bisphenol A with 2 mols of propylene oxide/ Hexamethylene diamine | 29,000 | 65 |

TABLE 1-3

| | Base polyester | Additional component | Weight average molecular weight | Melting point (° C.) |
|---|---|---|---|---|
| Resin 1-C-1 | Resin 1-A-1 | Hexamethylene diamine | 30,000 | 59 |
| Resin 1-C-2 | Resin 1-A-1 | — | 28,000 | 58 |
| Resin 1-C-3 | Resin 1-A-2 | Hexamethylene diamine | 30,000 | 45 |
| Resin 1-C-4 | Resin 1-A-3 | Hexamethylene diamine | 31,000 | 47 |
| Resin 1-C-5 | Resin 1-A-4 | Hexamethylene diamine | 30,000 | 55 |
| Resin 1-C-6 | Resin 1-A-5 | Hexamethylene diamine | 31,000 | 64 |

TABLE 1-4

| | Diol component | Acid component | OH/COOH | Weight average molecular weight | Glass transition temperature (Tg) (° C.) |
|---|---|---|---|---|---|
| Resin 1-D-1 | Adduct of bisphenol A with 2 mols of ethylene oxide/ Adduct of bisphenol A with 2 mols of propylene oxide/ | Isophthalic acid/ Adipic acid | 1.3 | 4.,000 | 50 |

TABLE 1-5

| Example | 1 | 2 | 3 | 4 | 5 | 6 | 7 | 8 | 9 | 10 |
|---|---|---|---|---|---|---|---|---|---|---|
| Toner | 1 | 2 | 3 | 4 | 5 | 6 | 7 | 8 | 9 | 10 |
| Crystalline polyester having urethane and/or urea bonding | 1-B-1 | 1-B-2 | 1-B-3 | 1-B-4 | 1-B-5 | 1-B-6 | 1-B-2 | 1-B-2 | 1-B-2 | 1-B-3 |
| Non-modified crystalline polyester | 1-A-1 | 1-A-1 | 1-A-1 | 1-A-1 | 1-A-1 | 1-A-1 | 1-A-1 | 1-A-1 | 1-A-1 | 1-A-1 |
| Crystalline polyester having an isocyanate group at end | 1-C-1 | 1-C-1 | 1-C-1 | 1-C-1 | 1-C-1 | 1-C-1 | 1-C-1 | 1-C-1 | 1-C-1 | 1-C-2 |
| Weight % of non-modified crystalline polyester in crystalline polyester | 22 | 11 | 6 | 3 | 39 | 56 | 48 | 13 | 14 | 22 |
| Weight % of crystalline polyester in toner | 84 | 84 | 84 | 84 | 84 | 84 | 84 | 75 | 65 | 84 |
| T1 (° C.) | 61 | 59 | 60 | 59 | 62 | 63 | 63 | 61 | 62 | 60 |
| T2 (° C.) | 38 | 33 | 33 | 30 | 42 | 46 | 45 | 37 | 39 | 37 |
| T1 − T2 (° C.) | 23 | 26 | 27 | 29 | 20 | 17 | 18 | 24 | 23 | 23 |
| Ratio {C/(C + A}} | 0.23 | 0.21 | 0.20 | 0.19 | 0.28 | 0.34 | 0.31 | 0.19 | 0.16 | 0.22 |
| Lower limit of fixing temperature (° C.) | 95 | 100 | 100 | 105 | 90 | 90 | 90 | 105 | 110 | 95 |
| Upper limit of fixing temperature (° C.) | 185 | 190 | 195 | 200 | 175 | 140 | 150 | 190 | 190 | 185 |
| High temperature stability | E | G | E | G | G | G | G | G | G | G |
| Damage to image during transfer path | G | F | F | F | G | G | G | G | G | G |

| Example | 11 | 12 | 13 | 14 | 15 | 16 | 17 | 18 | 19 | 20 | 21 |
|---|---|---|---|---|---|---|---|---|---|---|---|
| Toner | 11 | 12 | 13 | 14 | 15 | 16 | 17 | 18 | 19 | 20 | 21 |
| Crystalline polyester having urethane and/or urea bonding | 1-B-2 | 1-B-3 | 1-B-2 | 1-B-7 | 1-B-8 | 1-B-9 | 1-B-10 | 1-B-2 | 1-B-2 | 1-B-2 | 1-B-2 |
| Non-modified crystalline polyester | 1-A-4 | 1-A-5 | 1-A-1 | 1-A-2 | 1-A-3 | 1-A-4 | 1-A-5 | 1-A-1 | 1-A-1 | 1-A-1 | 1-A-1 |
| Crystalline polyester having an isocyanate group at end | 1-C-2 | 1-C-2 | 1-C-2 | 1-C-3 | 1-C-4 | 1-C-5 | 1-C-6 | — | 1-C-1 | 1-C-1 | 1-C-1 |
| Weight % of non-modified crystalline polyester in crystalline polyester | 22 | 22 | 22 | 22 | 22 | 22 | 22 | 22 | 17 | 18 | 20 |
| Weight % of crystalline polyester in toner | 84 | 84 | 84 | 84 | 84 | 84 | 84 | 84 | 56 | 51 | 47 |
| T1 (° C.) | 62 | 65 | 60 | 47 | 49 | 54 | 66 | 62 | 62 | 62 | 62 |
| T2 (° C.) | 42 | 46 | 38 | 26 | 29 | 32 | 46 | 42 | 37 | 38 | 37 |
| T1 − T2 (° C.) | 20 | 19 | 22 | 21 | 20 | 22 | 20 | 20 | 25 | 24 | 24 |
| Ratio {C/(C + A}} | 0.23 | 0.25 | 0.23 | 0.21 | 0.21 | 0.22 | 0.25 | 0.23 | 0.14 | 0.14 | 0.12 |
| Lower limit of fixing temp. (° C.) | 95 | 100 | 95 | 85 | 90 | 95 | 100 | 90 | 115 | 120 | 125 |
| Upper limit of fixing temp. (° C.) | 185 | 190 | 185 | 180 | 180 | 185 | 190 | 170 | 190 | 185 | 185 |
| High temp. stability | E | E | E | F | G | G | E | G | G | G | G |
| Damage to image during transfer path | G | G | G | G | G | G | G | G | G | G | G |

TABLE 1-6

| Comparative Example | 1 | 2 | 3 | 4 | 5 | 6 |
|---|---|---|---|---|---|---|
| Toner | 22 | 23 | 24 | 25 | 26 | 27 |
| Crystalline polyester having urethane and/or urea bonding | 1-B-1 | 1-B-1 | 1-B-1 | — | — | 1-B-2 |
| Non-modified crystalline polyester | — | 1-A-1 | 1-A-1 | 1-A-1 | — | 1-A-1 |
| Crystalline polyester having an isocyanate group at end | 1-C-1 | 1-C-1 | 1-C-1 | — | — | 1-C-1 |
| Weight % of non-modified crystalline polyester in crystalline polyester | 0 | 1 | 2 | 100 | 0 | 25 |
| Weight % of crystalline polyester in toner | 84 | 84 | 84 | 84 | 0 | 37 |
| T1 (° C.) | 58 | 58 | 59 | 66 | — | 62 |
| T2 (° C.) | 20 | 22 | 27 | 52 | — | 39 |
| T1 − T2 (° C.) | 38 | 36 | 32 | 14 | — | 23 |
| Ratio {C/(C + A}} | 0.19 | 0.20 | 0.20 | 0.40 | 0.0 | 0.09 |
| Lower limit of fixing temp. (° C.) | 110 | 110 | 105 | — | 170 | 180 |
| Upper limit of fixing temp. (° C.) | 205 | 200 | 200 | — | 170 | 180 |

TABLE 1-6-continued

| Comparative Example | 1 | 2 | 3 | 4 | 5 | 6 |
|---|---|---|---|---|---|---|
| High temp. stability | G | G | G | F | G | G |
| Damage to image during transfer path | B | B | B | B | G | G |

Synthesis of Crystalline Resin 2-A-1

241 parts of sebacic acid, 31 parts of adipic acid, 164 parts of 1,4-butane diol, and 0.75 parts of titanium dihydroroxybis (triethanol aminate) as a condensing catalyst were placed in a reaction container equipped with a condenser, a stirrer, and a nitrogen introducing tube to conduct reaction at 180° C. for 8 hours in a nitrogen atmosphere while distilling away produced water.

Next, reaction was conducted for four hours while gradually heating the system to 225° C. and distilling away produced water and 1,4-butane diol in a nitrogen atmosphere and the reaction was furthermore conducted with a reduced pressure of from 5 mmHg to 20 mmHg until the weight average molecular weight Mw of the resultant reached about 6,000 to obtain [Crystalline resin A'1].

218 parts of the thus-obtained [Crystalline resin A'1} was transferred to a reaction container equipped with a condenser, a stirrer, and a nitrogen introducing tube and 250 parts of ethyl acetate and 8.6 parts of hexamethylene diisocyanate (HDI) were added thereto to conduct reaction at 80° C. in a nitrogen atmosphere for five hours.

Thereafter, ethyl acetate was distilled away with a reduced pressure to obtain [Crystalline Resin 2-A-1] having an Mw of about 22,000 and a melting point of 62° C.

Synthesis of Crystalline Resin 2-A-2

212 parts of sebacic acid, 88 parts of 1,3-propane diol, and 0.75 parts of titanium dihydroroxybis (triethanol aminate) as a condensing catalyst in a reaction container equipped with a condenser, a stirrer, and a nitrogen introducing tube to conduct reaction for 8 hours at 180° C. in a nitrogen atmosphere while distilling away produced water.

Next, reaction was conducted for 4 hours while gradually heating the system to 225° C. while distilling away produced water and 1,3-propane diol in a nitrogen atmosphere and the reaction was further conducted with a reduced pressure of from 5 mmHg to 20 mmHg until the weight average molecular weight Mw of the resultant reaches about 8,000 to obtain [Crystalline Resin A'2].

218 parts of the thus-obtained [Crystalline resin A'2] was transferred to a reaction container equipped with a condenser, a stirrer, and a nitrogen introducing tube and 250 parts of ethyl acetate and 8.6 parts of hexamethylene diisocyanate (HDI) were added thereto to conduct reaction at 80° C. in a nitrogen atmosphere for 5 hours.

Then, ethyl acetate was distilled away with a reduced pressure to obtain [Crystalline Resin 2-A-2] having an Mw of about 24,000 and a melting point of 56° C.

Synthesis of Crystalline Resin 2-A-3

241 parts of sebacic acid, 160 parts of 1,4-butane diol, and 0.75 parts of titanium dihydroroxybis (triethanol aminate) as a condensing catalyst were placed in a reaction container equipped with a condenser, a stirrer, and a nitrogen introducing tube to conduct reaction for 8 hours at 180° C. in a nitrogen atmosphere while distilling away produced water.

Next, the system was gradually heated to 225° C. to conduct reaction for 4 hours while distilling away produced water and 1,4-butane diol in a nitrogen atmosphere and the reaction was further conducted with a reduced pressure of from 5 mmHg to 20 mmHg for 5 hours to obtain [Crystalline Resin 2-A-3] having an Mw of about 14,000 and a melting point of 68° C.

Synthesis of Crystalline Resin 2-A-4

218 parts by weight of the thus-obtained crystalline resin A'2 in the same manner as in Example 2-2 was transferred to a reaction container equipped with a condenser, a stirrer, and a nitrogen introducing tube and 250 parts of ethyl acetate and 12.6 parts of hexamethylene diisocyanate (HDI) were added thereto to conduct reaction at 80° C. in a nitrogen atmosphere for 5 hours.

Then, ethyl acetate was distilled away with a reduced pressure with a reduced pressure to obtain [Crystalline Resin 2-A-4] having an Mw of about 74,000 and a melting point of 57° C.

Synthesis of Non-crystalline Resin

The following recipe was placed in a container equipped with a condenser, a stirrer, and a nitrogen introducing tube to conduct a reaction at 230° C. for 4 hours under normal pressure followed by another reaction for 5 hours with a reduced pressure of 10 mmHg to 15 mmHg to obtain [Non-crystalline polyester resin 1]:

Adduct of bisphenol A with 2 mole of ethylene oxide: 75.7 parts
Dibutyl tin oxide: 0.2 parts
Adipic acid: 3.8 parts
Isophthalic acid: 21.0 parts Synthesis of Resin Particulate The following recipe was placed in a container equipped with a stirrer and a thermometer and stirred at 400 rpm for 15 minutes to obtain a white emulsion:

Water: 683 parts
Sodium salt of sulfate of an adduct of methacrylic acid with ethyleneoxide (EREMINOR RS-30, manufactured by Sanyo Chemical Industries, Ltd.): 16 parts
Styrene: 83 parts
Methacrylic acid: 83 parts
Butyl acrylate: 110 parts
Ammonium persulfate: 1 part The system was heated to 75° C. to conduct reaction for five hours. Furthermore, 30 parts of 1% ammonium persulfate aqueous solution wasa added followed by aging at 75° C. for five hours to obtain an aqueous liquid dispersion of [Liquid dispersion of resin particulate] of a vinyl resin (copolymer of styrene-methacrylic acid-acrylic acid-butyl acrylate-sodium salt of sulfate of an adduct of methacrylic acid with ethyleneoxide).

[Resin particulate liquid dispersion] had a volume average particle diameter (measured by LA-920, manufactured by Horiba Corporation) of 38 nm, a weight average molecular weight of 420,000, and a glass transition temperature (Tg) of 63° C.

Example 2-1

Preparation of Master Batch 30 parts of water, 100 parts of carbon black (Printex 35, DBP oil absorption amount=42 ml/100 g, pH=9.5, manufactured by Degussa AG.), and 100 parts of [Non-crystalline polyester resin 1] were mixed by a HENSCHEL MIXER (manufactured by NIPPON COKE & ENGINEERING CO., LTD.).

Subsequent to kneading the mixture by two rolls at 150° C. for 30 minutes, the resultant was rolled and cooled down by a pulverizer (manufactured by Hosokawa Micron Corporation) to prepare [Master batch].

Manufacturing of Liquid Dispersion of Wax 20 parts of paraffin wax (HNP-9, melting point: 75° C., manufactured by NIPPON SEIRO CO., LTD.) and 80 parts of ethyl acetate were placed in a reaction container equipped with a condenser, a thermometer, and a stirrer. The system was heated to 78° C. to dissolve the wax sufficiently followed by cooling down to 30° C. in one hour while stirring.

Thereafter, the resultant was wet-pulverized under the conditions of: liquid transfer speed 1.0 kg/h; disk circumferential speed: 10 m/s; filling amount of 0.5 mm zirconia beads: 80% by volume; number of passes: 6 to obtain [Liquid dispersion of wax].

Preparation of Oil Phase 100 parts of [Crystalline Resin 2-A-1] and 100 parts of ethyl acetate were placed in a container equipped with a thermometer and a stirrer and dissolved by heating to the melting point of the resin or higher. 20 parts of [Liquid dispersion of wax], 14 parts of [Master batch], 1.1 parts of [Nucleating agent] (ADK STAB NA-11: melting point: 400° C., metal salt of phosphoric acid ester compound, manufactured by ADEKA Co., Ltd.) were added thereto followed by stirring by a TK type HOMOMIXER (manufactured by PRIMIX Corporation) at a rotation number of 10,000 rpm at 50° C. for uniform dissolution and dispersion to obtain [Oil phase].

Preparation of Aqueous Medium Phase 660 parts of water, 25 parts of [Resin particulate liquid dispersion], 25 parts of 48.5% by weight aqueous solution of sodium dodecyldiphenyl etherdisulfonate (EREMINOR MON-7, manufactured by Sanyo Chemical Industries, Ltd.), and 60 parts of ethyl acetate were mixed and stirred to obtain [Aqueous medium] of milky white.

Preparation of Emulsified Slurry 150 parts of [Aqueous medium] was placed in a container and stirred at 12,000 rpm by a TK type HOMOMIXER (manufactured by PRIMIX Corporation). 100 parts of [Oil phase] was added thereto followed by mixing for 10 minutes to prepare an emulsion or liquid dispersion, which was defined as [Emulsified slurry].

Removal of Organic Solvent 100 parts of [Emulsified slurry] was placed in a flask equipped with a degassing pipe, a stirrer, and a thermometer and stirred at a stirring speed of 20 m/min to remove the solvent at 30° C. under a reduced pressure for 12 hours. Thus, [Solvent-removed slurry] was obtained.

Washing

After all of [Solvent-removed slurry] was filtered under a reduced pressure, 300 parts of deionized water was added to the filtered cake and mixed by a TK HOMOMIXER at 12,000 rotations per minute (rpm) for 10 minutes followed by filtration.

300 parts of deionized water was added to the thus-obtained filtered cake and the resultant was mixed by a TK HOMOMIXER at 12,000 rpm for 10 minutes followed by filtration, which was repeated three times. The resultant having a conductivity of the re-dispersed slurry ranging from 0.1 μS/cm to 10 μS/cm was defined as [Washed slurry].

Drying

The obtained filtered cake was dried by a circulation drier at 45° C. for 48 hours. The dried cake was sieved using a screen having an opening of 75 μm to obtain [Mother toner particle a].

External Addition Treatment 100 parts of [Mother toner particle a], 0.6 parts of hydrophobic silica having an average particle diameter of 100 nm, 1.0 part of titanium oxide having an average particle diameter of 20 nm, and 0.8 parts of fine powder of hydrophobic silica having an average particle diameter of 15 nm were mixed to obtain [Toner a].

Manufacturing of Carrier 100 parts of silicone resin (organo straight silicone), 5 parts of γ-(2-aminoethyl)aminopropyl trimethoxy silane, and 10 parts of carbon black were added to 100 parts of toluene followed by dispersion for 20 minutes by a HOMOMIXER to prepare a resin layer liquid application.

Using a fluid bed type coating device, the resin layer liquid application was applied to the surface of 1,000 parts of spherical magnetite having an average particle diameter of 50 μm to manufacture [Carrier].

Manufacturing of Development Agent 5 parts of [Toner a] and 95 parts of [Carrier] were mixed by a ball mill to manufacture a development agent.

Next, the thus-obtained development agent was evaluated as follows with regard to the following properties:

The results are shown in Table 2-3.

Low Temperature Fixability and Hot Offset Resistance

Paper (TYPE 6200 paper, manufactured by Ricoh Co., Ltd.) was set in a machine having a remodeled fixing device based on a photocopier (MF-2200, manufactured by Ricoh Co., Ltd.) having a TEFLON™ roller as the fixing roller in the fixing device and a photocopying test was conducted using the machine.

To be specific, the cold offset temperature (low temperature fixability, lower limit of fixing temperature) and the hot offset temperature (hot offset temperature, upper limit of fixing temperature) were obtained by changing the fixing temperature.

The evaluation conditions of the lower limit of fixing temperature were: Sheet feeding linear speed: 120 mm/sec to 150 mm/sec; plane pressure: 1.2 kgf/cm$^2$; and nipping width: 3 mm.

In addition, the evaluation conditions of the lower limit of fixing temperature were:

Sheet feeding linear speed: 50 min/sec; plane pressure: 2.0 kgf/cm$^2$; and nipping width: 4.5 mm.

The lower limit of fixing temperature and the upper limit of fixing temperature were evaluated as follows:

Evaluation Criteria

Evaluation Criteria of Upper Limit of Fixing Temperature

G (Good): the upper limit of the fixing temperature was 180° C. or higher

F (Fair): the upper limit of the fixing temperature was from 170° C. to lower than 180° C.

B (Bad): the lower limit of the fixing temperature was lower than 170° C.

Evaluation Criteria of Lower Limit of Fixing Temperature

G (Good): the lower limit of the fixing temperature was lower than 110° C.

F (Fair): the lower limit of the fixing temperature was from 110° C. to lower than 130° C.

B (Bad): the lower limit of the fixing temperature was 130° C. or higher

High Temperature Stability

A glass container was filled with the toner and left in a constant bath at 50° C. for 24 hours. Subsequent to cooling-down to 24° C., the needle penetration level of the toner by a needle penetration test (according to JIS K2235-1991) to evaluate the high temperature stability by the following criteria:

A large needle penetration value indicates excellent high temperature stability. Toner having a needle penetration level less than 5 mm was likely to cause a problem.

Evaluation Criteria

G (Good): More than 10 mm

F (Fair): 5 mm to less than 10 mm

B (Bad): Less than 5 mm

Sticking Property of Image

Paper (TYPE 6200 paper, manufactured by Ricoh Co., Ltd.) was set in a machine having a remodeled fixing device based on a photocopier (MF-2200, manufactured by Ricoh Co., Ltd.) having a TEFLON™ roller as the fixing roller in the fixing device and a photocopying test was conducted using the machine.

To be specific, the fixing temperature was set at 20° C. higher than the lower limit of the fixing temperature obtained in evaluation of the lower temperature fixability. The conditions were: Sheet feeding linear speed: 120 mm/sec to 150 mm/sec; plane pressure: 1.2 kgf/cm$^2$; and nipping width: 3 mm.

The fixed image was superimposed on white paper and both were sandwiched by metal plates to apply a pressure of 10 kPa. After leaving it at 50° C. for 24 hours, the image was detached from the white paper to evaluate the sticking property of image.

The evaluation criteria of the sticking property of image are as follows:

The sticking property ranked as B (Bad) causes a practical problem.

Evaluation Criteria

G (Good): No peeling-off of image observed with no noise when peeling off.

F (Fair): No peeling-off of image seen but a noise heard when peeling off.

B (Bad): the image and the white paper adhere to each other and a large part of the image was detached when peeling off.

Gloss

Paper (TYPE 6200 paper, manufactured by Ricoh Co., Ltd.) was set in a machine having a fixing device remodeled based on a photocopier (MF-2200, manufactured by Ricoh Co., Ltd.) having a TEFLON™ roller as the fixing roller in the fixing device and a photocopying test was conducted using the machine.

To be specific, the fixing temperature was set at 20° C. higher than the lower limit of the fixing temperature obtained in evaluation of the lower temperature fixability. The conditions were: Sheet feeding linear speed: 120 mm/sec to 150 mm/sec; plane pressure: 1.2 kgf/cm$^2$; and nipping width: 3 mm.

The image obtained after the photocopying test, 60 degree gloss was measured by a gloss meter (VG-7000, manufactured by meter Nippon Denshoku Industries Co., Ltd.).

Evaluation Criteria

G (Good): 30% or more

F (Fair): 20% to less than 30%

B (Bad): Less than 20%

Example 2-2

[Toner b] was manufactured in the same manner as in the preparation of the oil phase of Example 2-1 except that [Nucleating agent] was changed to ADK STAB NA-27 (melting point: 230° C., complex of a metal salt of phosphoric acid ester compound and an organic compound, manufactured by ADEKA Co., Ltd.).

The obtained toner was evaluated in the same manner as in Example 2-1.

The results are shown in Table 2-3.

Example 2-3

[Toner c] was manufactured in the same manner as in the preparation of the oil phase of the preparation of the oil phase of Example 2-1 except that [Nucleating agent] was changed to ADK STAB NA-5 (melting point: 350° C., nitrogen-containing compound, manufactured by ADEKA Co., Ltd.).

The obtained toner was evaluated in the same manner as in Example 2-1.

The results are shown in Table 2-3.

Example 4

[Toner d] was manufactured in the same manner as in the preparation of the oil phase of Example 2-1 except that the addition amount of the nucleating agent was changed to 0.05 parts.

The obtained toner was evaluated in the same manner as in Example 2-1.

The results are shown in Table 2-3.

Example 5

[Toner e] was manufactured in the same manner as in the preparation of the oil phase of Example 2-1 except that the addition amount of the nucleating agent was changed to 6.42 parts.

The obtained toner was evaluated in the same manner as in Example 2-1.

The results are shown in Table 2-3.

Example 6

[Toner f] was manufactured in the same manner as in the preparation of the oil phase of Example 2-1 except that the nucleating agent was changed to behenyl laurate (melting point: 52° C.).

The obtained toner was evaluated in the same manner as in Example 2-1.

The results are shown in Table 2-3.

Example 7

[Toner g] was manufactured in the same manner as in the preparation of the oil phase of Example 2-1 except that the addition amount of [Crystalline Resin 2-A-1] was changed to 85 parts and 15 parts of [Crystalline Resin 2-A-4] was added.

The obtained toner was evaluated in the same manner as in Example 2-1.

The results are shown in Table 2-3.

Comparative Example 2-1

[Toner h] was manufactured in the same manner as in the preparation of the oil phase of Example 2-1 except that [Crystalline Resin 2-A-1] was changed to [Crystalline Resin 2-A-3].

The obtained toner was evaluated in the same manner as in Example 2-1.

The results are shown in Table 2-3.

Comparative Example 2-2

[Toner i] was manufactured in the same manner as in the preparation of the oil phase of Example 2-1 except that no nucleating agent was added and [Crystalline Resin 2-A-1] was changed to [Crystalline Resin 2-A-2].

The obtained toner was evaluated in the same manner as in Example 2-1.

The results are shown in Table 2-3.

The blending ratio and the content of Examples and Comparative Examples are shown in Table 2-1.

TABLE 2-1

| | | Crystalline resin | | | Nucleating agent | | |
|---|---|---|---|---|---|---|---|
| | Toner | Kind | Melting point (° C.) | Content (in binder resin) (% by weight) | Kind | Content (in binder resin) (% by weight) | Melting point (° C.) |
| Example 2-1 | a | Crystalline resin 2-A-1 | 62 | 93.5 | Phosphoric acid ester metal salt compound | 1.0 | 400 |
| Example 2-2 | b | Crystalline resin 2-A-1 | 62 | 93.5 | Complex of phosphoric acid ester metal salt compound and organic compound | 1.0 | 230 |
| Example 2-3 | c | Crystalline resin 2-A-1 | 62 | 93.5 | Phosphoric acid ester metal salt compound | 1.0 | 350 |
| Example 2-4 | d | Crystalline resin 2-A-1 | 62 | 93.5 | Phosphoric acid ester metal salt compound | 0.05 | 400 |
| Example 2-5 | e | Crystalline resin 2-A-1 | 62 | 93.5 | Aliphatic acid ester | 6.0 | 400 |
| Example 2-6 | f | Crystalline resin 2-A-1 | 62 | 93.5 | Phosphoric acid ester metal salt compound | 1.0 | 52 |
| Example 2-7 | g | Crystalline resin 2-A-1 | 62 | 79.5 | Phosphoric acid ester metal salt compound | 1.0 | 400 |
| | | Crystalline resin 2-A-4 | 57 | 14.0 | | | |
| Comparative Example 2-1 | h | Crystalline resin 2-A-3 | 68 | 93.5 | Phosphoric acid ester metal salt compound | 1.0 | 400 |
| Comparative Example 2-2 | i | Crystalline resin 2-A-2 | 56 | 93.5 | — | | |

The properties of toners obtained in Examples and Comparative Examples are shown in Tables 2-2-1 and 2-2-2.

TABLE 2-2-1

| | Toner | T1 (° C.) | T2 (° C.) | T1 − T2 (° C.) | Crystalline structure amount {C/(C + A)} | Melting heat amount (J/g) |
|---|---|---|---|---|---|---|
| Example 2-1 | a | 58 | 40 | 18 | 0.25 | 51 |
| Example 2-2 | b | 59 | 39 | 20 | 0.25 | 55 |
| Example 2-3 | c | 59 | 41 | 18 | 0.25 | 55 |
| Example 2-4 | d | 58 | 30 | 28 | 0.25 | 43 |
| Example 2-5 | e | 58 | 42 | 16 | 0.25 | 54 |
| Example 2-6 | f | 57 | 32 | 25 | 0.25 | 35 |
| Example 2-7 | g | 58 | 40 | 18 | 0.25 | 45 |
| Comparative Example 2-1 | h | 64 | 50 | 14 | 0.3 | 60 |
| Comparative Example 2-2 | i | 52 | 20 | 32 | 0.23 | 40 |

TABLE 2-2-2

| | Toner | Weight average molecular weight (Mw) | Component having a molecular weight of 100,000 or more (%) | Component having a molecular weight of 250,000 or more (%) | Nitrogen element amount (% by weight) | Urethane bonding | Urea bonding |
|---|---|---|---|---|---|---|---|
| Example 2-1 | a | 21,000 | 0 | 0 | 0.24 | Yes | No |
| Example 2-2 | b | 21,000 | 0 | 0 | 0.24 | Yes | No |
| Example 2-3 | c | 21,000 | 0 | 0 | 0.24 | Yes | No |
| Example 2-4 | d | 21,000 | 0 | 0 | 0.24 | Yes | No |
| Example 2-5 | e | 21,000 | 0 | 0 | 0.24 | Yes | No |
| Example 2-6 | f | 21,000 | 0 | 0 | 0.24 | Yes | No |
| Example 2-7 | g | 65,000 | 7.2 | 1.2 | 0.22 | Yes | Yes |
| Comparative Example 2-1 | h | 13,000 | 0 | 0 | 0 | No | No |
| Comparative Example 2-2 | I | 23,000 | 0 | 0 | 0.26 | Yes | No |

TABLE 2-3

| | Toner | Fixing: Lower limit | Fixing: Upper limit | High temperature stability | Gloss | Image sticking to another image/medium |
|---|---|---|---|---|---|---|
| Example 2-1 | a | G | F | G | G | G |
| Example 2-2 | b | G | F | G | G | G |
| Example 2-3 | c | G | F | G | G | G |
| Example 2-4 | d | G | F | G | F | F |
| Example 2-5 | e | F | F | G | G | G |
| Example 2-6 | f | G | F | F | F | F |
| Example 2-7 | g | G | G | G | G | G |
| Comparative Example 2-1 | h | G | B | B | G | G |
| Comparative Example 2-2 | I | G | G | B | G | B |

Manufacturing Example 1

Synthesis of Crystalline Polyester Unit (a-1)

685.5 parts of sebacic acid, 434.6 parts of 1,6-hexane diol, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water.

Thereafter, reaction was conducted for 4 hours while gradually heating to 220° C. and distilling away water produced in a nitrogen atmosphere and continued with a reduced pressure of from 0.007 MPa to 0.026 MPa while distilling away water. When the acid value was 2 or less the resultant was taken out to obtain [Crystalline polyester unit (a-1)].

Manufacturing Example 2

Synthesis of Crystalline Polyester Unit (a-2)

763.1 parts of sebacic acid, 499 parts of 1,4-butane diol, 11.3 parts of trimethylol propane, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water.

Thereafter, reaction was conducted for 4 hours while gradually heating to 220° C. and distilling away water produced in a nitrogen atmosphere and continued with a reduced pressure of from 0.007 MPa to 0.026 MPa while distilling away water. When the Mw was 10.0, the resultant was taken out to obtain [Crystalline polyester unit (a-2)].

Manufacturing Example 3

Synthesis of Crystalline Polyester Unit (a-3)

685.5 parts of sebacic acid, 418.0 parts of 1,4-butane diol, 16.6 parts of trimethylol propane, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water.

Thereafter, reaction was conducted for 4 hours while gradually heating to 220° C. and distilling away water produced in a nitrogen atmosphere and continued with a reduced pressure of from 0.007 MPa to 0.026 MPa while distilling away water. When the acid value was 2 or less the resultant was taken out to obtain [Crystalline polyester unit (a-3)].

Manufacturing Example 4

Synthesis of Crystalline Polyester Unit (a-4)

641.6 parts of sebacic acid, 320.9 parts of 1,6-hexane diol, 12.5 parts of trimethylol propane, 137.8 parts of 1,4-butane diol, 12.5 parts of trimethylol propane, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water. Thereafter, reaction was conducted for 4 hours while gradually heating to 220° C. and distilling away water produced in a nitrogen atmosphere and continued with a reduced pressure of from 0.007 MPa to 0.026 MPa while distilling away water. When the Mw was 14,200, the resultant was taken out to obtain [Crystalline polyester unit (a-4)].

Manufacturing Example 5

Synthesis of Crystalline Polyester Unit (a-5)

881.0 parts of dodecane diacid, 458.3 parts of ethylene glycol, 16.5 parts of trimethylol propane, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water.

Thereafter, reaction was conducted for 4 hours while gradually heating to 220° C. and distilling away water and ethylene glycol produced in a nitrogen atmosphere and continued with a reduced pressure of from 0.007 MPa to 0.026 MPa while distilling away water and ethylene glycol. When the Mw was 12,000, the resultant was taken out to obtain [Crystalline polyester unit (a-5)].

Manufacturing Example 6

Synthesis of Crystalline Polyester Unit (a-6)

656.2 parts of sebacic acid, 323.4 parts of 1,6-hexane diol, 118.6 parts of 1,3-propane diol, 16.8 parts of trimethylol propane, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water.

Thereafter, reaction was conducted for 4 hours while gradually heating to 220° C. and distilling away water and 1,3-propane diol produced in a nitrogen atmosphere and continued with a reduced pressure of from 0.007 MPa to 0.026 MPa while distilling away water and 1,3-propane diol. When the Mw was 12,700, the resultant was taken out to obtain [Crystalline polyester unit (a-6)].

Manufacturing Example 7

Synthesis of Crystalline Polyester Unit (a'-1)

763.1 parts of sebacic acid, 509 parts of 1,4-butane diol, and 1 part of titanium dihydroroxybis (triethanol aminate) as a condensing catalyst were placed in a reaction container equipped with a stirrer, heating-cooling equipment, a condenser tube, a thermometer, and a nitrogen introducing tube followed by heating to 180° C. to conduct reaction for 10 hours at the temperature in a nitrogen atmosphere while distilling away produced water.

Thereafter, reaction was conducted for 4 hours while gradually heating to 220° C. and distilling away water and 1,4-butane diol produced in a nitrogen atmosphere and continued with a reduced pressure of from 0.007 MPa to 0.026 MPa while distilling away water and 1,4-butane diol. When the Mw was 16,000, the resultant was taken out to obtain [Crystalline polyester unit (a'-1)].

The compositions and properties of the crystalline polyester unit (a-1) to (a-6), and (a'-1) manufactured in Manufacturing Examples 1 to 7 are shown in Table 3-1.

TABLE 3-1

| | Crystalline polyester unit (a) | | | | | | |
|---|---|---|---|---|---|---|---|
| | a-1 | a-2 | a-3 | a-4 | a-5 | a-6 | a-7 |
| Acid | Sebacic acid | Sebacic acid | Sebacic acid | Sebacic acid | Dodecan diacid | Sebacic acid | Sebacic acid |
| Alcohol | 1,6-HD | 1,4-BD TMP | 1,6-HD-TMP | 1,6-HD 1,4-BD TMP | EG TMP | 1,6-HD 1,3-PD TMP | 1,4-BD TMP |
| Melting point (° C.) | 67 | 61 | 64 | 60 | 85 | 57 | 57 |
| Weight average molecular weight | 12,000 | 11,000 | 13,100 | 14,500 | 12,300 | 13,000 | 16,000 |
| Acid value (mgKOH/g) | 0.7 | 0.8 | 1.0 | 0.9 | 0.4 | 0.5 | 0.5 |
| Hydroxyl value (mgKOH/g) | 33 | 38 | 27 | 25 | 30 | 28 | 22 |

Manufacturing Example 8

Manufacturing of Crystalline Resin 3-A-1

150 parts of an adduct of bisphenol A with 2 mols of PO and 5 parts of ethylene diamine, 250 parts of ethyl acetate were placed in a reaction container equipped with a stirrer, heating-cooling equipment, a condenser tube, and a thermometer.

167 parts of diphenyl methane diisocyanate (MDI) was added thereto followed by 5 hour reaction at 80° C. and thereafter ethyl acetate was removed to obtain a non-crystalline unit having an isocyanate group at its end.

400 parts of [Crystalline polyester unit (a-1)] and 400 parts of ethyl acetate were placed in a reaction container equipped with a stirrer, heating-cooling equipment, a condenser tube, and a thermometer and heated to 70° C. followed by 2 hour stirring at the temperature for dissolution. Thereafter, 180 parts of the non-crystalline unit was added and the temperature was raised to 80° C. to conduct reaction for 5 hours to obtain [Crystalline resin (3-A-1)] by removing ethyl acetate.

Manufacturing Example 9

Manufacturing of Crystalline Resin 3-A-2

[Crystalline resin (3-A-2)] was obtained in the same manner as in Manufacturing Example 8 except that 5 parts of ethylene diamine was changed to 1 part of water and the content of MDI was changed to 159 parts.

Manufacturing Example 10

Manufacturing of Crystalline Resin 3-A-3

[Crystalline resin (3-A-3)] was obtained in the same manner as in Manufacturing Example 8 except that 5 parts of ethylene diamine was changed to 7 parts of hexamethylene diamine and the content of MDI was changed to 160 parts.

Manufacturing Example 11

Manufacturing of Crystalline Resin 3-A-4

[Crystalline resin (3-A-4)] was obtained in the same manner as in Manufacturing Example 8 except that 5 parts of ethylene diamine was changed to 1 part of diethylene triamine, and the content of MDI was changed to 148 parts.

Manufacturing Example 12

Manufacturing of Crystalline Resin 3-A-5

[Crystalline resin (3-A-5)] was obtained in the same manner as in Manufacturing Example 8 except that the content of MDI was changed to 176 parts and the crystalline polyester unit was changed to crystalline polyester unit (a-2).

Manufacturing Example 14

Manufacturing of Crystalline Resin 3-A-6

[Crystalline resin (3-A-6)] was obtained in the same manner as in Manufacturing Example 8 except that the content of MDI was changed to 157 parts and the crystalline polyester unit was changed to crystalline polyester unit (a-3).

Manufacturing Example 14

Manufacturing of Crystalline Resin 3-A-7

[Crystalline resin (3-A-7)] was obtained in the same manner as in Manufacturing Example 8 except that the content of MDI was changed to 153 parts and the crystalline polyester unit was changed to crystalline polyester unit (a-4).

Manufacturing Example 15

Manufacturing of Crystalline Resin 3-A-8

[Crystalline resin (3-A-8)] was obtained in the same manner as in Manufacturing Example 8 except that the content of MDI was changed to 162 parts and the crystalline polyester unit was changed to crystalline polyester unit (a-5).

Manufacturing Example 16

Manufacturing of Crystalline Resin 3-A-9

[Crystalline resin (3-A-9)] was obtained in the same manner as in Manufacturing Example 8 except that the content of MDI was changed to 158 parts and the crystalline polyester unit was changed to crystalline polyester unit (a-6).

Manufacturing Example 17

Manufacturing of Crystalline Resin 3-A-10

[Crystalline resin (3-A-10)] was obtained in the same manner as in Manufacturing Example 13 except that the content of MDI was changed to 150 parts and the content of the non-crystalline unit was changed to 230 parts.

Manufacturing Example 18

Manufacturing of Crystalline Resin 3-A-11

[Crystalline resin (3-A-11)] was obtained in the same manner as in Manufacturing Example 13 except that the content of MDI was changed to 146 parts and the content of the non-crystalline unit was changed to 280 parts.

Manufacturing Example 19

Manufacturing of Crystalline Resin 3-A-12

[Crystalline resin (3-A-12)] was obtained in the same manner as in Manufacturing Example 13 except that the content of MDI was changed to 143 parts and the content of the non-crystalline unit was changed to 330 parts.

Manufacturing Example 20

Manufacturing of Crystalline Resin A-13

[Crystalline resin (3-A-13)] was obtained in the same manner as in Manufacturing Example 13 except that the content of MDI was changed to 140 parts and the content of the non-crystalline unit was changed to 380 parts.

Manufacturing Example 21

Manufacturing of Crystalline Resin 3-A-14

[Crystalline resin (3-A-14)] was obtained in the same manner as in Manufacturing Example 13 except that the content of MDI was changed to 172 parts and the content of the non-crystalline unit was changed to 130 parts.

Manufacturing Example 22

Manufacturing of Crystalline Resin 3-A-15

[Crystalline resin (3-A-15)] was obtained in the same manner as in Manufacturing Example 13 except that the content of MDI was changed to 208 parts and the content of the non-crystalline unit was changed to 80 parts.

Manufacturing Example 23

Manufacturing of Crystalline Resin 3-A-16

[Crystalline resin (3-A-16)] was obtained in the same manner as in Manufacturing Example 8 except that the content of ethylene diamine was changed to 0 part and the content of MDI was changed to 142 parts.

Manufacturing Example 24

Manufacturing of Crystalline Resin Precursor A-0

[Crystalline resin (3-A-16)] was obtained in the same manner as in Manufacturing Example 8 except that the content of bisphenol A with 2 mols of PO as changed 0 part and the content of MDI was changed to 45 parts.

Manufacturing Example 25

Manufacturing of Crystalline Resin 3-A'-1

313 parts of [Crystalline polyester unit (a'-1)], 287 parts of 1,4-cyclohexabe dimethanol (CHDM), and 1,000 parts of ethyl acetate were placed in a reaction container equipped with a stirrer, a thermometer, a nitrogen-introducing tube, and a decompression unit while introducing nitrogen and the system was heated to 70° C., at which the system was stirred for 2 hours for dissolution. Subsequent to 400 parts of xylylene diisocyanate (XDI) addition to the system, the system was heated to 80° C. for reaction for 5 hours. After 3 parts of tertiary butyl alcohol was added, ethyl acetate was removed to obtain [Crystalline resin A'-1].

Manufacturing Example 26

Manufacturing of Crystalline Resin 3-A'-2

[Crystalline resin (3-A'-2)] was obtained in the same manner as in Manufacturing Example 22 except that the content of MDI was changed to 117 parts and the content of the non-crystalline unit was changed to 450 parts.

Manufacturing Example 27

Manufacturing of Crystalline Resin 3-A'-3

[Crystalline resin (3-A'-3)] was obtained in the same manner as in Manufacturing Example 23 except that the content of MDI was changed to 117 parts and the content of the non-crystalline unit was changed to 500 parts.

The compositions and properties of [Crystalline resin (3-A-1)] to [Crystalline resin (3-A'-3)] manufactured in Manufacturing Examples 8 to 27 are shown in Table 3-2.

TABLE 3-2

| Crystalline Resin | Crystalline polyester unit Kind | Content ratio (% by weight) | Kind of isocyanate — | Content ratio of urethane group (% by weight) | Content ratio of urea group (% by weight) | Melting point (° C.) | Weight average molecular weight (Mw) — |
|---|---|---|---|---|---|---|---|
| 3-A-1 | a-1 | 69 | MDI | 6.7 | 0.47 | 59.0 | 40,900 |
| 3-A-2 | a-1 | 69 | MDI | 6.9 | 0.32 | 59.0 | 41,900 |
| 3-A-3 | a-1 | 69 | MDI | 6.7 | 0.34 | 60.0 | 39,600 |
| 3-A-4 | a-1 | 69 | MDI | 7.1 | 0.06 | 59.0 | 47,500 |
| 3-A-5 | a-2 | 69 | MDI | 6.9 | 0.45 | 55.0 | 39,500 |
| 3-A-6 | a-3 | 69 | MDI | 6.4 | 0.48 | 57.0 | 39,500 |
| 3-A-7 | a-4 | 69 | MDI | 6.3 | 0.49 | 54.0 | 40,100 |
| 3-A-8 | a-5 | 69 | MDI | 6.5 | 0.47 | 79.0 | 40,900 |
| 3-A-9 | a-6 | 69 | MDI | 6.4 | 0.48 | 52.0 | 40,200 |
| 3-A-10 | a-3 | 63 | MDI | 7.3 | 0.58 | 59.0 | 40,200 |
| 3-A-11 | a-3 | 59 | MDI | 8.1 | 0.66 | 58.0 | 41,900 |
| 3-A-12 | a-3 | 55 | MDI | 8.7 | 0.73 | 57.0 | 42,400 |
| 3-A-13 | a-3 | 51 | MDI | 9.3 | 0.80 | 55.0 | 39,400 |
| 3-A-14 | a-3 | 75 | MDI | 5.4 | 0.36 | 60.0 | 41,700 |
| 3-A-15 | a-3 | 83 | MDI | 4.1 | 0.22 | 62.0 | 41,000 |
| 3-A-16 | a-1 | 69 | MDI | 7.1 | 0 | 60.0 | 40,000 |
| 3-A-0 | a-1 | 90 | MDI | 4.8 | 0 | 62.0 | 21,000 |
| 3-A'-1 | a'-1 | 31 | XDI | 25.1 | 0 | 51.0 | 120,600 |
| 3-A'-2 | a'-1 | 47 | MDI | 11.1 | 0 | 53.0 | 41,400 |
| 3-A'-3 | a'-1 | 44 | MDI | 11.5 | 0 | 52.0 | 38,900 |

Manufacturing Example 28

Manufacturing of Particulate Liquid Dispersion 1

The following recipe was placed in a container equipped with a stirrer, heating-cooling equipment, a condenser tube, and a thermometer and stirred at 350 rpm for 15 minutes to obtain a white emulsion:

Water: 690.0 parts

Sodium salt of sulfate of an adduct of methacrylic acid with ethyleneoxide (EREMINOR RS-30, manufactured by Sanyo Chemical Industries, Ltd.): 9.0 parts Styrene: 90.0 parts Methacrylic acid: 90.0 parts Butyl acrylate: 110.0 parts Ammonium persulfate: 1.0 part Thereafter, the temperature was raised to 75° C., at which the reaction was conducted for 5 hours.

Furthermore, 30 parts of 1% by weight ammonium persulfate aqueous solution was added followed by aging at 75° C. for 5 hours to obtain [Particulate liquid dispersion 1] of a vinyl resin (copolymer of styrene-methacrylic acid-butyl acrylate-sodium salt of sulfate of an adduct of methacrylic acid with ethyleneoxide).

The volume average particle diameter of the particles dispersed in [Particulate liquid dispersion 1] was 0.1 nm as measured by a laser diffraction/scattering type particle size distribution analyzer (LA-920, manufactured by Horiba Ltd.).

Part of [Particulate liquid dispersion 1] was taken out and Tg and Mw thereof were measured. Tg was 65° C. and Mw was 150,000.

Manufacturing Example 29

Manufacturing of Particulate Liquid Dispersion 2

The following recipe was placed in a container equipped with a stirrer and a thermometer while introducing nitrogen:

Polyester diol (hydroxyl value: 44): ethylene glycol and sebacic acid: 379.7 parts 2,2-dimethylol propionic acid: 26.9 parts N,N-bis(2-hydroxyethy)sulfamic acid: 2.4 parts Isophorone diisocyanate: 76 parts Acetone: 500 parts Thereafter, the system was heated to 90° C. to conduct urethanification reaction in 40 hours to manufacture a crystalline urethane resin (C-8) having a hydroxyl group at its end.

The content of NCO in the crystalline urethane resin (C-8) was 0% by weight. 1,800 parts of decane was placed in a reaction device equipped with a stirrer, a thermometer, and a solvent-removing device and heated to 40° C.

Thereafter, 836 parts of acetone solution of the crystalline urethane resin (C-8) heated to 40° C. was placed therein while stirring to emulsify (c-8) followed by removing acetone to obtain [Particulate liquid dispersion 2] containing (c-8).

The volume average particle diameter of [Particulate liquid dispersion 2] was 0.20 μm as measured by ELS-800.

Manufacturing Example 30

Manufacturing of Colorant Liquid Dispersion

The following recipe was placed in a reaction container equipped with a stirrer, heating-cooling equipment, a thermometer, a condenser tube, and a nitrogen-introducing tube and reacted at 180° C. in nitrogen atmosphere for 8 hours while removing produced methanol:

Popylene glycol: 557 parts (17.5 parts by mol)

Terephthalic acid dimethyl ester: 569 parts (7.0 parts by mol)

Adipic acid: 184 parts (3.0 parts by mol)

Tetrabuthoxy titanate (condensing catalyst): 3 parts

Next, the system was gradually heated to 230° C. to conduct reaction for 4 hours while distilling away produced water and 1,4-butane diol in a nitrogen atmosphere and the reaction was further conducted with a reduced pressure of from 0.007 mmHg to 0.026 mmHg for 1 hour.

The collected propylene glycol was 175 parts (5.5 parts by mol).

Subsequent to cooling down to 180° C., 121 parts of trimellitic anhydiride (1.5 parts by mol) was added to the container to conduct reaction for 2 hours at a normal pressure and sealed environment and thereafter continue the reaction at 220° C. and normal pressure until the softening point was 180° C. to obtain a polyester resin (Mn=8,500).

20 parts of copper phthalocyanine, 4 parts of a colorant dispersing agent (Solsperse® 28000, manufactured by Avecia Group), 20 parts of the thus-obtained polyester resin, and 56 parts of ethyl acetate were placed in a beaker and stirred for uniform dispersion. Copper phthalocyanine was finely-dispersed by bead mill to obtain [Colorant liquid dispersion].

The volume average particle diameter of [Colorant liquid dispersion] was 0.2 μm as measured by LA-920.

Manufacturing Example 31

Manufacturing of Modified Wax 454 parts of xylene and 150 parts of a low-molecular weight polyethylene (SANWAX LEL-400: softening point: 128° C., manufactured by SANYO KASEI Co., Ltd.) were placed in a pressure tight reaction container equipped with a stirrer, heating-cooling equipment, a thermometer, and a dropping bottle followed by nitrogen substitution and the temperature was raised to 170° C. while stirring, at which a liquid mixture of 595 parts of styrene, 255 parts of methyl methacrylate, 34 parts of di-t-butyl peroxy hexahydro terephathalate, and 119 parts of xylene were dropped followed by 30-minute keeping at the same temperature.

Thereafter, xylene was removed under a pressure of 0.039 MPa to obtain a modified wax.

The modified wax has an SP value of graft chain of 10.35 $(cal/cm^3)^{1/2}$, an Mn of 1,900, Mw of 5,200, and a Tg of 56.9° C.

Manufacturing Example 32

Manufacturing of Releasing Agent Liquid Dispersion 10 parts of paraffin wax (HNP-9: Melting heat maximum peak temperature: 73° C., manufactured by Nippon Seiro Co., Ltd.), 1 part of the modified wax obtained in Manufacturing Example 36, and 33 parts of ethyl acetate were placed in a reaction container equipped with a stirrer, heating-cooling equipment, a thermometer, and a condenser tube and the temperature was raised to 78° C. while stirring. At the temperature, stirring was kept for 30 minutes followed by cooling-down to 30° C. to finely-crystallize paraffin wax, the resultant was wet-pulverized by an ULTRAVISCO MILL (manufactured by IMEX Co., Ltd.) to obtain [Releasing agent liquid dispersion].

The volume average particle diameter thereof was 0.25 μm.

Manufacturing Example 33

Manufacturing of Resin Solution (D-1)

30 parts of [Colorant liquid dispersion], 140 parts of [Releasing agent liquid dispersion], 85 parts of [Crystalline resin (3-A-1), 30 parts of [Precursor (A-0) solution], and 138 parts of ethyl acetate were placed and stirred in a reaction container equipped with a stirrer and a thermometer to uniformly dissolve [Crystalline resin (3-A-1)] to obtain [Resin solution (D-1)].

Manufacturing Examples 34 to 56

Manufacturing of Resin Solutions (D-2) to (D-24)

[Resin solution (D-2)] to [Resin solution (D-24)] were obtained in the same manner as in manufacturing Example 33 except that the contents were changed as shown in Table 3-3.

TABLE 3-3

| Solution | Colorant liquid dispersion (parts) | Releasing agent liquid dispersion (parts) | Crystalline resin (A) Kind | Crystalline resin (A) Content (parts) | Crystalline resin precursor (A-0) (parts) | Organic solvent (C) Ethyl acetate (parts) |
|---|---|---|---|---|---|---|
| 3-D-1 | 30 | 140 | 3-A-1 | 85 | 30 | 138 |
| 3-D-2 | 30 | 140 | 3-A-2 | 85 | 30 | 138 |
| 3-D-3 | 30 | 140 | 3-A-3 | 85 | 30 | 138 |
| 3-D-4 | 30 | 140 | 3-A-4 | 85 | 30 | 138 |
| 3-D-5 | 30 | 140 | 3-A-5 | 85 | 30 | 138 |
| 3-D-6 | 30 | 140 | 3-A-6 | 85 | 30 | 138 |
| 3-D-7 | 30 | 140 | 3-A-7 | 85 | 30 | 138 |
| 3-D-8 | 30 | 140 | 3-A-8 | 85 | 30 | 138 |
| 3-D-9 | 30 | 140 | 3-A-9 | 85 | 30 | 138 |
| 3-D-10 | 30 | 140 | 3-A-10 | 85 | 30 | 138 |
| 3-D-11 | 30 | 140 | 3-A-11 | 85 | 30 | 138 |
| 3-D-12 | 30 | 140 | 3-A-12 | 85 | 30 | 138 |
| 3-D-13 | 30 | 140 | 3-A-13 | 85 | 30 | 138 |
| 3-D-14 | 30 | 140 | 3-A-14 | 85 | 30 | 138 |
| 3-D-15 | 30 | 140 | 3-A-15 | 85 | 30 | 138 |
| 3-D-16 | 30 | 140 | 3-A-16 | 85 | 30 | 138 |
| 3-D-17 | 30 | 140 | 3-A'-1 | 85 | 0 | 138 |
| 3-D-18 | 30 | 140 | 3-A'-2 | 85 | 0 | 138 |
| 3-D-19 | 30 | 140 | 3-A'-3 | 85 | 0 | 138 |

Example 3-1

Manufacturing of Toner (S-1)

170.2 parts of deionized water, 0.3 parts of [Particulate liquid dispersion], 1 part of carboxy methyl cellulose sodium, 36 parts of 48.5% by weight aqueous solution of sodium dodecyldiphenyl etherdisulfonate (EREMINOR MON-7, manufactured by Sanyo Chemical Industries, Ltd.), and 15.3 parts of ethyl acetate were placed and stirred in a beaker to be uniformly dissolved.

Then, the system was heated to 50° C. and thereafter 75 parts of [Resin solution (D-19] was placed while stirred at 10,000 rpm for 2 minutes by a TK HOMOMIXER.

Thereafter, the liquid mixture was transferred to a reaction container equipped with a stirrer and a thermometer. Ethyl acetate was distilled away until the concentration at 50° C. was 0.5% by weight or less to obtain [Aqueous resin liquid dispersion] of toner particles.

Next, [Aqueous resin liquid dispersion] was filtered and dried at 40° C. for 18 hours so that the volatile portion was 0.5% by weight or less to obtain toner particles.

Thereafter, 10 parts of toner particles and 0.05 parts of colloidal silica (AEROSIL® R972, manufactured by Nippon Aerosil Co., Ltd.) were mixed by a sample mill to obtain [Toner (S-1)].

Examples 3-2 to 3-16 and Comparative Examples 3-1 to 3-3

Manufacturing of Toner (S-2) to Toner (S-16), (S'-1) to (S'-3)

[Toner (S-2)] to [Toner (S-16)] and [Toner (S'-1)] to [Toner (S'-3)] were manufactured in the same manner as in Example 3-1 except that 75 parts of [Resin solution (D-1)] was changed to 75 parts of [Resin solution (D-2)] to [Resin solution (D-16)] and [Resin solution (D'-1)] to [Resin solution (D'-3)].

Martens hardness, the volume average particle diameter, and the particle size distribution of [Toner (S-2)] to [Toner (S-16)] and [Toner (S'-1)] to [Toner (S'-3)] were measured by the following methods and evaluated with regard to the low temperature fixability, high temperature stability, and the damage to image during transfer in paper path The results are shown in Table 3-4.

[1] Martens Hardness

After about 5 g of toner was placed in a die having a diameter of 40 mm and melt-molded by applying heat and pressure at 120° C. under a load of 0.5 kN by using a precision hot press, the toner was cooled down to 20° C. while maintaining the load to obtain a smooth toner melt-molded product having a disk-like form with the upper and lower surfaces thereof parallel to each other.

With regard to Martens hardness, the toner melt-molded product was melted at a temperature, for example, 100° C. at which the form of the toner can be held without deformation.

Thereafter, the temperature was cooled down from 100° C. to 50° C. At 15 minutes after the temperature was cooled down to 50° C., the toner was measured by a microhardness tester (Fischer Scope H100, manufactured by Fischer Instruments K.K.) while heating the toner on the hot plate The toner was measured 4 times to calculate the average.

Indenter: Square corn indenter

Load: 250 mN

Force application time: 30 s

Force maintaining time: 5 s

[2] Volume Average Particle and Particle Size Distribution

Toner was dispersed in water and the volume average particle diameter and the particle size distribution were measured by Coulter counter (Multisizer (II), manufactured by Beckman Coulter, Inc.

[3] Low Temperature Fixability

After 1.0% by weight of AEROSIL® R972 (manufactured by Nippon Aerosil Co., Ltd.) was added to toner and uniformly mixed therewith, the thus-obtained powder was uniformly placed on paper such that the density was 0.6 mg/cm$^2$. A printer from which a heat fixing device was removed was used to place the powder on paper.

Any method that can uniformly place powder on paper is suitably usable.

The cold offset occurring temperature was measured under the conditions of the paper passing through the pressure roller at a fixing speed (heating roller peripheral speed) of 213 mm/sec and a fixing pressure of (pressure of the pressure roller) of 10 kg/cm$^2$.

A lower cold offset occurring temperature means excellent lower temperature fixability.

[4] Damage to Image during Transfer

A solid image having a toner attachment amount of from 0.75 mg/cm$^2$ to 0.95 mg/cm$^2$ after image transfer was formed on a transfer sheet (Type 6200, manufactured by RICOH CO., LTD.) using the image forming apparatus 100A and fixing was conducted at a temperature 10° C. higher than the lower limit of the fixing temperature of the toner. The degree of the damage to the image caused by the discharging roller (the discharging roller 56 in FIG. 5) during transfer in the paper path was evaluated according to the following criteria:

The speed of the transfer sheet passing through the nipping portion of the fixing device was 280 mm/s, which was conducted for A4 size in the landscape direction.

The results are shown in Table 3-4.

G (Good): No damage to image during transfer in the paper path

F (Fair): Slightly damaged but causing no practical problem

B (Bad): Significantly damaged causing a practical problem

TABLE 3-4

| | Toner | C/(C + A) | Martens hardness (N/mm$^2$) | T1 (° C.) | T2 (° C.) | T1 − T2 (° C.) | Dv (μm) | Dv/Dn | Low temp. fixability | Damage to image in paper path |
|---|---|---|---|---|---|---|---|---|---|---|
| Example 1 | S-1 | 0.25 | 45 | 59 | 36 | 23 | 5.8 | 1.2 | 100 | G |
| Example 2 | S-2 | 0.24 | 41 | 60 | 37 | 23 | 5.2 | 1.2 | 100 | G |
| Example 3 | S-3 | 0.25 | 42 | 59 | 38 | 21 | 5.4 | 1.18 | 100 | G |
| Example 4 | S-4 | 0.25 | 52 | 59 | 37 | 22 | 5.2 | 1.22 | 105 | G |
| Example 5 | S-5 | 0.23 | 423 | 55 | 34 | 21 | 5.7 | 1.19 | 95 | G |
| Example 6 | S-6 | 0.24 | 61 | 58 | 36 | 22 | 5.6 | 1.2 | 100 | G |
| Example 7 | S-7 | 0.23 | 41 | 55 | 34 | 21 | 5.8 | 1.2 | 95 | G |
| Example 8 | S-8 | 0.29 | 53 | 80 | 60 | 20 | 5.2 | 1.2 | 120 | G |
| Example 9 | S-9 | 0.20 | 37 | 51 | 30 | 21 | 5.4 | 1.18 | 90 | F |
| Example 10 | S-10 | 0.24 | 44 | 59 | 35 | 24 | 5.5 | 1.19 | 100 | G |
| Example 11 | S-11 | 0.20 | 48 | 59 | 33 | 26 | 5.8 | 1.19 | 105 | G |
| Example 12 | S-12 | 0.18 | 56 | 57 | 31 | 26 | 5.6 | 1.2 | 110 | G |
| Example 13 | S-13 | 0.16 | 66 | 56 | 28 | 28 | 5.7 | 1.19 | 120 | G |
| Example 14 | S-14 | 0.27 | 35 | 61 | 41 | 20 | 5.4 | 1.21 | 100 | F |
| Example 15 | S-15 | 0.30 | 24 | 61 | 45 | 16 | 5.1 | 1.18 | 90 | F |
| Example 16 | S-16 | 0.26 | 38 | 61 | 40 | 21 | 5.5 | 1.22 | 100 | F |
| Comparative Example 1 | S'-1 | 0.10 | 95 | 51 | 13 | 38 | 5.7 | 1.19 | 150 | B |
| Comparative Example 2 | S'-2 | 0.14 | 77 | 52 | 20 | 32 | 5.7 | 1.22 | 125 | B |
| Comparative Example 3 | S'-3 | 0.13 | 84 | 51 | 18 | 33 | 5.4 | 1.21 | 130 | B |

The measuring methods of Example 4-1 are described below:

The results are shown in Tables 4-1 and 4-2.

Molecular Weight

The molecular weights {Number average molecular weight (Mn), Weight average molecular weight (Mw), peak top molecular weight (Mpt), and molecular weight distribution} of the toner were measured by using a gel permeation chromatography (GPC) (HLC-8220-GPC, manufactured by TOSOH CORPORATION).

The column was TSK gel Super HZM-M 15 cm triplet (manufactured by TOSOH CORPORATION).

30 mg of the toner was placed in 20 ml of tetrahydrofuran (THF) (containing a stabilizer, manufactured by Wako Pure Chemical Industries, Ltd.). Subsequent to one hour stirring, the mixture was filtered using a filter having an opening of 0.2 μm to obtain the filtrate as a sample.

100 μl of the sample was infused into the measuring instrument and measured under the condition that the temperature was 40° C. and the flow speed was 0.35 ml/min.

The molecular weight of the sample was calculated by using a standard curve made by mono-dispersed polystyrene standard samples.

The mono-dispersed polystyrene standard samples were Showdex STANDARD SERIES (manufactured by SHOWA DENKO K.K.) and toluene.

THF solutions for the following three kinds of mono-dispersed polystyrene standard samples were prepared for measuring under the conditions described above; and a standard curve was drawn by setting the maintaining time of the peak top as the light scattering molecular weight of the mono-dispersed polystyrene standard samples.

A refractive index (RI) detector was used as the detector.

Solution A: S-7450: 2.5 mg
S-678: 2.5 mg
S-46.5: 2.5 mg
S-290: 2.5 mg
THF: 50 ml
Solution B: S-3730: 2.5 mg
S-257: 2.5 mg
S-19.8: 2.5 mg
S-0.580: 2.5 mg
THF: 50 ml
Solution C: S-1470: 2.5 mg
S-112: 2.5 mg
S-6.93: 2.5 mg
toluene: 2.5 mg
THF: 50 ml The ratio of the component having a molecular weight of 100,000 or more was obtained by the intersection of the curve of the molecular weight of 100,000 in the thus-obtained integral molecular weight distribution curve.

The ratio of the component having a molecular weight of 250,000 or more was obtained by the intersection of the curve of the molecular weight of 250,000 in the thus-obtained integral molecular weight distribution curve.

The tetrahydrofuran (THF) soluble in the following measuring of the decomposed residue was obtained by: placing 30 mg of the toner in 20 ml of tetrahydrofuran (THF) (containing a stabilizer, manufactured by Wako Pure Chemical Industries, Ltd.); and subsequent to one hour stirring, filtering the mixture using a filter having an opening of 0.2 μm Decomposed Residue The decomposed residue was measured by the following method:

1 g of the THF soluble obtained by the method described above and 100 ml of 0.1 normal methanol solution of potassium hydroxide was added thereto to conduct decomposition reaction at 50° C. for 24 hours while gently stirring.

Thereafter, the system was cooled down to room temperature, the decomposed residue product was washed with 20 ml of methanol at room temperature. Subsequent to washing with 20 ml of deionized water three times, the resultant was vacuum-dried at 50° C. for 12 hours to obtain the decomposed residue.

The thus-obtained decomposed residue was weighed and divided by the amount of sample obtained before decomposition to calculate the ratio of the decomposed residue (% by weight).

Synthesis of Crystalline Polyester Unit 1

249 parts of 1,6-hexane diol, 394 parts of sebacic acid, and 0.8 parts of dibutyl tin oxide were placed in a reaction container equipped with a condenser, a stirrer and a nitrogen introducing tube to conduct a reaction at 180° C. at normal pressure for 6 hours.

Then, the resultant was reacted for 4 hours with a reduced pressure of from 10 mmHg to 15 mm Hg to synthesize [Crystalline polyester unit 1].

The thus-obtained [Crystalline polyester unit 1] had a number average molecular weight of 4,000, a weight average molecular weight of 9,100, and a melting point of 66° C.

Synthesis of Polyurethane Prepolymer 1

Next, 235 parts of an adduct of bisphenol A with 2 mols of propylene oxide, 10 parts of propylene glycol, 254 parts of 4,4'-diphenyl methane diisocyanate, and 600 parts of ethyl acetate were placed in a reaction container equipped with a condenser, stirrer, and a nitrogen introducing tube to conduct reaction at 80° C. for 3 hours at normal pressure to prepare [Polyurethane prepolymer 1].

The thus-obtained [Polyurethane prepolymer 1] had a number average molecular weight of 2,600.

Synthesis of Resin 4-A-1

Next, [Resin 4-A-1] formed of a crystalline polyester unit and a polyurethane prepolymer unit was obtained by placing 430 parts of [Crystalline polyester unit 1], 176 parts of [Polyurethane prepolymer 1], and 400 parts of ethyl acetate in a reaction container equipped with a condenser, stirrer and a nitrogen introducing tube to conduct reaction at 80° C. for 5 hours.

The thus-obtained [Resin 4-A-1] had a number average molecular weight of 10,100, a weight average molecular weight of 31,000, a nitrogen atom concentration of 1.7% by weight, and a melting point of 65° C.

Manufacturing of Resin 4-B-1

Next, 391 parts of [Crystalline polyester unit 1], 47 parts of 4,4'-diphenyl methylene diisocyanate, and 438 parts of ethyl acetate are placed in a reaction container equipped with a condenser, stirrer and a nitrogen introducing tube to conduct reaction at 82° C. for 5 hours to prepare [Resin 4-B-1] as a polyester prepolymer.

Manufacturing of Colorant Liquid Dispersion 1

20 parts of copper phthalocyanine, 4 parts of a colorant dispersing agent (Solsperse® 28000, manufactured by Avecia Group), and 76 parts of ethyl acetate were placed in a beaker and stirred for uniform dispersion. Thereafter, copper phthalocyanine was finely-dispersed by bead mill to obtain [Colorant liquid dispersion 1].

The volume average particle diameter of [Colorant liquid dispersion 1] was 0.3 μm as measured by LA-920.

Manufacturing of Releasing Agent Liquid Dispersion 1

15 parts of paraffin wax (HNP-9, manufactured by NIPPON SEIRO CO., LTD.) and 85 parts of ethyl acetate were placed in a reaction container equipped with a condenser, a thermometer, and a stirrer. The system was heated to 78° C. to dissolve the wax sufficiently followed by cooling down to 30° C. in one hour while stirring. Thereafter, the resultant was wet-pulverized under the conditions of: liquid transfer speed 1.0 kg/h; disk circumferential speed: 10 m/s; filling amount of 0.5 mm zirconia beads: 80% by volume; number of passes: 6 times.

Thereafter, ethyl acetate was added such that the concentration of the solid portion was 15% to obtain [Releasing agent liquid dispersion 1].

Preparation of Toner Liquid Material 1

84 parts of [Resin 4-A-1], 32 parts of [Resin 4-B-1], 14 parts of [Releasing agent liquid dispersion 1], 10 parts of [Colorant liquid dispersion 1], 0.06 parts of a nucleating gent (ADK STAB NA-11, melting point: 400° C., manufactured by ADEKA Co., Ltd.), and 84 parts of ethyl acetate were placed in a beaker. The resin was dissolved while being stirred at 50° C. and the solution was stirred at 8,000 rpm by a TK HOMOMIXER for uniform dispersion to obtain [Toner liquid material 1].

99 parts of deionized water, 6 parts of 25% by weight aqueous liquid dispersion of organic resin particulates (a copolymer of styrene-methacrylic acid-butyl acrylate-a sodium salt of sulfate of an adduct of methacrylic acid with ethyleneoxide) for stabilizing dispersion, 1 part of carboxymethyl cellulose sodium, and 10 parts of 48.5% aqueous solution of sodium dodecyldiphenyl etherdisulfonate (EREMINOR MON-7, manufactured by Sanyo Chemical Industries, Ltd.) were placed in a beaker to dissolve them uniformly.

Then, 75 parts of [Toner liquid material 1] was placed in another beaker and stirred at 50° C. for 2 minutes at 10,000 rpm by a TK HOMOMIXER.

Thereafter, this liquid mixture was transferred to a flask equipped with a stirrer and a thermometer. Ethyl acetate was distilled away until the concentration at 55° C. was 0.5% by weight or less to obtain [Aqueous resin liquid dispersion of resin particle].

After [Aqueous resin liquid dispersion of resin particle] was cooled down to room temperature and filtered, 30 parts of the thus-obtained filtered cake was added thereto and mixed at 12,000 rpm for 10 minutes by a TK HOMOMIXER followed by filtration twice to obtain a filtered cake.

Thereafter, 300 parts of deionized water was added to the thus-obtained filtered cake and mixed at 12,000 rpm for 10 minutes by a TK HOMOMIXER followed by filtration three times. 300 parts of 1% by weight hydrochloric acid was added to the filtered. The resultant was mixed at 12,000 rpm for 10 minutes by a TK HOMOMIXER followed by filtration.

300 parts of deionized water was added to the thus-obtained filtered cake. After the resultant was mixed at 12,000 rpm for 10 minutes by a TK HOMOMIXER, filtration was conducted twice to obtain a filtered cake.

The thus-obtained filtered cake was pulverized and dried at 40° C. for 22 hours to obtain [Resin particle 1] having a volume average particle diameter of 5.6 μm.

100 parts of the thus-obtained [Resin particle 1] and 1.0 part of hydrophobic silica (H-2000, manufactured by Clariant Japan K.K.) serving as an external additive were mixed by a HENSCEL MIXER (manufactured by NIPPON COKE & ENGINEERING CO., LTD.) at a peripheral speed of 30 m/s for 30 seconds followed by one-minute break. This cycle was repeated five times and the resultant was screened with a mesh having an opening of 35 μm to manufacture [Toner 1].

Evaluation

The thus obtained [Toner 1] was evaluated as follows:

The results are shown in Table 4-3.

Low Temperature Fixability

A solid image having a width of 50 mm was formed on thin paper having a machine translation along the longitudinal direction (photocopying paper <55>, manufactured by Ricoh Co., Ltd.) with an attachment amount of the toner of from 0.75 mg/cm$^2$ to 0.95 mg/cm$^2$.

To be specific, using a machine remodeled based a color laser printer (IPSiO SP C420, manufactured by Ricoh Co., Ltd.) in which the fixing device was remodeled, images were formed at a linear speed of 300 mm/min and passed through the fixing device while controlling the temperature of the fixing member externally.

Next, with regard to the post-fixing image, a sapphire needle of 125 μR was moved on the colored portion of the fixed image by an automatic drawing machine (AD-401, manufactured by Ueshima Seisakusho Co., Ltd.) under the conditions of a needle rotation diameter of 8 mm and a load of 1 g and the traveling surface of the point of the sapphire needle was observed to determine the temperature below which scratch occurs as the lower limit of the fixing temperature.

Toner Durability

The toner was set on a color laser printer (IPSiO SP C420, manufactured by RICOH CO., LTD.), which was remodeled such that the processing speed was controlled externally. A blank image was output at a sheet output linear speed of 600 mm/min with a run length of 1,000 sheets.

Thereafter, the development agent was collected and the toner therein was observed by a scanning electron microscope to evaluate the degradation degree of the toner according the following evaluation criteria:

The degree evaluated as F (Fair) is acceptable but, as B (Bad) and VB (Very bad). not acceptable.

Evaluation Criteria

E (Excellent): No toner aggregation observed

G (Good): Aggregation of a couple of toner particles slightly observed but no melting and fusion between aggregated particles observed.

F (Fair): Aggregation of several toner particles observed but no melting and fusion between aggregated particles observed.

B (Bad): Aggregation of several toner particles observed and melting and bonding between aggregated particles slightly observed.

VB (Very bad): Aggregation of toner particles observed and clearly aggregated particles clearly melted and bonded High Temperature Stability A glass container was filled with the toner and left in a constant temperature bath at 55° C. for 24 hours.

Subsequent to cooling-down to 24° C., the penetration degree of the toner was measured by a needle penetration test (according to JIS K2235-1991).

A larger needle penetration degree indicates better thermal stability.

Toner having a needle penetration value less than 15 mm is likely to cause a practical problem.

The needle penetration degree was evaluated as follows:

The evaluation criteria of the high temperature stability were as follows:

E (Excellent): Penetrated

G (Good): 25 mm to less than penetrated

F (Fair): 20 mm to less than 25 mm

B (Bad): 15 mm to less than 20 mm

VB (Very bad): less than 15 mm

TABLE 4-1

| | Toner liquid material | Resin 4-A-1 (parts by weight) | Resin 4-A-2 (parts by weight) | Resin 4-A-3 (parts by weight) | Resin 4-A-4 (parts by weight) | Resin 4-A-5 (parts by weight) | Resin 4-B-1 (parts by weight) | Resin 4-B-2 (parts by weight) |
|---|---|---|---|---|---|---|---|---|
| Example 4-1 | 11 | 84 | — | — | — | — | 1 | — |

The properties of the toner obtained in Example 1 are shown in Tables 4-2-1 and 4-2-2.

TABLE 4-2-1

| | Mn | Mw | Mpt | Component having a molecular weight of 100,000 or greater (%) | Component having a molecular weight of 2500,000 or greater (%) | Mw/Mn | Decomposed residue |
|---|---|---|---|---|---|---|---|
| Example 4-1 | 12,400 | 53,100 | 43,600 | 13.4 | 1.2 | 4.28 | 16.7 |

| | Amount of nitrogen (% by weight) | Amount of crystalline structure {C/C + A} | Urethane bonding | Urea bonding |
|---|---|---|---|---|
| Example 4-1 | 1.5 | 0.27 | Yes | Yes |

TABLE 4-2-2

| | Insoluble in liquid mixture (% by weight) | Endothermic amount ΔH (T) | Endothermic amount ΔH (H) | Endothermic amount ΔH(T)/ΔH (T) | Melting heat Maximum peak temp. (° C.) | Melting heat Amount of melting heat (J/g) | Endothermic maximum peak temp. T1 (° C.) | Exothermic maximum peak temp. T2 (° C.) |
|---|---|---|---|---|---|---|---|---|
| Example 4-1 | 13.8 | 65.1 | 46.7 | 0.72 | 67.0 | 65.1 | 65.0 | 38.0 |

TABLE 4-3

| | Evaluation Results Lower limit of fixing temperature (° C.) | Toner durability | High temperature stability |
|---|---|---|---|
| Example 4-1 | 105 | E | E |

According to the present invention, toner is provided which solves an issue peculiar to toner containing a crystalline resin such as crystalline polyester resin, that is damage receiving immediately after heat fixing during transfer of an image in the transfer path in an image forming apparatus, without having an adverse impact on the low temperature fixability while striking a balance between the low temperature fixability and the high temperature stability at a high level, and a development agent, an image forming apparatus, and a process cartridge that use the toner are also provided.

Having now fully described embodiments of the present invention, it will be apparent to one of ordinary skill in the art that many changes and modifications can be made thereto without departing from the spirit and scope of embodiments of the invention as set forth herein.

What is claimed is:

1. A toner, comprising:

a binder resin comprising a crystalline polyester resin having a urethane and/or urea bonding; and a colorant, wherein in a diffraction spectrum of the toner as measured by an X-ray diffraction instrument, a ratio {C/(C+A)} of an integral intensity C of a spectrum derived from a crystalline structure to an integral intensity A of a spectrum derived from a non-crystalline structure is 0.16 or greater, wherein the toner satisfies the following relation 1:

$$T1-T2\leq 30^\circ\ \text{C.} \qquad \text{Relation 1}$$

where T1 represents a maximum endothermic peak in a first temperature rising from 0° C. to 100° C. at a temperature rising rate of 10° C./min and T2 represents a maximum exothermic peak in a first temperature falling from 100° C. to 0° C. at a temperature falling rate of 10° C./min as T1 and T2 are measured by diffraction scanning calorimetry (DSC).

2. The toner according to claim 1, wherein T2 satisfies the following relation 2:

$$T2\geq 30^\circ\ \text{C.} \qquad \text{Relation 2}$$

3. The toner according to claim 1, wherein the crystalline polyester resin further comprises a non-modified crystalline resin.

4. The toner according to claim 3, wherein a ratio of the non-modified crystalline polyester resin is from 2% by weight to less than 50% by weight in the crystalline resin.

5. The toner according to claim 1, further comprising a nucleating agent.

6. The toner according to claim 1, wherein a melt molded product of the toner has a Martens hardness of 20 $N/m^2$ or more at 50° C.

7. The toner according to claim 1, wherein a tetrahydrofuran soluble of the toner contains a component having a molecular weight of 100,000 or greater in an amount of 5.0% or greater of a peak area in a molecular weight distribution as measured by gel permeation chromatography, wherein a ratio of decomposed residue of the tetrahydrofuran soluble insoluble in methanol is 5.0% by weight or greater when the tetrahydrofuran soluble is decomposed in 0.1 N KOH methanol solution.

8. The toner according to claim 1, wherein the crystalline polyester resin having a urethane and/or urea bonding comprises a crystalline polyester polyester resin having a urea bonding.

9. The toner according to claim 1, wherein the crystalline polyester resin having a urethane and/or urea bonding comprises a crystalline polyester resin having a urethane and/or urea bonding formed by elongating a modified crystalline polyester resin having an isocyanate group at an end thereof.

10. The toner according to claim 1, wherein TI satisfies the following relation 3:

$$50^\circ\ \text{C.}<T1<70^\circ\ \text{C.} \qquad \text{Relation 3.}$$

11. The toner according to claim 1, prepared by granulating toner particles by dispersing and/or emulsifying in an aqueous medium an oil phase in which a toner composition comprising a binder resin, a coloring agent, and an organically modified laminate inorganic mineral is dissolved and/or dispersed in an organic solvent.

12. The toner according to claim 11, wherein elongation reaction is conducted between an active hydrogen group and a modified crystalline polyester resin having an isocyanate group at an end thereof when granulating the toner particles by dispersion and/or emulsification in the aqueous medium.

13. A development agent comprising:

the toner of claim 1; and carrier.

14. The toner according to claim 1, which further comprises a releasing agent.

15. The toner according to claim 14, wherein the releasing agent accounts for 3 parts by weight to 10 parts by weight to 100 parts by weight of the toner.

16. The toner according to claim 1, wherein the content of the crystalline polyester resin in the toner is 75% by weight or more.

17. The toner according to claim 1, wherein the content of the crystalline polyester resin in the toner is 80% by weight or more.

18. A process cartridge comprising:

a latent electrostatic image bearing member to bear a latent electrostatic image; and a development device to develop the latent electrostatic image with a toner to form a visible image, wherein the development device contains the toner of claim 1, wherein the process cartridge is detachably attachable to an image forming apparatus.

* * * * *